US010182281B2

(12) United States Patent
Igarashi et al.

(10) Patent No.: US 10,182,281 B2
(45) Date of Patent: Jan. 15, 2019

(54) SOUND OUTPUT DEVICE AND SOUND GUIDING DEVICE

(71) Applicant: SONY CORPORATION, Tokyo (JP)

(72) Inventors: Go Igarashi, Tokyo (JP); Satoshi Suzuki, Kanagawa (JP); Kohei Asada, Kanagawa (JP); Koji Nageno, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/521,288

(22) PCT Filed: Aug. 5, 2015

(86) PCT No.: PCT/JP2015/072187
§ 371 (c)(1),
(2) Date: Apr. 22, 2017

(87) PCT Pub. No.: WO2016/067700
PCT Pub. Date: May 6, 2016

(65) Prior Publication Data

US 2017/0311070 A1 Oct. 26, 2017

(30) Foreign Application Priority Data

Oct. 30, 2014 (JP) ..... 2014-220918

(51) Int. Cl.
*H04R 1/10* (2006.01)
*H04R 1/20* (2006.01)

(52) U.S. Cl.
CPC ..... *H04R 1/1016* (2013.01); *H04R 1/1066* (2013.01); *H04R 1/1075* (2013.01);
(Continued)

(58) Field of Classification Search
CPC .. H04R 1/1016; H04R 1/1075; H04R 1/1008; H04R 1/1066; H04R 1/105; H04R 1/20;
(Continued)

(56) References Cited

U.S. PATENT DOCUMENTS 3,098,127 A * 7/1963 Huth ..... H04R 25/402 381/322
4,381,830 A * 5/1983 Jelonek ..... H04R 25/48 381/312

(Continued)

FOREIGN PATENT DOCUMENTS

AU 7153996 A 4/1997
AU 4552499 A 2/2000

(Continued)

OTHER PUBLICATIONS

Extended European Search Report of EP Application No. 158550416, dated May 17, 2018, 07 pages of EESR.

(Continued)

*Primary Examiner* — Thang V Tran
(74) *Attorney, Agent, or Firm* — Chip Law Group

(57) ABSTRACT

Provided is a sound output device worn on an ear of a listener and used, and having listening characteristics of an ambient sound in a wearing state. A sound output device 100 includes a sound generating portion 110 that generates a sound, a sound guiding portion 120 that takes in the sound generated in the sound generating portion 110 from one end 121, and a holding portion 130 that holds the sound guiding portion 120 in the vicinity of the other end 122. The holding portion 130 is engaged with an intertragic notch, and supports the sound guiding portion 120 such that a sound output hole of the other end 122 of the sound guiding portion 120 to face a depth side of an ear canal. Even in a state where the listener wears the sound output device 100, the sound output
(Continued)

device 100 does not block an ear cavity of the listener, and the listener can listen to the ambient sound.

20 Claims, 75 Drawing Sheets

(52) U.S. Cl.
CPC ..... *H04R 1/20* (2013.01); *H04R 1/105* (2013.01); *H04R 2430/01* (2013.01)

(58) Field of Classification Search
CPC ..... H04R 2225/021; H04R 2225/025; H04R 2225/63; H04R 2430/01; H04R 2201/10
See application file for complete search history.

(56) References Cited

U.S. PATENT DOCUMENTS

| | | | | |
|---|---|---|---|---|
| 4,864,610 | A | 9/1989 | Stevens | |
| 5,459,290 | A | 10/1995 | Yamagishi | |
| 5,694,475 | A | 12/1997 | Boyden | |
| 6,681,022 | B1 * | 1/2004 | Puthuff | H04R 1/105 381/315 |
| 7,027,608 | B2 * | 4/2006 | Fretz | H04R 25/65 381/322 |
| 8,411,890 | B2 * | 4/2013 | Ooi | H04R 25/60 381/328 |
| 2005/0078847 | A1 | 4/2005 | Dobras et al. | |
| 2006/0215864 | A1 | 9/2006 | Espersen | |
| 2008/0013767 | A1 | 1/2008 | Olsen | |
| 2008/0253598 | A1 * | 10/2008 | Nielsen | H04R 25/608 381/330 |
| 2010/0278350 | A1 * | 11/2010 | Rung | H04R 1/10 381/59 |
| 2011/0007926 | A1 | 1/2011 | Murozaki | |
| 2012/0082331 | A1 * | 4/2012 | Meosky | H04R 25/60 381/323 |

FOREIGN PATENT DOCUMENTS

| | | | |
|---|---|---|---|
| EP | 0852104 | A1 | 7/1998 |
| JP | 04-101600 | A | 4/1992 |
| JP | 11-500594 | A | 1/1999 |
| JP | 3038243 | B2 | 5/2000 |
| JP | 3057731 | B2 | 7/2000 |
| JP | 2001-508261 | | 6/2001 |
| JP | 2001-508261 | A | 6/2001 |
| JP | 2007-189673 | A | 7/2007 |
| JP | 2008-512882 | A | 4/2008 |
| JP | 4709017 | A | 6/2011 |
| JP | 4709017 | B2 | 6/2011 |
| JP | 2011-193331 | A | 9/2011 |
| JP | 2013-106130 | A | 5/2013 |
| WO | 97/11573 | A1 | 3/1997 |
| WO | 00/05924 | A1 | 2/2000 |
| WO | 2012/114644 | A1 | 8/2012 |

OTHER PUBLICATIONS

Office Action for JP Patent Application No. 2018-105879, dated Jun. 19, 2018, 05 pages of Office Action and 03 pages of English Translation.

Notice of Allowance in U.S. Appl. No. 16/023,331 dated Oct 29, 2018.

Office Action for CN Patent Application No. 201580057770.2, dated Nov. 2, 2018, 07 pages of Office Action and 09 pages of English Translation.

* cited by examiner

SOUND OUTPUT DEVICE AND SOUND GUIDING DEVICE

CROSS REFERENCE TO RELATED APPLICATIONS

This application is a U.S. National Phase of International Patent Application No. PCT/JP2015/072187 filed on Aug. 5, 2015, which claims priority benefit of Japanese Patent Application No. JP 2014-220918 filed in the Japan Patent Office on Oct. 30, 2014, and also claims priority benefit of Japanese Patent Application No. JP 2015-083220 filed in the Japan Patent Office on Apr. 15, 2015. Each of the above-referenced applications is hereby incorporated herein by reference in its entirety.

TECHNICAL FIELD

The technology disclosed in the present specification relates to a sound output device and a sound guiding device worn on an ear of a listener and used.

BACKGROUND ART

Small sound conversion devices, in which a speaker closely placed over an ear or an eardrum converts an electrical signal output from a reproducing device or a receiver into a sound signal, that is, earphones have been widely used. The sound reproducing device of this sort outputs a sound to be heard by only the listener who wears the device, and thus is provided for use in various environments.

Many of the currently used earphones have a shape used by being inserted in the ear of the listener. For example, an inner ear-type earphone has a shape used by being hooked on the pinna of the listener. Further, a canal-type earphone has a shape used by being deeply inserted into the ear cavity (ear canal), and many of the canal-type earphones are sealed types in structure and are relatively favorable in sound insulating properties, and thus have an advantage that a wearer can enjoy music in a noisy place.

The canal-type earphone includes, as basic configuration elements, a speaker unit that converts an electrical signal into a sound signal and an approximately cylindrical housing (case) that is also used as a sound tube, and the speaker unit is attached to one end of the housing (outside the ear canal). The housing is provided with a radiation outlet through which aerial vibration generated in the speaker unit is radiated to the ear canal and transmitted to the eardrum. Further, an earpiece (detachable part) having a shape matched with the ear canal when the listener wears the earphone is attached to the other end of the housing (an insertion portion of the ear canal). For example, a canal-type earphone device in which a sound tube is obliquely arranged from a position off the center of a housing, thereby to be arranged up to an ear canal entrance, in addition to the housing being put in a cavum conchae, has been proposed (for example, see Patent Document 1).

Even while the listener wears the earphone and is listening to presented audio, the listener needs to listen to an ambient sound at the same time when people around talks to the listener, for example. However, most of the conventional earphones including the canal-type earphone, it is extremely difficult for the listener to listen to the ambient sound in the wearing state. This is because the conventional earphones have a structure to almost completely block the ear cavity, from the perspective of improvement of reproduced sound quality and prevention of leakage of the reproduced sound to an outside. For example, in doing sports outside and inside, including walking, jogging, cycling, mount climbing, and snowboarding, in driving, or in navigation, being not able to listen to the ambient sound is a dangerous situation. Further, if the ambient sound cannot be heard in communication or presentation, the situation is led to a decrease in service.

Further, the conventional earphone appears to block the ear cavity of the listener in the wearing state, to the people around. Therefore, the wearer of the earphone gives the people an impression of feeling awkward to talk to, and may impede interpersonal communication.

CITATION LIST

Patent Document

Patent Document 1: Japanese Patent No. 4709017

SUMMARY OF THE INVENTION

Problems to be Solved by the Invention

An objective of the technology disclosed in the present specification is to provide an excellent sound output device and an excellent sound guiding device that are worn on the ear of the listener and used, and can output favorable sound information while realizing listening characteristics of an ambient sound in a wearing state, which is equivalent to that in a non-wearing state, at the same time.

Solutions to Problems

The technology disclosed in the present specification has been made in view of the above-described problems, and the technology according to the first aspect is a sound output device including:

a sound generating portion arranged on a back of an ear of a listener; and a sound guiding portion having a hollow structure, having one end connected to the sound generating portion, and the other end arranged in a vicinity of an entrance of an ear canal of the listener, and configured to take in a sound generated in the sound generating portion from the one end and to propagate the sound to the other end.

According to the second aspect of the technology disclosed in the present specification, the sound output device according to the first aspect further includes a holding portion configured to hold the other end of the sound guiding portion at the vicinity of the entrance of the ear canal of the listener.

According to the third aspect of the technology disclosed in the present specification, the holding portion of the sound output device according to the second aspect is engaged with an intertragic notch of the listener.

According to the fourth aspect of the technology disclosed in the present specification, the sound output device according to the first aspect further includes a pinch portion configured to pinch an ear lobe of the listener to allow the sound output device to be worn on the ear.

According to the fifth aspect of the technology disclosed in the present specification, the sound guiding portion of the sound output device according to the first aspect includes a pinch portion having an open/close structure arranged at a portion where the sound guiding portion is folded back from a back side to a front side of a pinna of the listener, and the pinch portion pinches an ear lobe, using pinch force to return to a close position.

According to the sixth aspect of the technology disclosed in the present specification, the sound output device according to the first aspect further includes a pinch portion configured to pinch an ear lobe of the listener together with the sound generating portion to allow the sound generating portion to be worn on the ear.

According to the seventh aspect of the technology disclosed in the present specification, the sound output device according to the first aspect further includes a guard portion configured to prevent the other end of the sound guiding portion from being deeply inserted into the ear canal of the listener.

According to the eighth aspect of the technology disclosed in the present specification, the holding portion of the sound output device according to the second aspect is engaged with the vicinity of the entrance of the ear canal (intertragic notch) of the listener, and fixes the sound guiding portion to the vicinity of the other end to prevent the sound guiding portion from being deeply inserted into the ear canal.

According to the ninth aspect of the technology disclosed in the present specification, the sound output device according to the first aspect further includes a deforming portion configured to be deformed according to action of external force to prevent the other end of the sound guiding portion from being deeply inserted into the ear canal of the listener.

According to the tenth aspect of the technology disclosed in the present specification, the sound guiding portion of the sound output device according to the fifth aspect includes a deforming portion that is deformed according to action of external force, between the other end and the pinch portion.

According to the eleventh aspect of the technology disclosed in the present specification, the deforming portion of the sound output device according to the tenth aspect is snapped when predetermined external force or more force is applied to prevent the other end of the sound guiding portion from being deeply inserted into the ear canal of the listener.

According to the twelfth aspect of the technology disclosed in the present specification, the deforming portion of the sound output device according to the tenth aspect is snapped when predetermined external force or more force is applied to prevent the other end of the sound guiding portion from being deeply inserted into the ear canal of the listener, and is reconnectable.

According to the thirteenth aspect of the technology disclosed in the present specification, the deforming portion of the sound output device according to the tenth aspect is bent when the external force is applied to prevent the other end of the sound guiding portion from being deeply inserted into the ear canal of the listener, and is restored to an original shape when released from the external force.

According to the fourteenth aspect of the technology disclosed in the present specification, the sound output device according to the first aspect further includes an earwax intrusion prevention portion to the other end of the sound guiding portion.

According to the fifteenth aspect of the technology disclosed in the present specification, the sound output device according to the first aspect further includes a sound volume control portion configured to adjust a sound volume of the sound output from the other end to the ear canal according to change of an inner diameter of the sound guiding portion.

According to the sixteenth aspect of the technology disclosed in the present specification, the sound volume control portion of the sound output device according to the fifteenth aspect performs switching of a mute-on state and a mute-off state by a toggle operation of a mute portion emerging in the sound guiding portion in response to pressing of a surface.

According to the seventeenth aspect of the technology disclosed in the present specification, the sound volume control portion of the sound output device according to the fifteenth aspect has a mute portion appear in the sound guiding portion in response to pressing of a surface and becomes a mute-on state, and has the mute portion disappear from the sound guiding portion when the surface is released from the pressing and becomes a mute-off state.

According to the eighteenth aspect of the technology disclosed in the present specification, the sound volume control portion of the sound output device according to the fifteenth aspect includes a flexible tube having a tapered structure inserted in the sound guiding portion, and a ring-like sound volume adjustment portion into which the flexible tube is inserted, and continuously sets the sound volume by continuously changing an inner diameter of the flexible tube according to a position of insertion in the sound volume adjustment portion.

According to the nineteenth aspect of the technology disclosed in the present specification, the sound volume control portion of the sound output device according to the fifteenth aspect includes an elastic deforming portion that configures a side surface of a part of the sound guiding portion, and a cam rotatably arranged to come in contact with the elastic deforming portion, and causes the elastic deforming portion to protrude into the sound guiding portion according to change of a rotation angle of the cam to continuously set the sound volume.

Further, the twentieth aspect of the technology disclosed in the present specification is a sound guiding device including:

a sound guiding portion having a hollow structure, having one end connected to a sound generating portion, and the other end arranged in a vicinity of an entrance of an ear canal of the listener, and configured to take in a sound generated in the sound generating portion from the one end and to propagate the sound to the other end; and a holding portion configured to hold the other end of the sound guiding portion at the vicinity of the entrance of the ear canal of the listener.

Effects of the Invention

According to the technology disclosed in the present specification, an excellent sound output device and an excellent sound guiding device that are worn on the ear of the listener and used, and can output favorable sound information while realizing listening characteristics of an ambient sound in a wearing state, which is equivalent to that in a non-wearing state, at the same time, can be provided.

Note that the effects described in the present specification are mere examples, and the effects of the present invention are not limited by the examples. Also, the present invention may exhibit additional effects in addition to the above effects.

Further objectives, characteristics, and advantages of the technology disclosed in the present specification will become clear from more detailed description based on embodiments described below and appended drawings.

BRIEF DESCRIPTION OF DRAWINGS

FIGS. 25(A) to 25(F) are diagrams illustrating configuration examples of the holding portion 130 having a shape other than the ring shapes and having a hollow structure into which an ambient sound can be taken in.

MODE FOR CARRYING OUT THE INVENTION

Hereinafter, embodiments of the technology disclosed in the present specification will be described in detail with reference to the drawings.

[A. Basic Structure]

Figure 1:
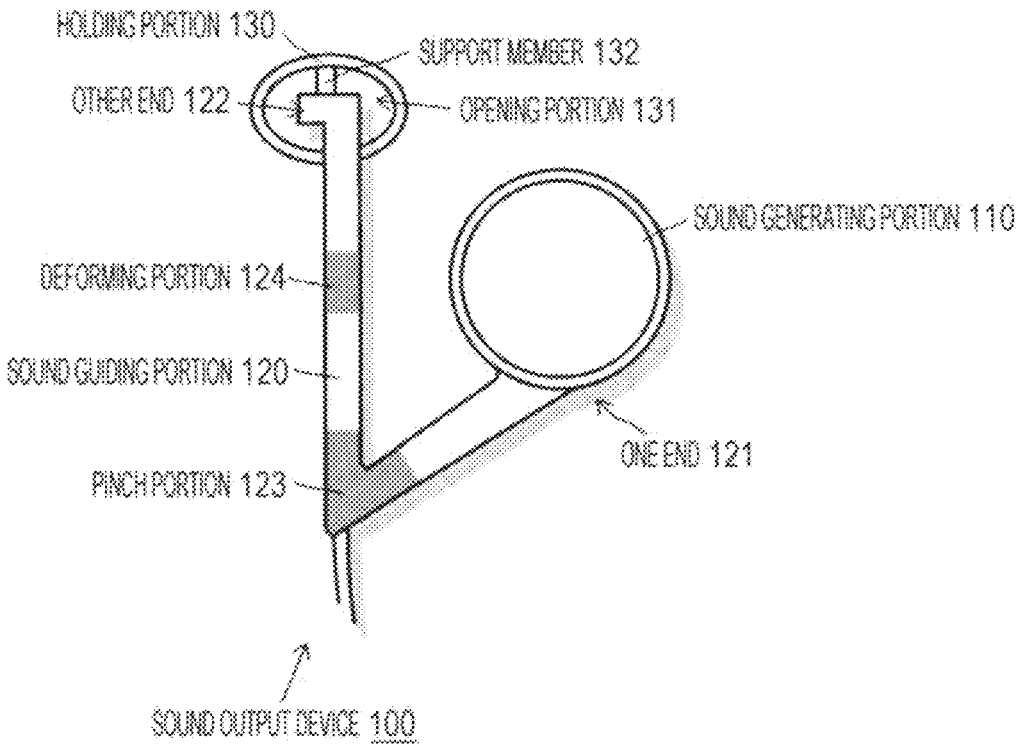
FIG. 1 is a front view of a sound output device 100 (for left ear) according to an embodiment of the technology disclosed in the present specification.
Figure 2:
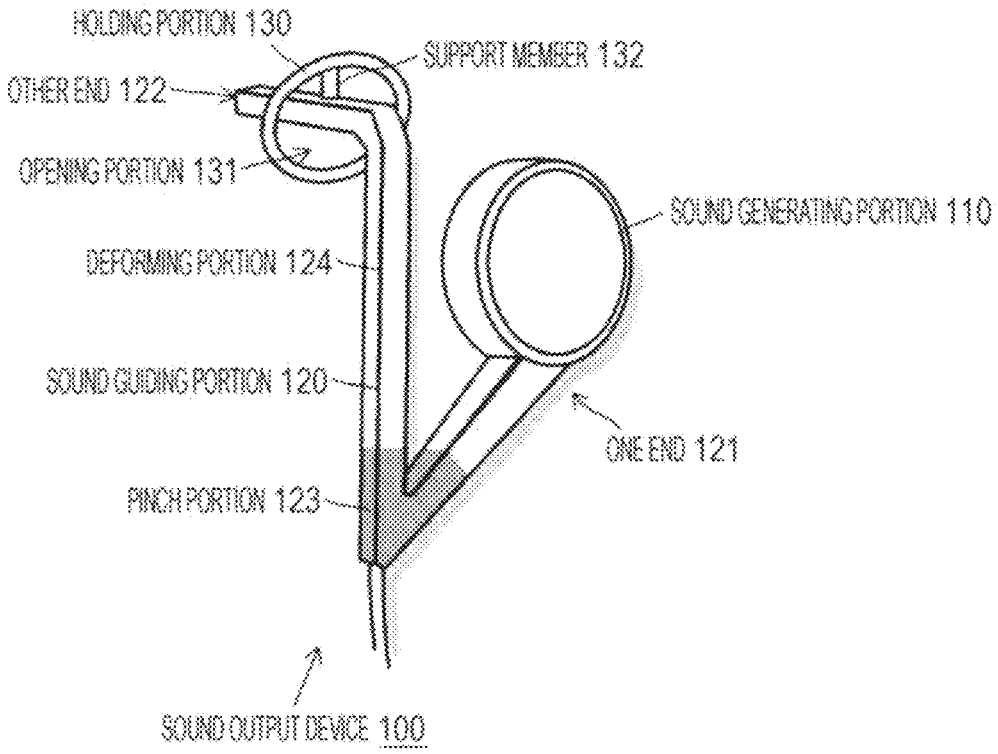
FIG. 2 is a perspective view of the sound output device 100 (for left ear) according to an embodiment of the technology disclosed in the present specification.

FIGS. 1 and 2 illustrate a configuration of a sound output device 100 worn on an ear of a listener and used, according to an embodiment of the technology disclosed in the present specification. Note that FIG. 1 is a front view of the sound output device 100 and FIG. 2 is a perspective view of the sound output device 100 as viewed from a left side. Further, the sound output device 100 illustrated in FIGS. 1 and 2 is configured to be worn on a left ear. However, it is understood that a sound output device for right ear (not illustrated) is configured in a symmetrical manner to the sound output device for left ear.

The sound output device 100 illustrated in FIGS. 1 and 2 includes a sound generating portion 110 that generates a sound, a sound guiding portion 120 that takes in the sound generated in the sound generating portion 110 from one end 121, and a holding portion 130 that holds the sound guiding portion 120 at the vicinity of the other end 122. The sound guiding portion 120 is made of a hollow pipe material having an inner diameter of 1 to 5 millimeters, and both ends of the sound guiding portion 120 are open ends. The one end 121 of the sound guiding portion 120 is a sound inlet hole of the generated sound from the sound generating portion 110, and the other end 122 is a sound output hole of the sound guiding portion 120. Therefore, when the one end 121 is attached to the sound generating portion 110, the sound guiding portion 120 becomes in a one-side open state.

As described above, the holding portion 130 is engaged with a vicinity of an entrance of an ear canal (for example, an intertragic notch), and supports the sound guiding portion 120 at the vicinity of the other end 122 to cause the sound output hole of the other end 122 of the sound guiding portion 120 to face a depth side of the ear canal. An outer diameter of the sound guiding portion 120 in at least the vicinity of the other end 122 is formed to be much smaller than an inner diameter of an ear cavity. Therefore, even in a state where the other end 122 of the sound guiding portion 120 is held in the vicinity of the entrance of the ear canal by the holding portion 130, the other end 122 does not block the ear cavity of the listener. That is, the ear cavity is open. The sound output device 100 can be said to be an "ear cavity open type" earphone, unlike conventional earphones.

Further, the holding portion 130 includes an opening portion 131 that opens the entrance of the ear canal (ear cavity) to an external environment even in the state of holding the sound guiding portion 120. In the example illustrated in FIGS. 1 and 2, the holding portion 130 is a ring-like structural body, and is connected with the vicinity of the other end 122 of the sound guiding portion 120 only with a rod-like support member 132. Therefore, all portions other than the rod-like support member 132, of the ring-like structural body, are the opening portion 131. Note that, as described below, the structure of the holding portion 130 is not limited to the ring-like structure, and an arbitrary shape that can support the other end 122 of the sound guiding portion 120 can be employed as long as the shape includes a hollow structure.

When the tubular sound guiding portion 120 takes in the sound generated from the sound generating portion 110 from the one end 121, the sound guiding portion 120 propagates aerial vibration of the sound, and radiates the aerial vibration from the other end 122 held in the vicinity of the entrance of the ear canal by the holding portion 130 toward the ear canal to the eardrum.

As described above, the holding portion 130 that holds the vicinity of the other end 122 of the sound guiding portion 120 includes the opening portion 131 that opens the entrance of the ear canal (ear cavity) to the external environment. Therefore, even in a state where the listener wears the sound output device 100, the sound output device 100 does not block the ear cavity of the listener. The listener can sufficiently listen to the ambient sound through the opening portion 131 while wearing the sound output device 100 and listening to the sound output from the sound generating portion 110.

Further, while opening the ear cavity, the sound output device 100 according to the present embodiment can prevent leakage of the generated sound (reproduced sound) from the sound generating portion 110 to an outside. This is because the other end 122 of the sound guiding portion 120 is attached to face the depth in the vicinity of the entrance of the ear canal, and radiates the aerial vibration of the generated sound near the eardrum, therefore sufficient sound quality can be obtained even if an output of the sound output unit 100 is made small.

Figure 3:
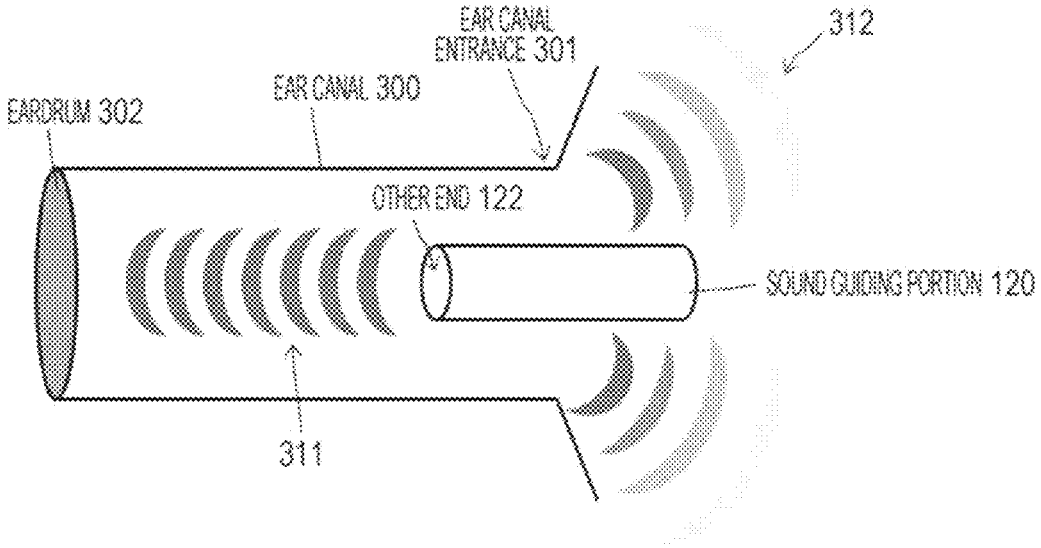
FIG. 3 is a diagram illustrating a state in which the ear cavity open-type sound output device 100 outputs sound waves to an ear of a listener.

Further, directivity of the aerial vibration radiated from the other end 122 of the sound guiding portion 120 also contributes to prevention of sound leakage. FIG. 3 illustrates a state in which the ear cavity open-type sound output device 100 outputs sound waves to the ear of the listener. The aerial vibration is radiated from the other end 122 of the sound guiding portion 120 toward an inside of the ear canal. An ear canal 300 is a hole starting from an ear canal entrance 301 and ends at an inside of an eardrum 302, and typically has a length of about 25 to 30 millimeters. The ear canal 300 is a cylindrical closed space. Therefore, the aerial vibration radiated from the other end 122 of the sound guiding portion 120 toward the depth of the ear canal 300 is propagated to the eardrum 302 with directivity, as illustrated by the reference number 311. Further, a sound pressure of the aerial vibration is decreased in the ear canal 300, and thus sensitivity (gain) of a low frequency range is especially improved. On the other hand, an outside of the ear canal 300, that is, the external environment is an opened space. Therefore, the aerial vibration radiated from the other end 122 of the sound guiding portion 120 to an outside of the ear canal 300 does not have directivity and is steeply attenuated, as illustrated by the reference number 312.

Description will be given with reference to FIGS. 1 and 2 again. The tubular sound guiding portion 120 has a bent shape in an intermediate portion, which is folded back from a back side to a front side of a pinna. The bent portion is a pinch portion 123 having an open/close structure, and can generate pinch force to pinch an ear lobe. Details will be described below.

The sound guiding portion 120 further includes a deforming portion 124 between the other end 122 arranged in the vicinity of the entrance of the ear canal and the bent pinch portion 123. The deforming portion 124 is deformed when excessive external force acts, and keeps the other end 122 of the sound guiding portion 120 not to enter the depth of the ear canal more than necessary. Details will be described below.

Figure 4:
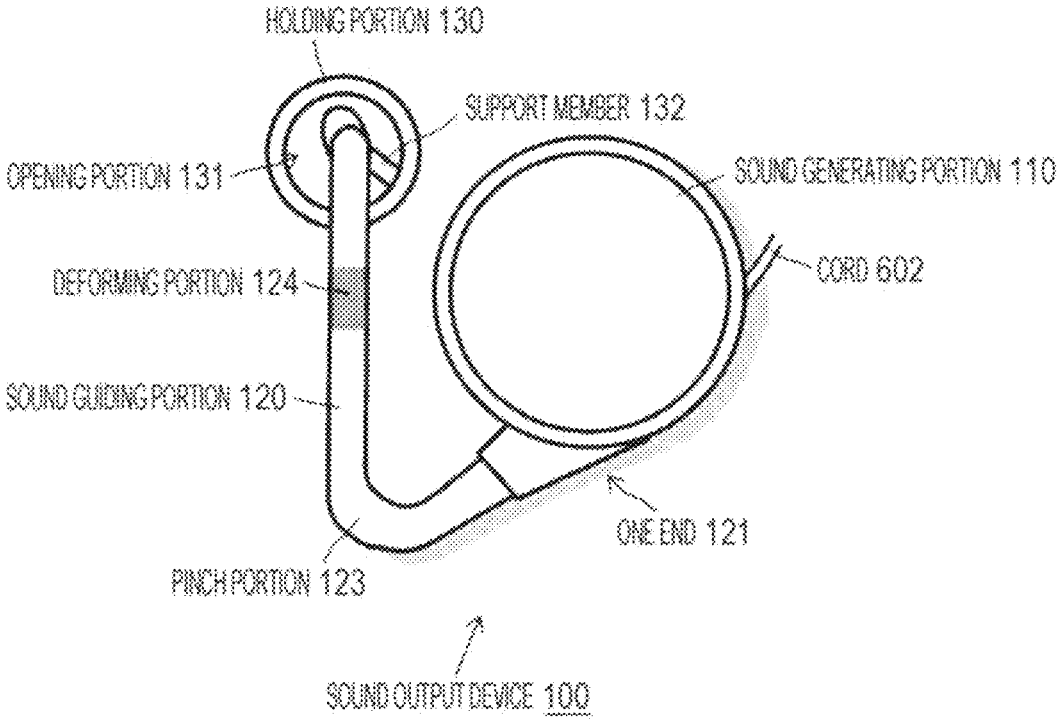
FIG. 4 is a diagram (front view) illustrating a modification of the sound output device 100 illustrated in FIGS. 1 and 2.
Figure 5:
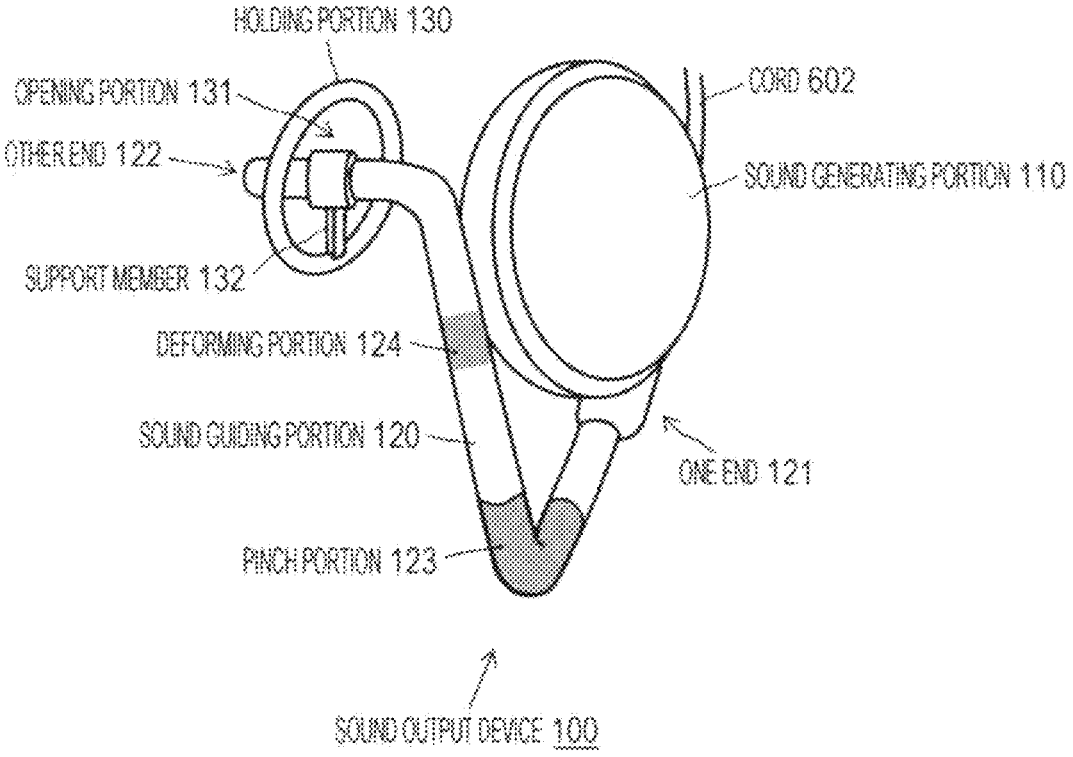
FIG. 5 is a diagram (perspective view) illustrating a modification of the sound output device 100 illustrated in FIGS. 1 and 2.
Figure 6:
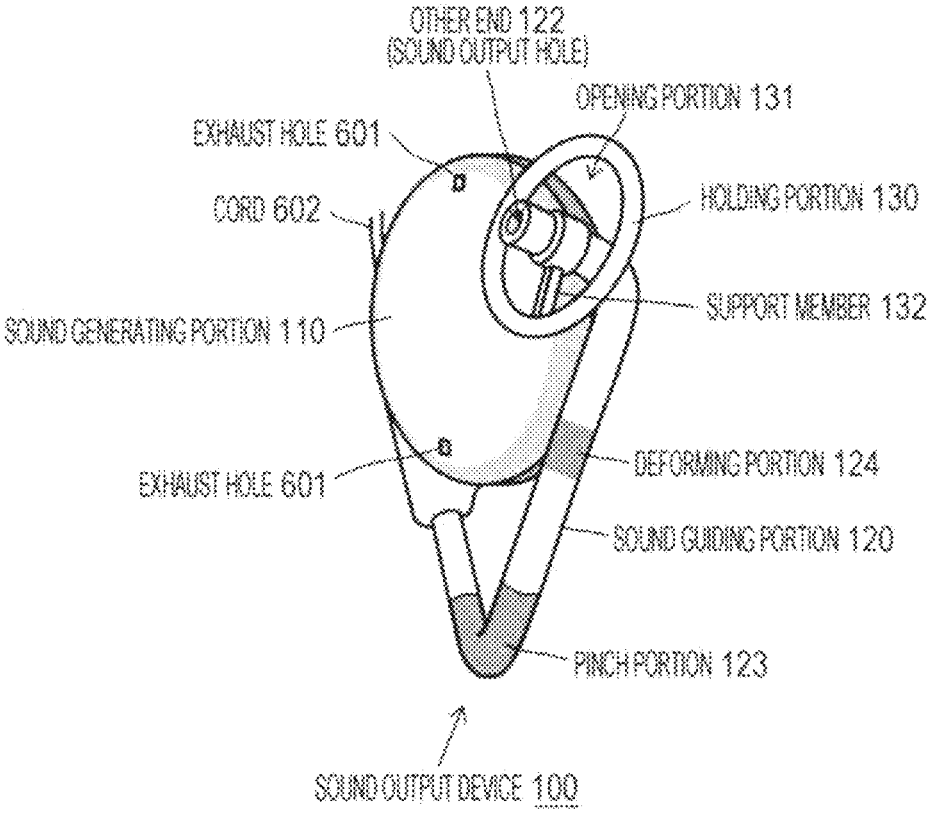
FIG. 6 is a diagram (perspective view) illustrating a modification of the sound output device 100 illustrated in FIGS. 1 and 2.

FIGS. 4 to 6 illustrate modifications of the sound output device 100 illustrated in FIGS. 1 and 2. Note that FIG. 4 is a front view of the sound output device 100 and FIG. 5 is a perspective view of the sound output device 100 as viewed from a left side. Further, FIG. 6 is a perspective view of the sound generating portion 110 as viewed from a direction where the back side can be seen. The same configuration element as that of the sound output device 100 illustrated in FIGS. 1 and 2 is denoted with the same reference number.

In the sound output device 100 illustrated in FIGS. 1 and 2, the sound guiding portion 120 is configured from the square cylinder-type pipe material. In contrast, the sound guiding portion 120 of the sound output device 100 illustrated in FIGS. 4 to 6 is configured from a cylinder-type pipe material. The shape of a member used for the sound guiding portion 120 is arbitrary as long as the member has a tubular shape, that is, a hollow structure that can propagate the aerial vibration.

Note that, as described below, the sound generating portion 110 uses a sound production element such as a speaker that produces sound pressure change. Therefore, at the time of sound production, pressure change is caused in the housing of the sound generating portion 110. As illustrated in FIG. 6, one or more exhaust holes 601 for a case where high pressure is generated in the housing are drilled in the housing on the back side. Further, a cord 602, through which an audio signal from a receiver (not illustrated) is input, is connected to the sound generating portion 110, the receiver receiving a radio signal from an audio reproduction device (not illustrated) such as a music player, a smart phone, or a tablet terminal, or an audio reproducing device.

[B. Wearing Mechanism on Ear]

The sound output device 100 has the bent shape in the intermediate portion of the sound guiding portion 120, the bent shape being folded back from the back side to the front side of the pinna. The bent portion is the pinch portion 123 having an open/close structure, and can allow the sound output device 100 to be worn on the ear of the listener by pinching the pinna of the listener with the sound guiding portion 120, using the pinch force generated in the pinch portion 123.

Figure 7:
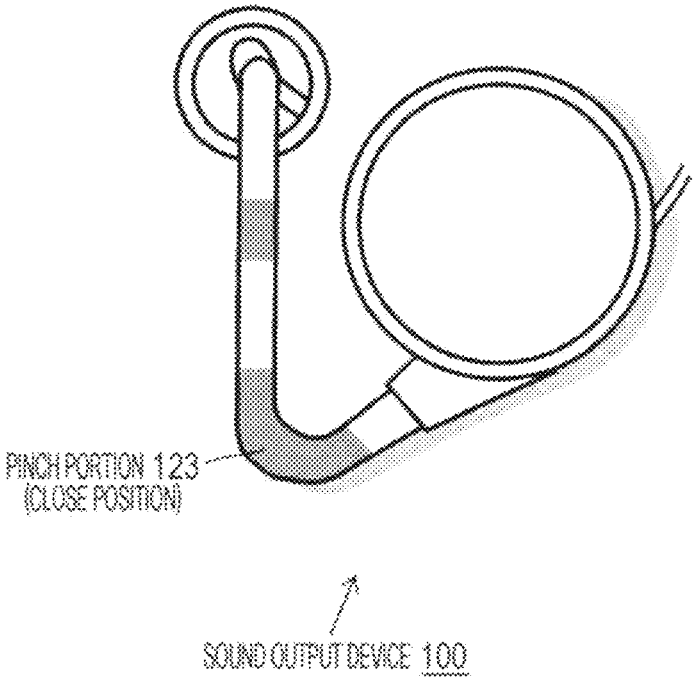
FIG. 7 is a diagram illustrating a close state of a pinch portion 123 of a sound guiding portion 120.
Figure 8:
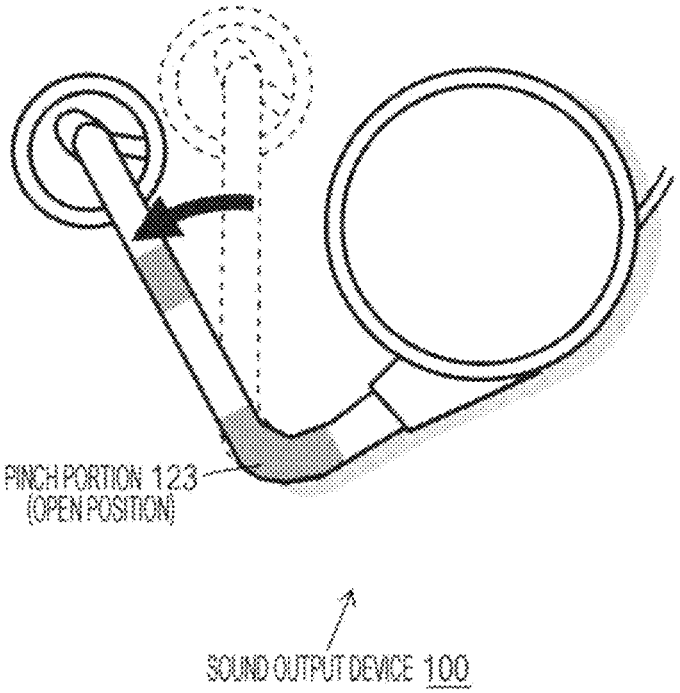
FIG. 8 is a diagram illustrating an open state of the pinch portion 123 of the sound guiding portion 120.

FIG. 7 illustrates a close state of the pinch portion 123, and FIG. 8 illustrates an open state of the pinch portion 123. Further, FIG. 9 illustrates a state in which the sound output device 100 according to the present embodiment is worn on the left ear of the listener.

As can be seen from FIGS. 7 and 8, the tubular sound guiding portion 120 includes the open/close structure bent at the pinch portion 123. Then, the pinch force to return to a close position illustrated in FIG. 7 is generated in the pinch portion 123 in an open position illustrated in FIG. 8.

Figure 9:
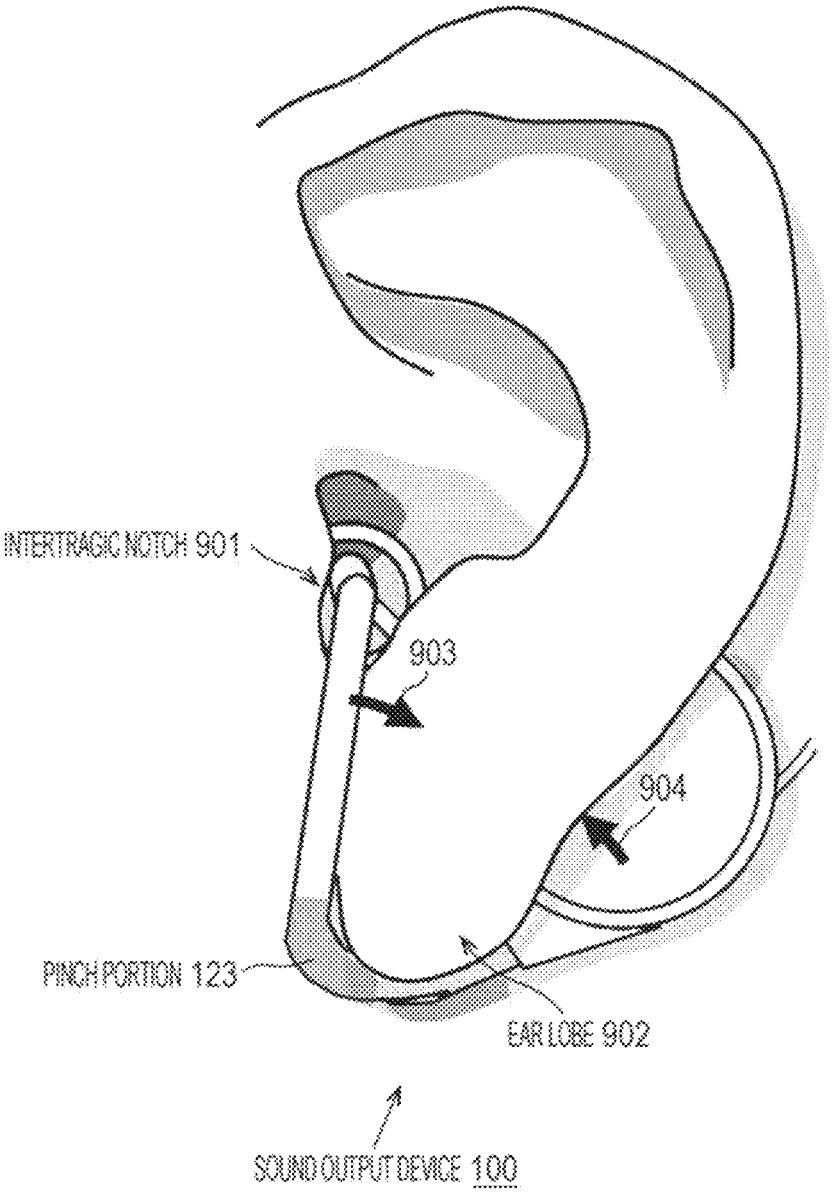
FIG. 9 is a diagram illustrating a state in which the sound output device 100 is worn on a left ear of the listener.

As illustrated in FIG. 9, the holding portion 130 that supports the sound guiding portion 120 at the vicinity of the other end 122 favorably comes in contact with a bottom face of the cavum conchae and is engaged with an intertragic notch 901, thereby to be attached to the vicinity of the entrance of the ear canal. Further, the sound generating portion 110 connected with the one end 121 of the sound guiding portion 120 is arranged on the back side of a pinna 902. Then, as illustrated by the reference numbers 903 and 904, the pinch force to return the open sound guiding portion 120 to the close position is generated in the pinch portion 123, the sound generating portion 110 is pressed against a back-side surface of the pinna, the sound guiding portion 120 bent as illustrated in FIG. 9 pinches the pinna (ear lobe) 902, so that the sound output device 100 is attached to the left ear.

To attach the sound output device 100 on the ear, the sound guiding portion 120 may just pinch an arbitrary place of the pinna 902. Note that pinching an ear lobe portion of a lower half of the pinna, the portion having a flat simple shape, makes a contact area in the close state larger and can firmly hold the pinna 902 with small pinch force, and is thus favorable. If the pinch force is small, the listener does not need to feel a pain when wearing the device and can bear long-term use.

In addition, the ear lobe is relatively small, and thus a distance folded back and passing from the sound generating portion 110 installed on the back side of the pinna to an end portion of the ear lobe up to reaching the entrance of the ear canal is short, and the length of the sound guiding portion 120 can be made short by the length. Being folded back at and passing the place shortest from the entrance of the ear canal can make the length of the sound guiding portion 120 shortest. The length of the sound guiding portion 120 is about 40 millimeters, for example. If the length to propagate the sound is short, attenuation from when the sound is taken in from the one end 121 of the sound generating portion 110 to when the sound is output from the other end 122 becomes small, and thus the output of the sound generating portion 110 can be suppressed.

In contrast, if the sound guiding portion 120 of the open/close structure tries to pinch an upper half of the pinna (not illustrated), the sound guiding pipe 120 with the other end 122 fixed to the vicinity of the entrance of the ear canal needs to pass on a complicated uneven shape caused by shapes of cartilages of the pinna in order of ear concha, anthelix, scapha, and helix toward an outside of the pinna. That is, the contact area between the sound guiding pipe 120 and the surface of the pinna in the close state is extremely small, and even if the sound guiding pipe 120 pinches the pinna with the same pinch force, the pinching becomes unstable. In addition, the upper half of the pinna is larger than the ear lobe, and thus the distance from the sound generating portion 110 installed on the back side of the pinna to passing on the helix up to reaching the entrance of the ear canal becomes long. The sound guiding pipe 120 becomes long by the distance, and thus the generated sound from the sound generating portion 110 is attenuated before radiated to the ear canal, or the output of the sound generating portion 110 needs to be increased. As an additional remark, the size of the helix of the upper half of the pinna considerably varies by individual as compared with the ear lobe. Therefore, if pinching the upper half of the pinna, the length of the sound guiding portion 120 needs to be adjusted and the adjustment is burdensome.

[C. Sound Generating Portion]

Next, the sound generating portion 110 will be described in detail. A principle to generate the sound by the sound generating portion 110 is arbitrary. Here, a structure of the sound generating portion 110, using the sound production element such as a speaker that produces sound pressure change, will be described.

Figure 10:
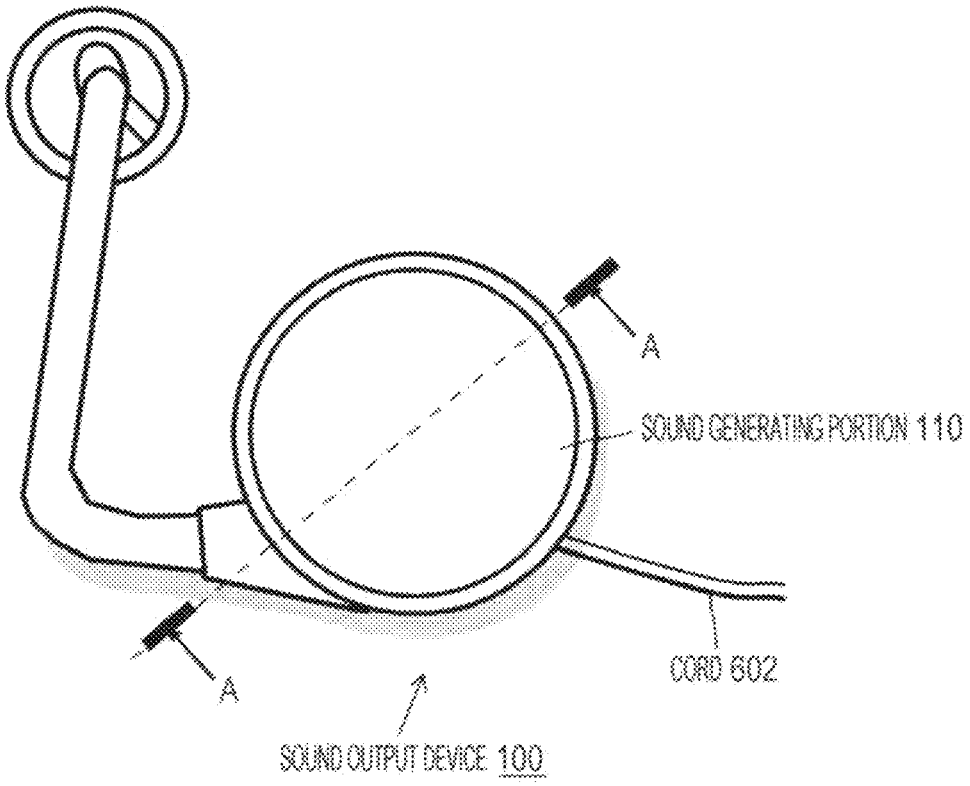
FIG. 10 is a diagram illustrating a state in which a sound generating portion 110 is viewed from the front.
Figure 11:
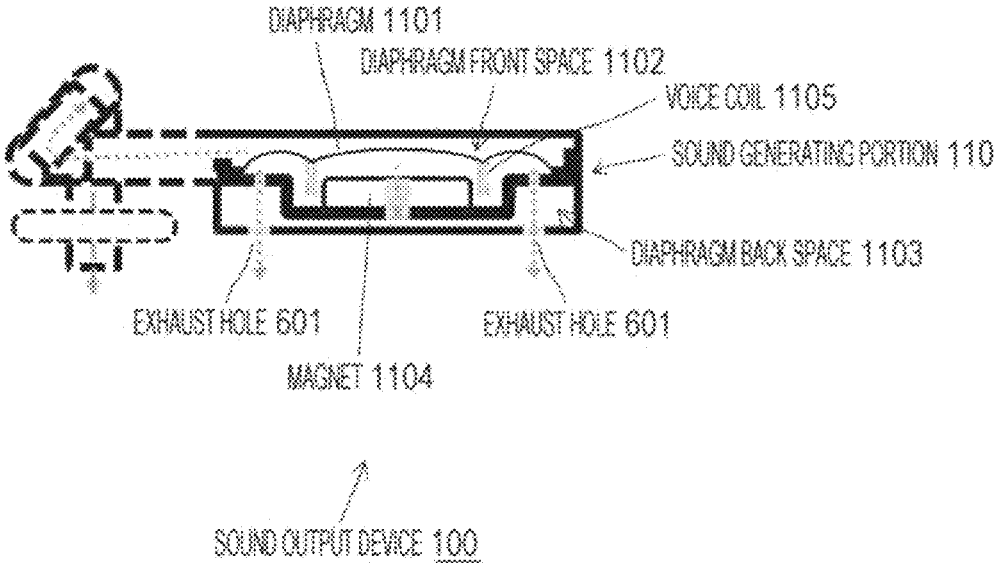
FIG. 11 is a diagram illustrating an A-A section of the sound generating portion 110.

FIG. 10 illustrates a state of the sound generating portion 110 as viewed from the front. Further, FIG. 11 illustrates an A-A sectional view of the sound generating portion 110. The sound generating portion 110 illustrated in FIGS. 10 and 11 is so-called a dynamic-type speaker. As illustrated in FIG. 11, a diaphragm 1101 including a voice coil 1105 is arranged in a magnetic circuit configured from a magnet 1104 to face the magnet 1104, inside the sound generating portion 110. Further, the inside of the sound generating portion 110 is divided by the diaphragm 1101 into a diaphragm front space (front cavity) 1102 and a diaphragm back space (back cavity) 1103. Then, when a magnetic field is changed in response to the audio signal input to the voice coil 1105 through the cord 602, the diaphragm 1101 is operated back and forth by magnetic force of the magnet 1104. As a result, pressure change is generated between the diaphragm front space 1102 and the diaphragm back space 1103, and this pressure change becomes a sound.

When the sound generated in the diaphragm front space 1102 is taken in to the one end 121 of the sound guiding portion 120, the sound is propagated in the tube and is radiated from the other end 122 of the sound guiding portion 120 toward the depth of the ear canal, and then reaches the eardrum.

Meanwhile, the sound generated in the diaphragm back space 1103 is radiated to an outside through the exhaust hole 601 drilled in the housing of the sound generating portion 110 on the back side so as not to disturb the vibration of the diaphragm 1101.

As for the exhaust hole 601, the inner diameter of the exhaust hole 601 is favorably 1.0 millimeter or less in the case where the sound production element in the sound generating portion 110 is a dynamic speaker having the diameter of 16 millimeters, considering sound leakage to an outside.

Note that the sound production element of the sound generating portion 110 maybe anyone of or a combination of two or more of balanced armature-type, condenser-type, piezoelectric-type, and electrostatic-type elements other than the dynamic-type element.

Figure 12:
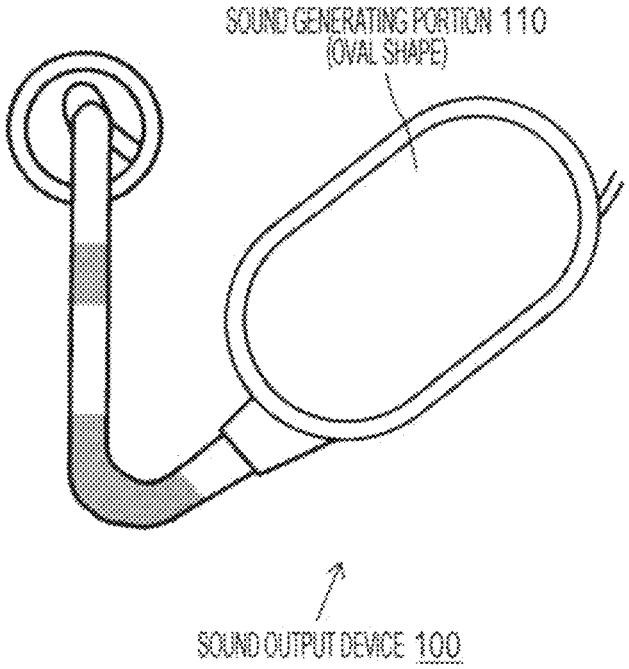
FIG. 12 is a diagram exemplarily illustrating an appearance of the sound output device 100 including the sound generating portion 110 having an oval shape.
Figure 13:
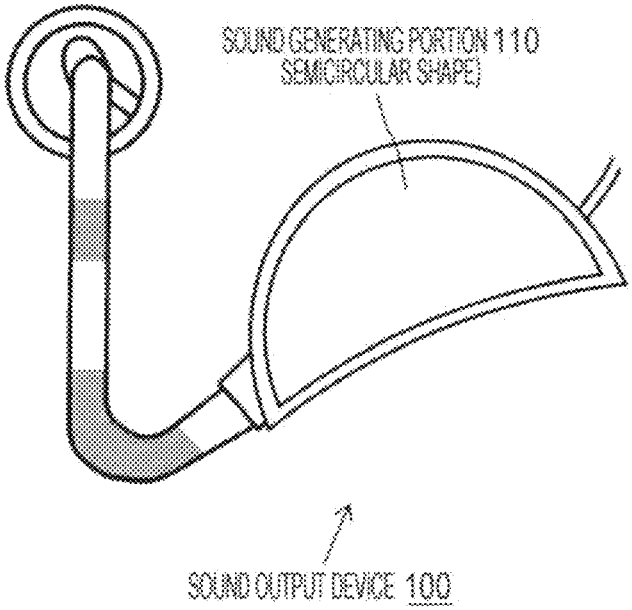
FIG. 13 is a diagram exemplarily illustrating an appearance of the sound output device 100 including the sound generating portion 110 having a semicircular shape.

Further, the shape of the sound generating portion 110 illustrated so far has been a disk shape. However, the shape of the sound generating portion 110 is not limited thereto. The sound generating portion 110 can be configured to have an arbitrary shape in accordance with the shape of the sound production element accommodated inside, or to be fit to the back-side surface of the pinna, as long as the sound generating portion 110 is attached to the one end 121 of the sound guiding portion 120, and does not impede the action to be pressed against the back-side surface of the pinna by the pinch force generated by the pinch portion 123 of the sound guiding portion 120. FIG. 12 exemplarily illustrates an appearance of the sound output device 100 including the sound generating portion 110 having an oval shape. Further, FIG. 13 exemplarily illustrates an appearance of the sound output device 100 including the semicircular sound generating portion 110.

Figure 14:
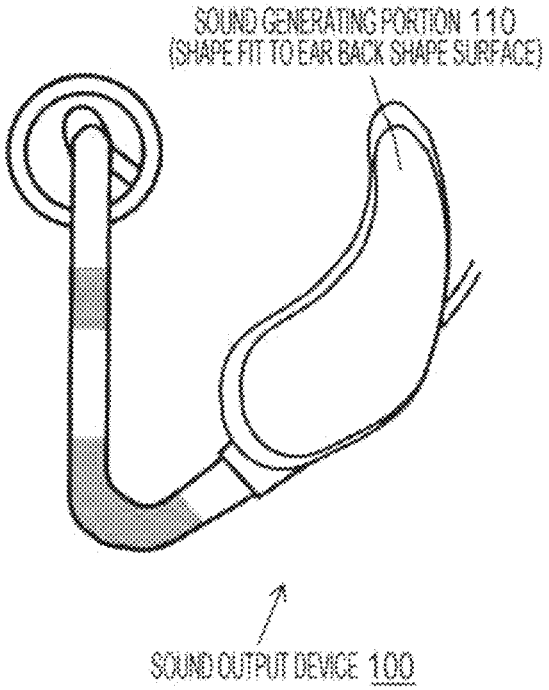
FIG. 14 is a diagram exemplarily illustrating an appearance of the sound output device 100 including the sound generating portion 110 having a side edge, the shape of which is fit to an ear back shape surface.
Figure 15:
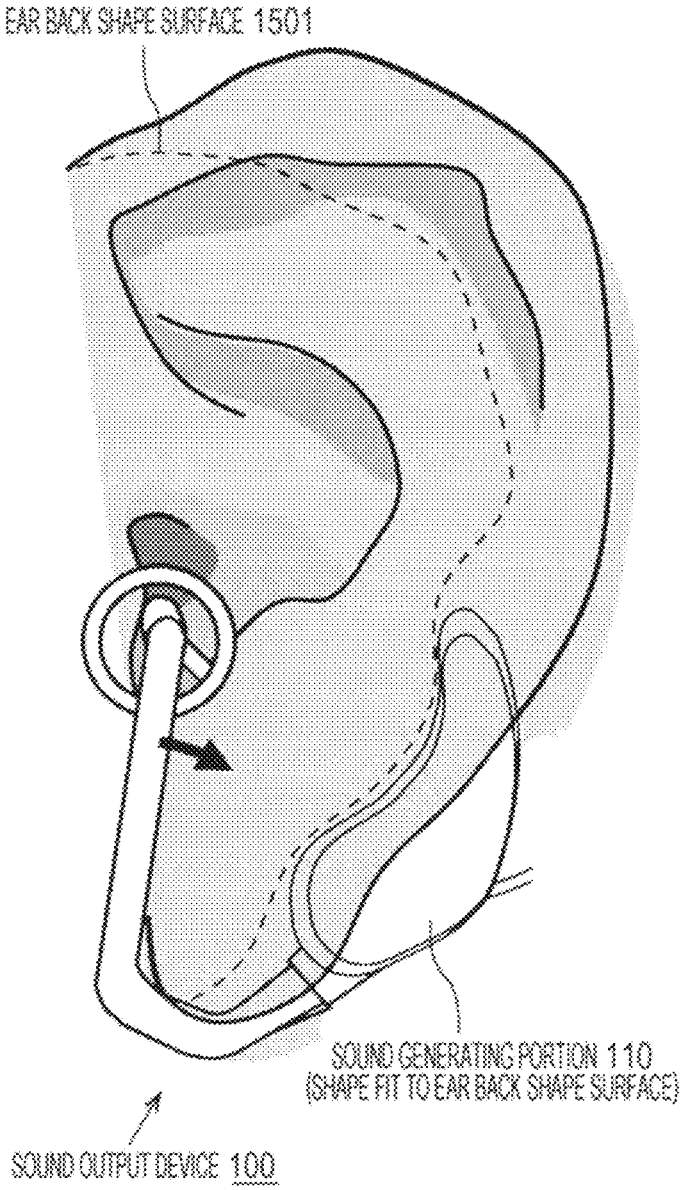
FIG. 15 is a diagram illustrating a state in which the sound output device 100 illustrated in FIG. 14 is worn on a left ear of an appropriate listener.

Further, the shape of ear back of a human considerably varies by individual. Therefore, the shape of the sound generating portion 110 may be formed to be fit to an ear back shape surface of individual person. FIG. 14 exemplarily illustrates an appearance of the sound output device 100 including the sound generating portion 110 having a side edge, the shape of which is fit to the ear back shape surface (illustrated by the reference number 1501 in FIG. 15) of a person. Further, FIG. 15 illustrates a state in which the sound output device 100 illustrated in FIG. 14 is worn on the left ear of an appropriate listener. In the example illustrated in FIG. 15, the side edge of the sound generating portion 110 is favorably engaged with the ear back shape surface 1501. In this case, the sound output device 100 can be firmly worn on the ear of the listener with smaller pinch force of the pinch portion 123.

[D. Sound Guiding Portion]

When the sound generated in the diaphragm front space 1102 is taken in to the one end 121 of the sound guiding portion 120, the sound is guided to the vicinity of the entrance of the ear canal and is radiated from the other end 122 of the sound guiding portion 120 toward the depth of the ear canal, and transmits audio information to the eardrum, accordingly.

When the sound guiding portion 120 (pinch portion 123) is folded back at and passes through the place shortest from the entrance of the ear canal, the length of the sound guiding portion 120 can be made shortest. In this case, the sound guiding portion 120 can propagate the sound generated in the sound generating portion 110 from the back of the ear to the vicinity of the entrance of the ear canal in the shortest distance. Therefore, a sound loss due to internal acoustic resistance of the sound guiding portion 120 can be minimized. The length of the sound guiding portion 120 is about 40 millimeters, for example (described above).

Figure 16:
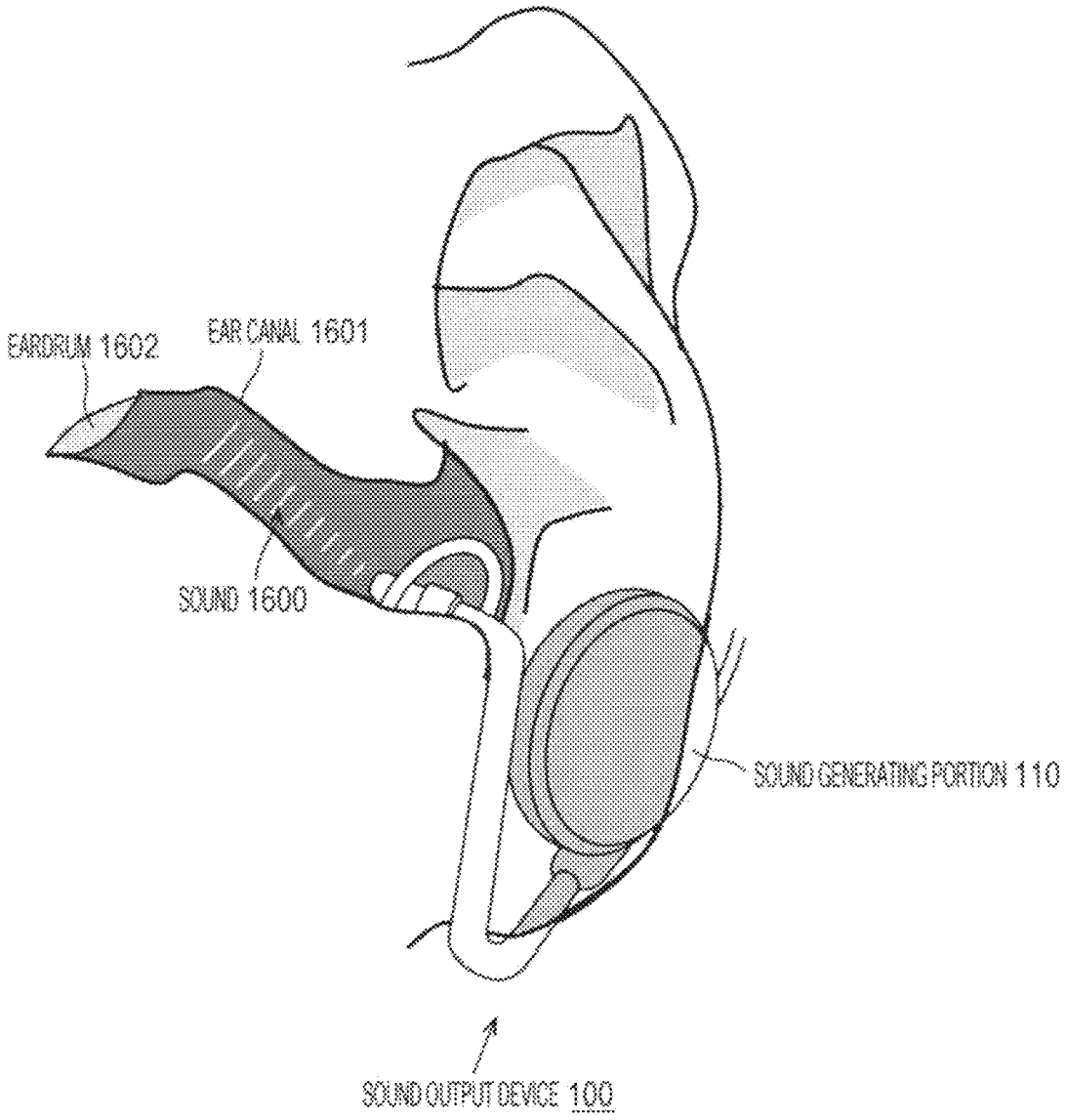
FIG. 16 is a diagram illustrating a state in which a sound 1600 radiated from the other end 122 of the sound guiding portion 120 is propagated in an ear canal 1601 and reaches an eardrum 1602.

FIG. 16 illustrates a state in which a sound 1600 radiated from the other end 122 of the sound guiding portion 120 is propagated in an ear canal 1601 and reaches an eardrum 1602 in coronal plane of the vicinity of the left ear of the head of the listener who wears the sound output device 100.

Figure 17:
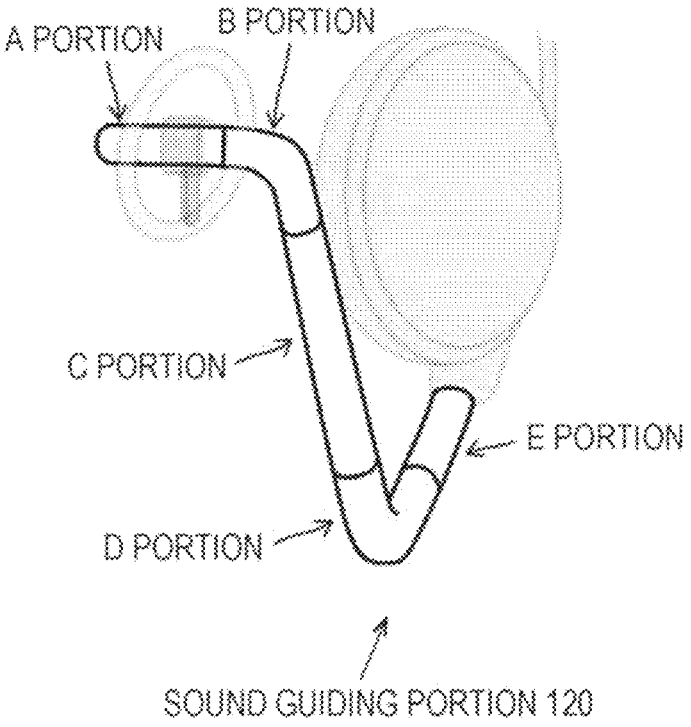
FIG. 17 is a diagram illustrating five portions defined in a length direction of the sound guiding portion 120.

In the sound guiding portion 120, five portions A to E can be defined in a length direction, as illustrated in FIG. 17, on the basis of functions and structures. The portions A to E can be respectively manufactured as separate parts and can be connected in the order of the illustration to configure the sound guiding portion 120, or two or more adjacent portions can be configured as an integrated part.

The E portion is a portion connected with the sound generating portion 110 (illustration is omitted in FIG. 17), and its tip end portion corresponds to the one end (sound input hole) 121 from which the sound generated from the sound generating portion 110 is taken in.

The D portion is connected with the E portion and the C portion at both ends such that the D portion is bent in a dogleg shaped manner. The D portion of the sound guiding portion 120 is folded back at the end portion of the ear lobe. Further, the D portion corresponds to the pinch portion 123 that realizes the open/close structure of the sound guiding portion 120, and generates the pinch force to return the open sound guiding portion 120 to the close position. Details of the structure of the pinch portion 123 will be described below.

The C portion corresponds to the deforming portion 124. The deforming portion 124 is bent when external force is applied between the B portion and the D portion, and has elasticity or flexibility to restore when released from the external force, or vulnerability to be snapped when the external force is applied. A tip end of the A portion can be prevented from excessively entering the depth of the ear canal even if the external force is applied by the flexibility of the vulnerability of the deforming portion 124. If the C portion has rigidity instead of flexibility and vulnerability, when the C portion is pressed by the external force, the A portion is pushed together and its tip end enters the depth of the ear canal and may damage an inner wall of the ear canal and the ear drum, and thus it is dangerous.

The tip end of the A portion corresponds to the other end (sound output hole) 122 from which the sound propagated in the sound guiding portion 120. The A portion is supported by the holding portion 130 (illustration is omitted in FIG. 17). When the holding portion 130 is engaged with the vicinity of the entrance of the ear canal (for example, the intertragic notch) while being in contact with the bottom face of the cavum conchae, a tip end of the E portion, that is, the other end 122 of the sound guiding portion 120 is arranged to face the inside of the ear canal. Further, the B portion connects the deforming portion 124 as the C portion and the other end 122 of the sound guiding portion 120 as the A portion. While the deforming portion 124 as the C portion is nearly parallel with a plane made by the ear lobe, the other end 122 of the sound guiding portion 120 as the A portion faces the depth of the ear canal, and thus the B portion that connects the aforementioned portions forms a nearly right-angle bent shape.

Figure 18:
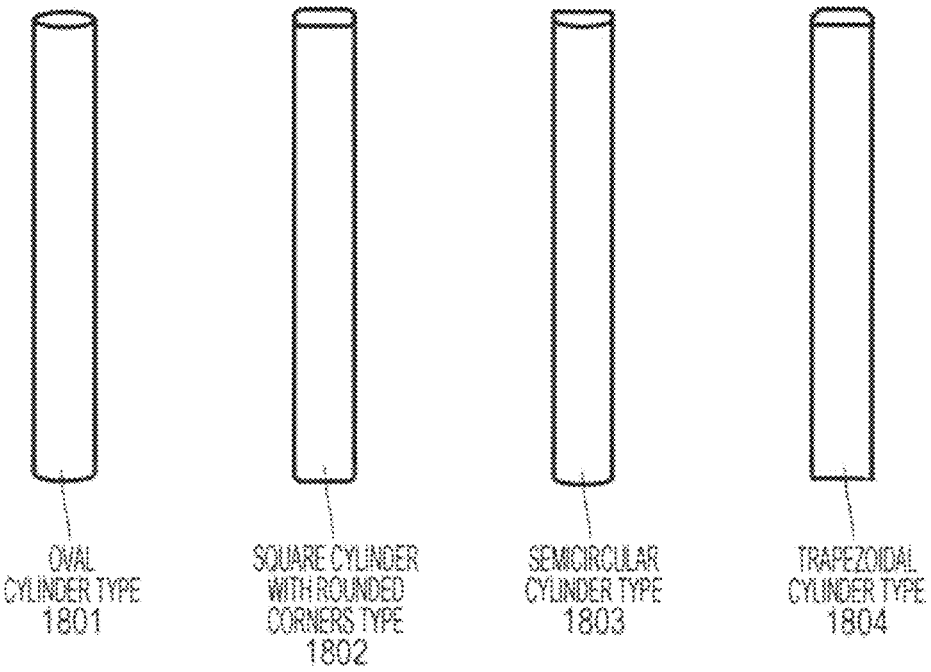
FIG. 18 is a diagram exemplarily illustrating cylindrical shapes applicable to the sound guiding portion 120.

The sound guiding portion 120 is configured from a pipe material having a hollow structure in which the sound generated in the sound generating portion 110, that is, the aerial vibration can be propagated. FIGS. 1 and 2 exemplarily illustrate the sound guiding portion 120 configure from a square cylinder-type pipe material. Further, FIGS. 4 to 6 exemplarily illustrate the sound guiding portion 120 configured from a cylinder-type pipe material. The shape of the member used for the sound guiding portion 120 is arbitrary as long as the shape is a hollow structure in which aerial vibration can be propagated, and is not limited to the square cylinder type or the cylinder type. FIG. 18 exemplarily illustrates other cylindrical shapes applicable to the sound guiding portion 120. As illustrated in FIG. 18, pipe materials of an oval cylinder type 1801, a square cylinder with rounded corners type 1802, a semicircular cylinder type 1803, and a trapezoidal cylinder type 1804 can be used as the sound guiding portion 120.

Further, in the examples illustrated in FIGS. 9, and 15 and 16, the sound guiding portion 120 is folded back at the lower end edge of the ear lobe from the back of the pinna to the front of the pinna and is extended to the vicinity of the entrance of the ear canal. The other end 122 of the sound guiding portion 120 is supported by the holding portion 130 engaged with the intertragic notch. However, the place of the pinna where the sound guiding portion 120 passes through is not limited to the lower end edge of the ear lobe.

Figure 19:
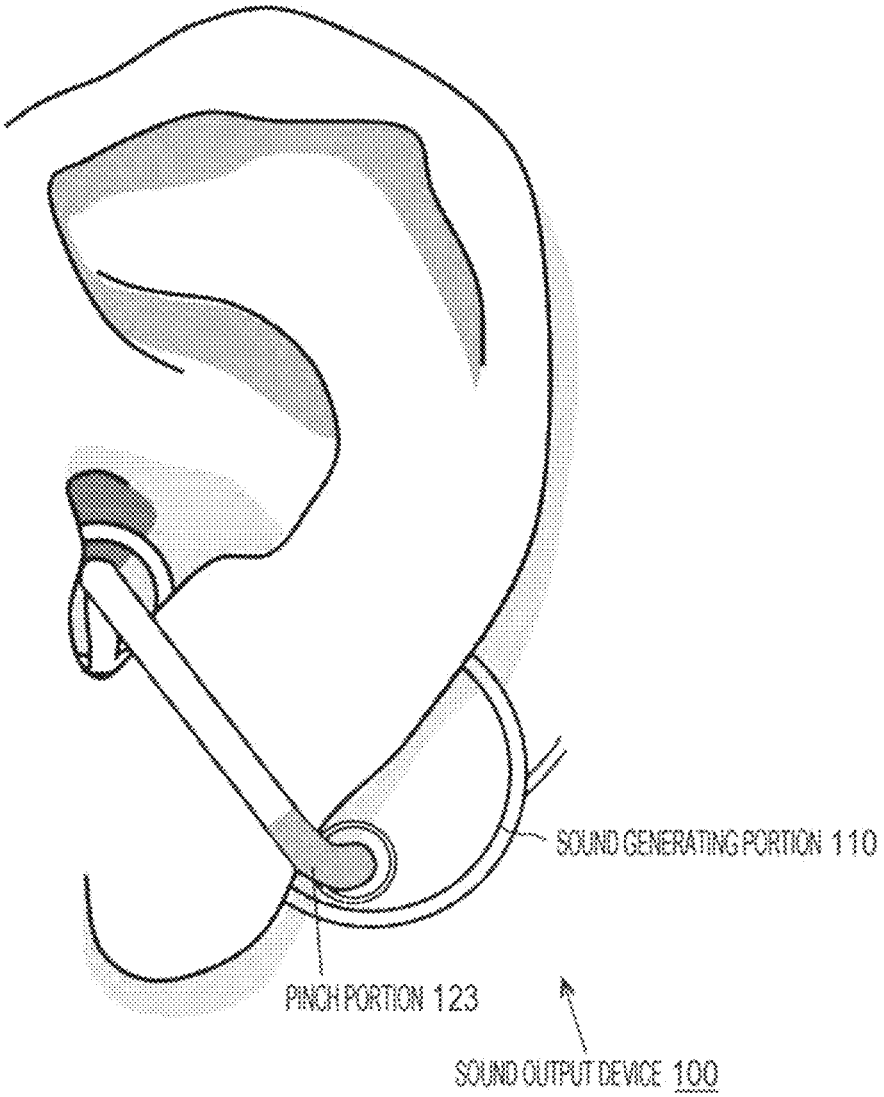
FIG. 19 is a diagram exemplarily illustrating a state in which the sound guiding portion 120 passes through portions other than a lower end edge of an ear lobe and is worn on the left ear of the listener.
Figure 20:
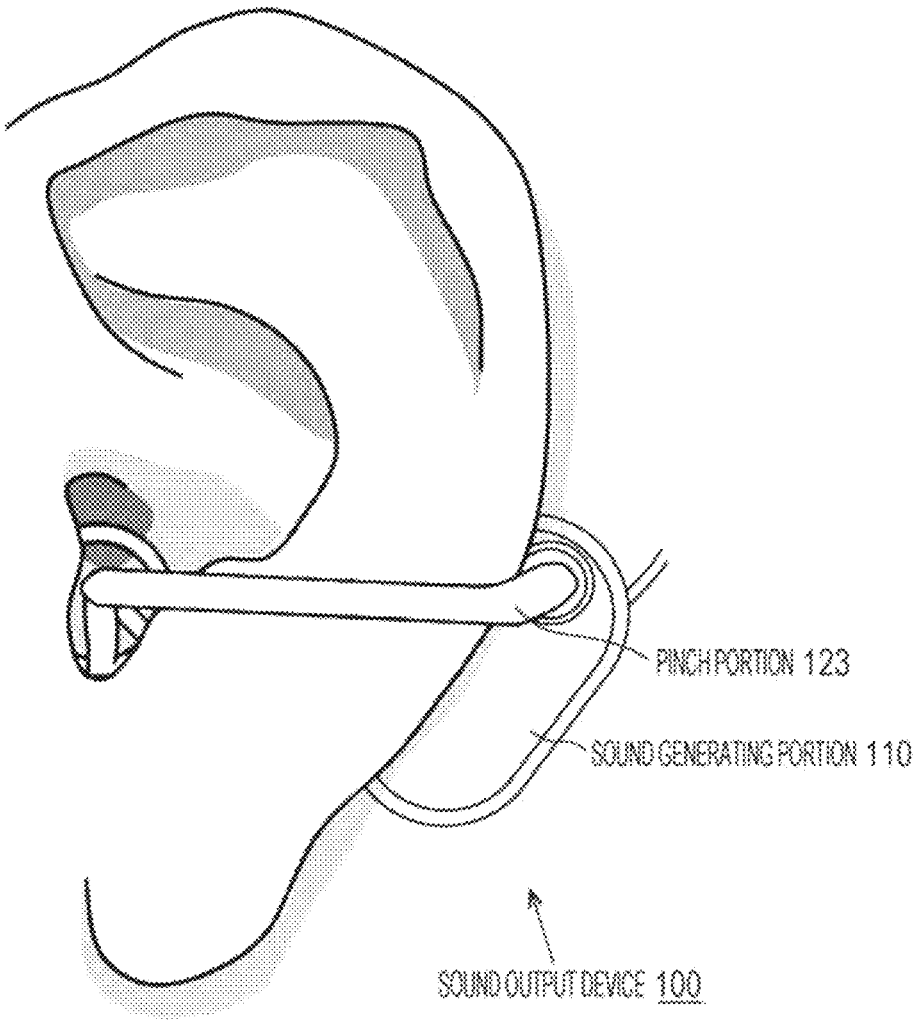
FIG. 20 is a diagram exemplarily illustrating a state in which the sound guiding portion 120 passes through portions other than the lower end edge of the ear lobe and is worn on the left ear of the listener.
Figure 21:
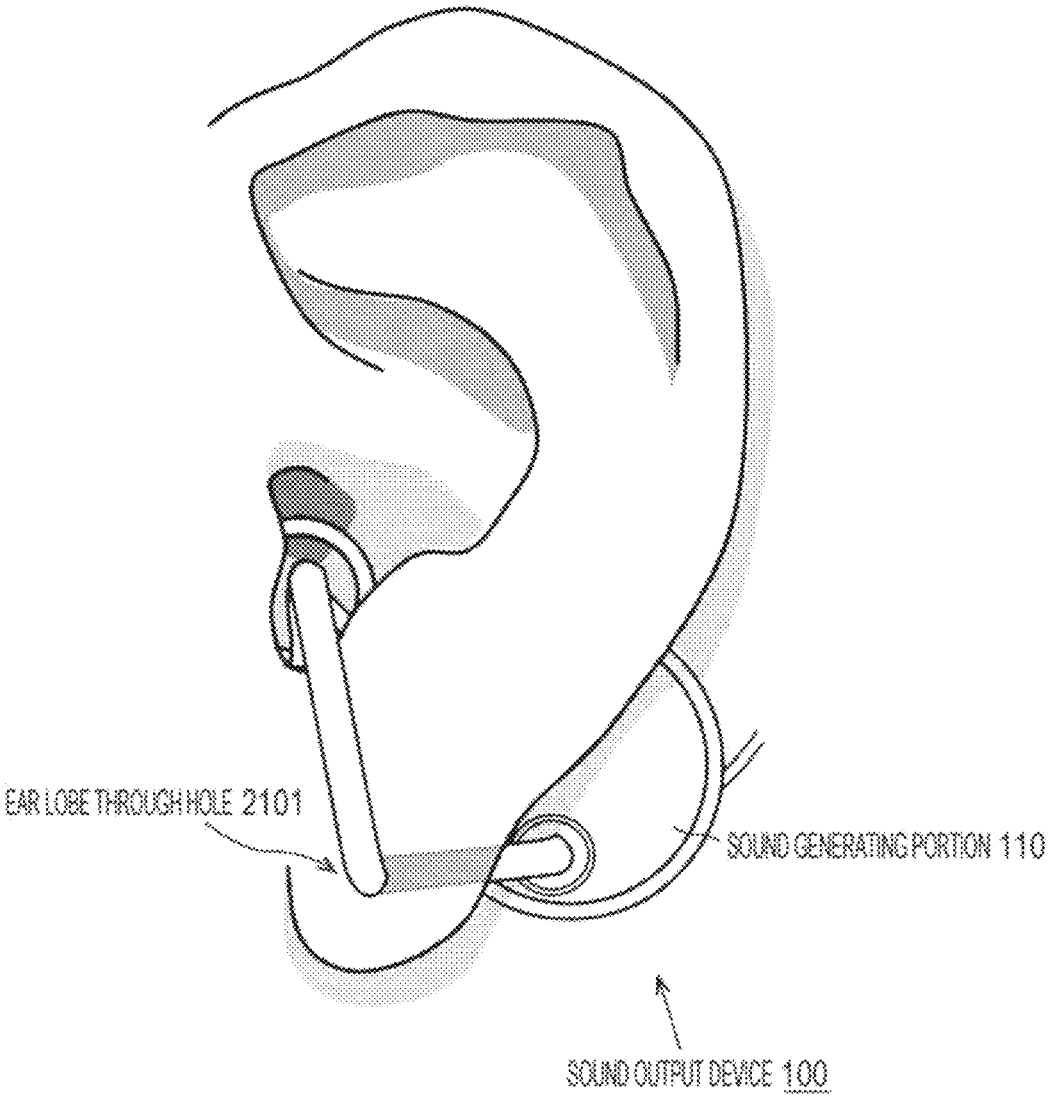
FIG. 21 is a diagram exemplarily illustrating a state in which the sound guiding portion 120 passes through portions other than the lower end edge of the ear lobe and is worn on the left ear of the listener.

FIGS. 19 to 21 exemplarily illustrate a state in which the sound guiding portion 120 passes through a portion other than the lower end edge of the ear lobe and is worn on the left ear of the listener. In the example illustrated in FIG. 19, the pinch portion 123 of the sound guiding portion 120 is folded back at an obliquely lower end edge of the ear lobe from the back of the pinna to the front of the pinna, and is extended from the back of the pinna to the vicinity of the entrance of the ear canal. Further, in the example illustrated in FIG. 20, the pinch portion 123 of the sound guiding portion 120 is folded back from the back of the pinna to the front of the pinna in nearly a horizontal direction, and is extended to the vicinity of the entrance of the ear canal. Further, in the example illustrated in FIG. 21, the sound guiding portion 120 is inserted into a through hole 2101 drilled in the ear lobe of the listener in the vicinity of the pinch portion 123, which is folded back from the back of the pinna to the front of the pinna, and is extended to the vicinity of the entrance of the ear canal.

[E. Holding Portion]

The holding portion 130 is engaged with the vicinity of the entrance of the ear canal (for example, the intertragic notch) while being in contact with the bottom face of the cavum conchae, and holds the vicinity of the other end 122 of the sound guiding portion 120 to cause the sound output hole of the other end 122 of the sound guiding portion 120 to face the depth side of the ear canal. That is, the holding portion 130 has a function to position the other end 122 of the sound guiding portion 120 to face the ear cavity (the depth side of the ear canal), and a function to hold the other end 122 of the sound guiding portion 120 not to come off the vicinity of the entrance of the ear canal.

When the other end 122 of the sound guiding portion 120 is accurately arranged to face the ear cavity, the sound 1600 radiated from the other end 122 of the sound guiding portion 120 is propagated in the ear canal 1601 and reaches the eardrum 1602, as illustrated by the reference number 1600 of FIG. 16. Meanwhile, if the other end 122 of the sound guiding portion 120 is arranged inclined with respect to the ear cavity (the direction of the ear canal), the sensitivity of the sound output is attenuated.

Figure 22:
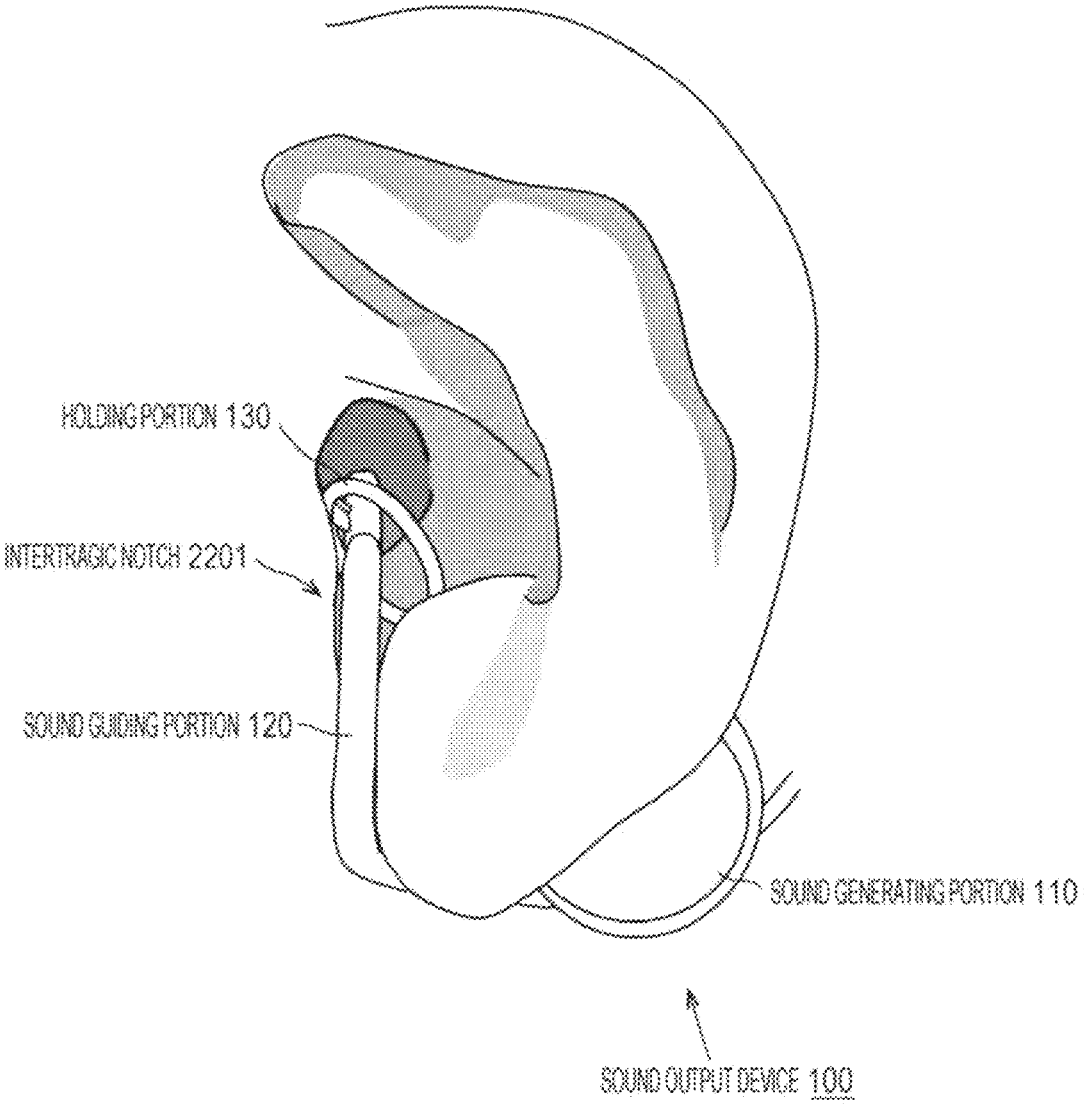
FIG. 22 is a diagram illustrating a state in which a holding portion 130 fixes the other end 122 of the sound guiding portion 120 near an entrance of the ear canal.
Figure 23:
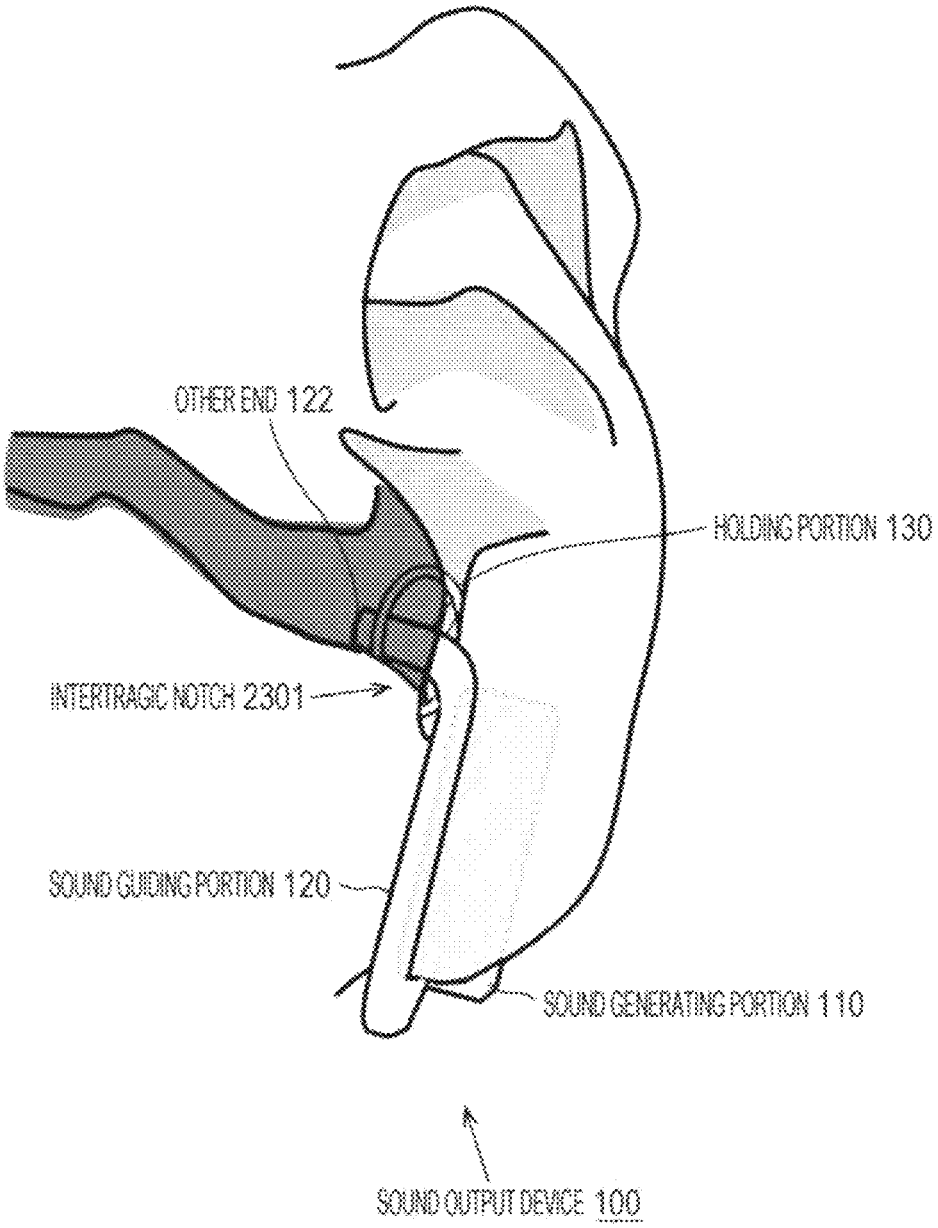
FIG. 23 is a diagram illustrating a state in which the holding portion 130 fixes the other end 122 of the sound guiding portion 120 near the entrance of the ear canal.

The holding portion 130 illustrated so far is a ring-like structural body, and is connected with the vicinity of the other end 122 of the sound guiding portion 120 only with the rod-like support member 132, and thus all portions other than the rod-like support member 132, of the ring-like structural body, are the hollow structure as the opening portion 131. FIGS. 22 and 23 illustrate a state in which the ring-like holding portion 130 fixes the other end 122 of the sound guiding portion 120 to the vicinity of the entrance of the ear canal. Note that FIG. 22 illustrates an appearance of the left ear of the listener who is wearing the sound output device 100, and FIG. 23 illustrates a coronal plane of the vicinity of the left ear of the head of the listener at that time. As illustrated in FIG. 22, favorably, the holding portion 130 is hanged on an intertragic notch 2201 while being in contact with the bottom face of the cavum conchae, thereby to realize stable wearing to the ear of the listener. Further, as illustrated in FIG. 23, when holding portion 130 is engaged with an intertragic notch 2301, the other end 122 of the sound guiding portion 120 is arranged to face the ear cavity.

The holding portion 130 is a ring-like structural body, and is connected with the vicinity of the other end 122 of the sound guiding portion 120 only with the rod-like support member 132, and thus all portions other than the rod-like support member 132, of the ring-like structural body, are the opening portion 131. Further, the inner diameter of the sound guiding portion 120 in the vicinity of the other end 122 is formed to be much smaller than the outer diameter of the ear cavity. Further, even in the state where the other end 122 is held in the vicinity of the entrance of the ear canal by the holding portion 130, the other end 122 does not block the ear cavity of the listener, and the ear cavity is open. Therefore, in a state where the listener wears the sound output device 100, the ambient sound enters the ear canal through a gap of the ear cavity without being disturbed, and is heard by the eardrum. Therefore, natural sound of the ambient sound can be realized. Further, the ear cavity being open gives the people around an impression of being welcomed to talk to, and does not impede interpersonal communication.

Figure 24D:
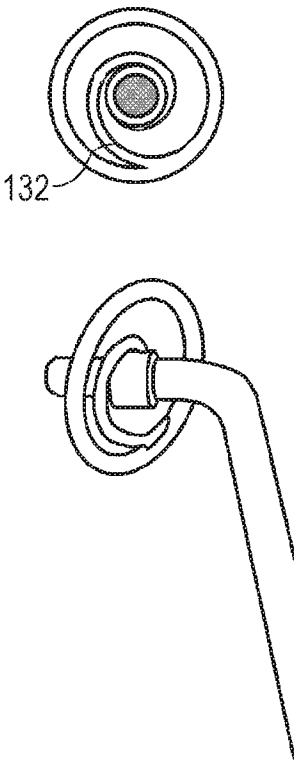
FIGS. 24(A) to 24(D) are diagrams illustrating configuration examples in which the ring-like holding portion 130 supports the other end 122 of the sound guiding portion 120.
Figure 24C:
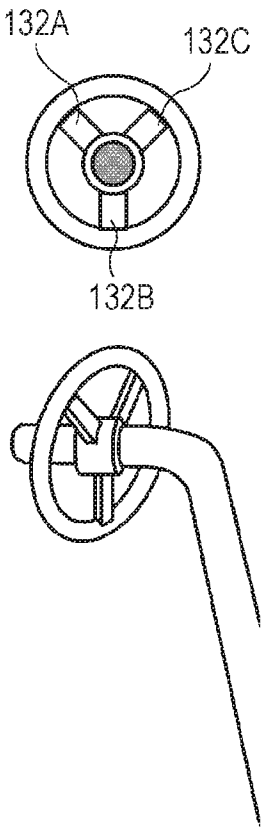
Figure 24B:
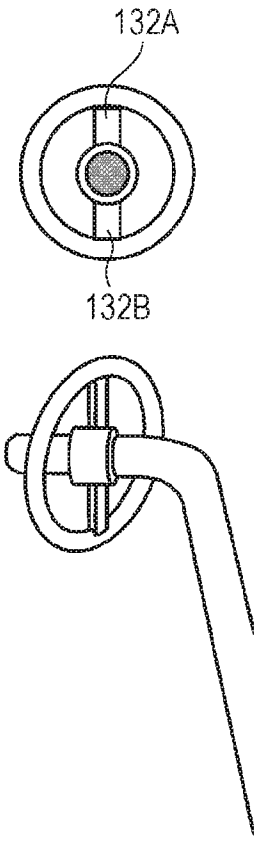
Figure 24A:
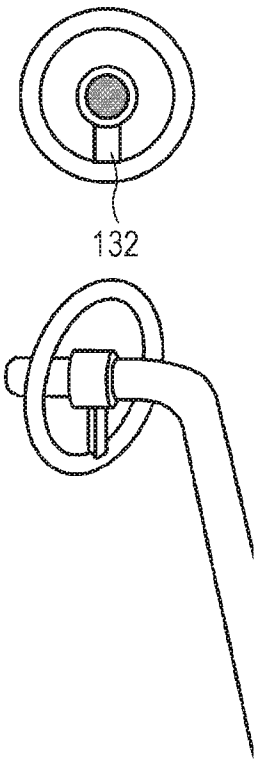

The ring-like holding portion 130 supports the vicinity of the other end 122 of the sound guiding portion 120 only with the rod-like support member 132 (described above). 24(A) to 24(D) illustrate other configuration examples in which the ring-like holding portion 130 supports the other end 122 of the sound guiding portion 120. FIG. 24(A) illustrates an example in which the holding portion 130 supports the other end 122 of the sound guiding portion 120 with the rod-like support member 132 at one place. Further, FIG. 24(B) illustrates an example in which the holding portion 130 supports the other end 122 of the sound guiding portion 120 with rod-like support members 132A and 132B at two places. Further, FIG. 24(C) illustrates an example in which the holding portion 130 supports the other end 122 of the other end 122 of the sound guiding portion 120 with rod-like support members 132A, 132B, and 132C at three places. Further, FIG. 24(D) illustrates an example in which the holding portion 130 supports the other end 122 of the sound guiding portion 120, using a spiral support member 132, at one place.

In any of the configuration examples illustrated in FIGS. 24(A) to 24(D), the holding portion 130 has a hollow structure, and the ear cavity is open. Therefore, even in a state where the listener engages the holding portion 130 with the intertragic notch, the ambient sound enters the ear canal through a gap of the ear cavity without being disturbed and is heard by the eardrum, and thus natural sound of the ambient sound can be realized.

In short, the holding portion 130 may have an arbitrary shape as long as the holding portion 130 has a hollow structure in which the ambient sound can be taken. Note that the holding portion 130 serves the function to position the other end 122 of the sound guiding portion 120, and the function to hold the other end 122 of the sound guiding portion 120 at the vicinity of the entrance of the ear canal.

Figure 25A:
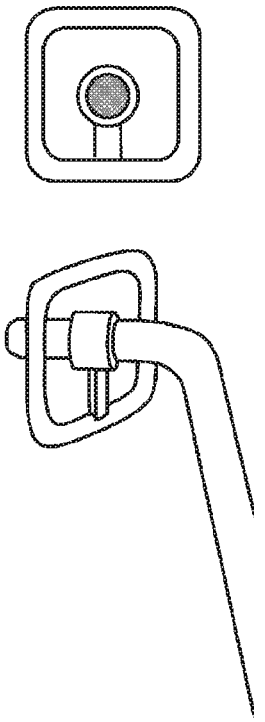
Figure 25B:
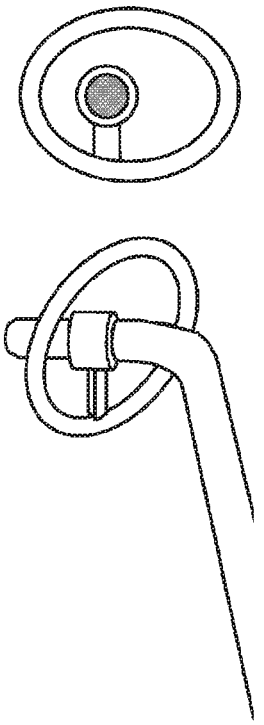
Figure 25C:
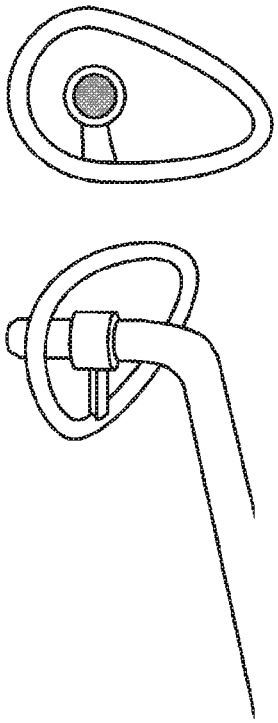
Figure 25D:
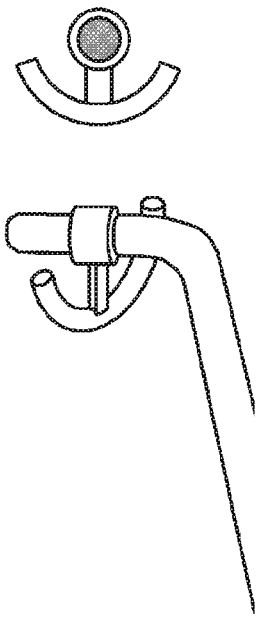
Figure 25E:
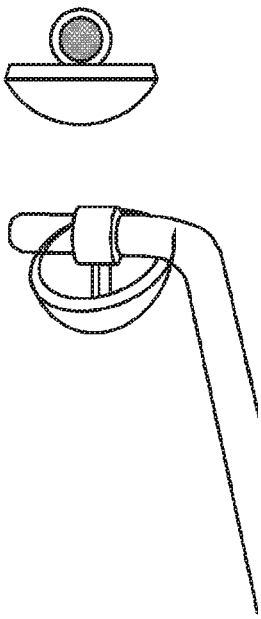
Figure 25F:
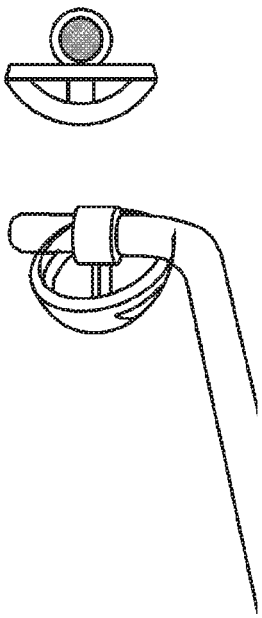

FIGS. 25(A) to 25(F) illustrate configuration examples of the holding portion 130 having a shape other than the ring shape, and having a hollow structure in which the ambient sound can be taken. FIG. 25(A) illustrates a configuration example of the holding portion 130 having a square shape, FIG. 25(B) illustrates a configuration example of the holding portion 130 having an oval shape, and FIG. 25(C) illustrates a configuration example of the holding portion 130 having an egg shape. The holding portions 130 illustrated in FIGS. 25(A) to 25(C) can be classified into one category where the holding portion 130 has an annular structure. Further, other than the annular structure, FIG. 25(D) illustrates a configuration example of the holding portion 130 having an anchor shape, FIG. 25(E) illustrates a configuration example of the holding portion 130 having a hemisphere shape, and FIG. 25(F) illustrates a configuration example of the holding portion 130 having a hemisphere shape with a hole, respectively. Although illustration is omitted, the holding portion 130 having a spherical shape instead of the hemisphere shape may be employed.

Further, holding performance for the intertragic notch by the holding portion 130 can be made favorable by manufacturing the holding portion 130 with a flexible material, more favorably, a material having restoring force (moderate elasticity).

Figure 26A:
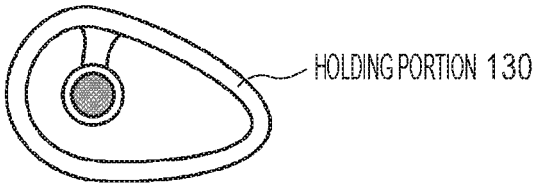
FIGS. 26(A) to 26(C) are diagrams illustrating a configuration example of the holding portion 130 having an egg shape and manufactured with a flexible material.
Figure 26B:
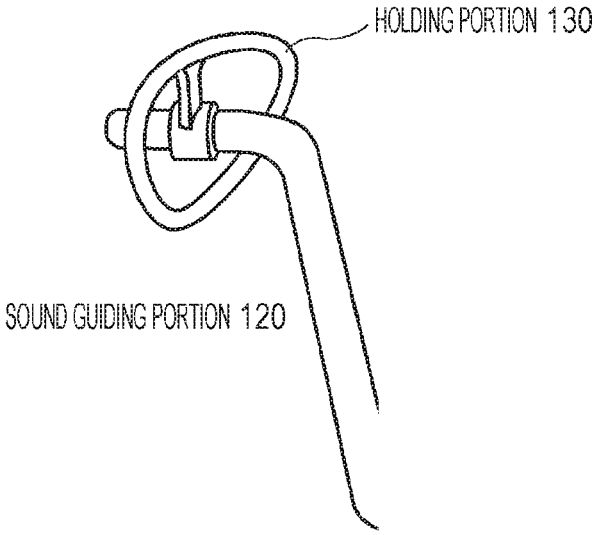
Figure 26C:
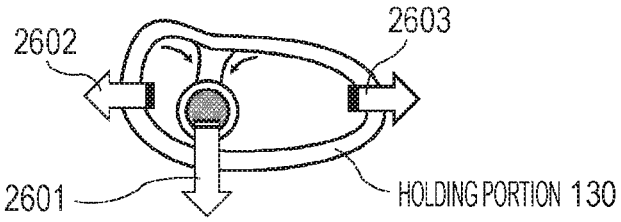
Figure 27:
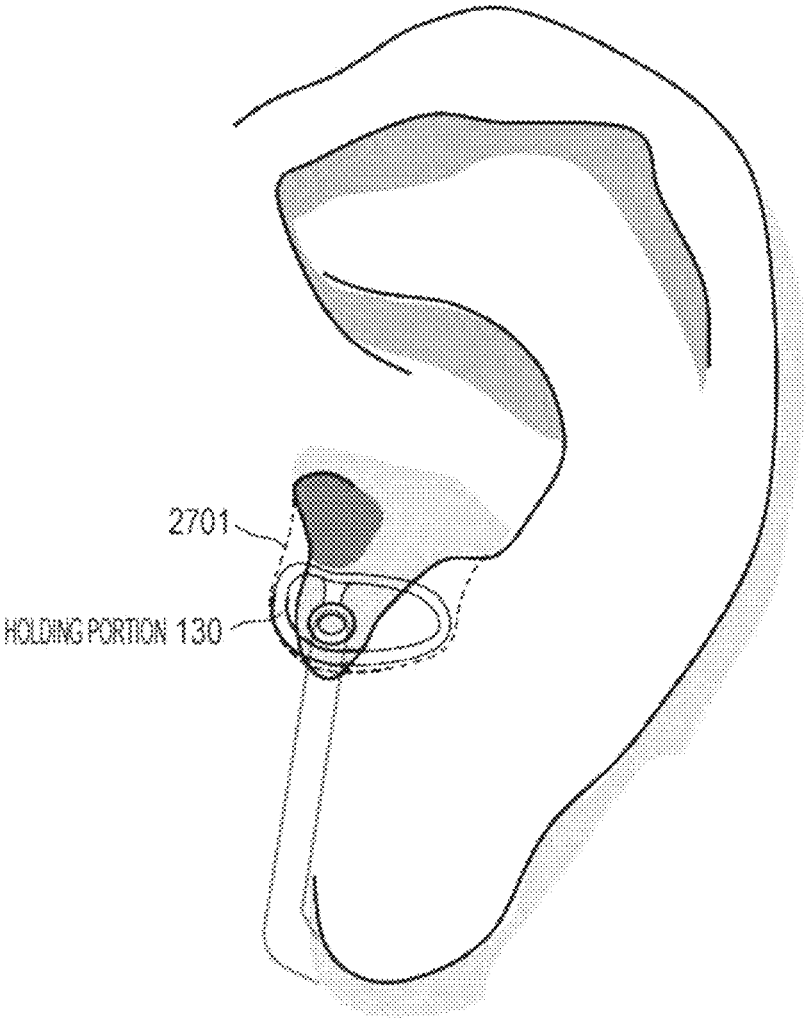
FIG. 27 is a diagram illustrating a state in which the holding portion 130 illustrated in FIGS. 26(A) to 26(C) is worn on the left ear of the listener.

FIGS. 26(A) to 26(C) illustrate a configuration example of the holding portion 130 having an egg shape manufactured with a flexible material. FIG. 26(A) illustrates a state in which the holding portion 130 before deformation is viewed from the front, and FIG. 26(B) illustrates a state in which the holding portion 130 before deformation is obliquely viewed, respectively. Further, FIG. 26(C) illustrates a state in which the holding portion 130 after deformation is viewed from the front. At the time of use of the sound output device 100, for example, as illustrated by the reference number 2601, external force that the other end 122 pulls the sound guiding portion 120 connected with the holding portion 130 acts. In a case where the holding portion 130 has an annular structure formed of a flexible material, if such tensile force 2601 acts, the holding portion 130 is deformed to be expanded in right and left directions on the sheet surface, as illustrated by the reference numbers 2602 and 2603. Therefore, the holding portion 130 becomes fit to the shape of the bottom face of the cavum conchae and comes in contact with the bottom face of the cavum conchae by plane, and the holding performance for the intertragic notch becomes more favorable. FIG. 27 illustrates a state in which the holding portion 130 (in the deformed state illustrated in FIG. 26(C)) illustrated in FIGS. 26(A) to 26(C) is engaged to be matched with a shape 2701 of the intertragic notch, and is worn on the left ear of the listener.

Further, the holding portion 130 is configured to have a shape fit to the shape surface of the bottom face of the cavum conchae in the intertragic notch space of the ear of an individual person, whereby the holding performance for the intertragic notch by the holding portion 130 can be made favorable.

Figure 28:
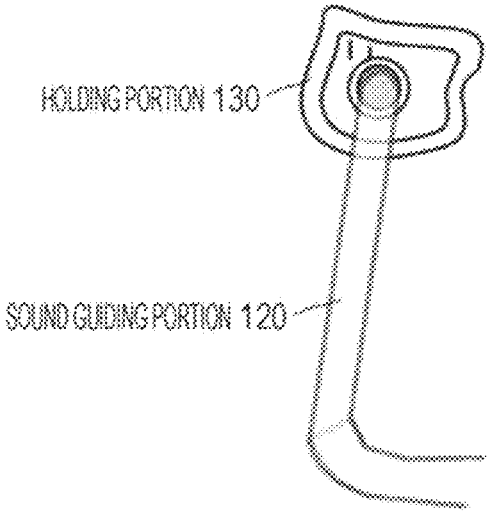
FIG. 28 is a diagram illustrating a state in which the holding portion 130 configured to have a shape fit to a shape surface of an intertragic notch space of an ear of an individual person is viewed from the front.
Figure 29:
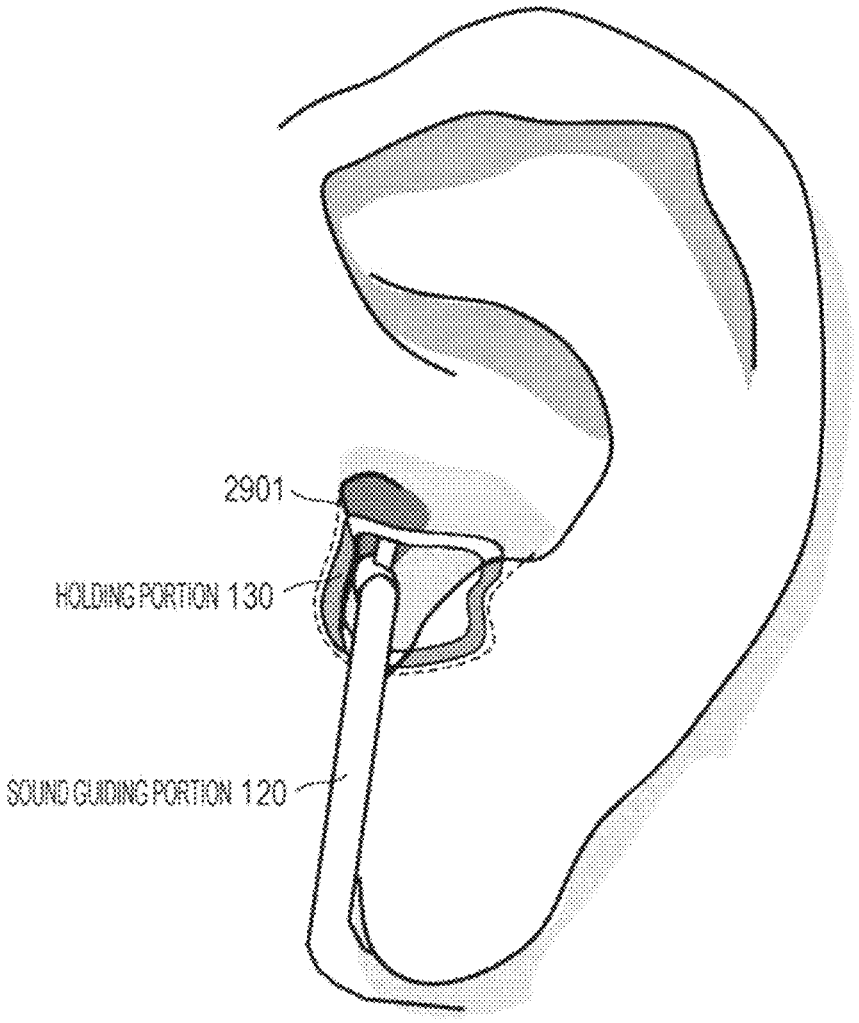
FIG. 29 is a diagram illustrating a state in which the holding portion 130 illustrated in FIG. 28 is worn on the left ear of the listener.

FIG. 28 illustrates a state in which the holding portion 130 configured to have a shape fit to the shape surface of the bottom face of the cavum conchae in the intertragic notch space of the ear of an individual person is viewed from the front. Further, FIG. 29 illustrates a state in which the holding portion 130 illustrated in FIG. 28 is worn on the left ear of the listener. As can be seen from FIG. 29, the holding portion 130 worn on the intertragic notch of the left ear is fit to a shape surface 2901 in the intertragic notch space of the ear of the listener. Therefore, the holding performance for the intertragic notch becomes more favorable.

Figure 30:
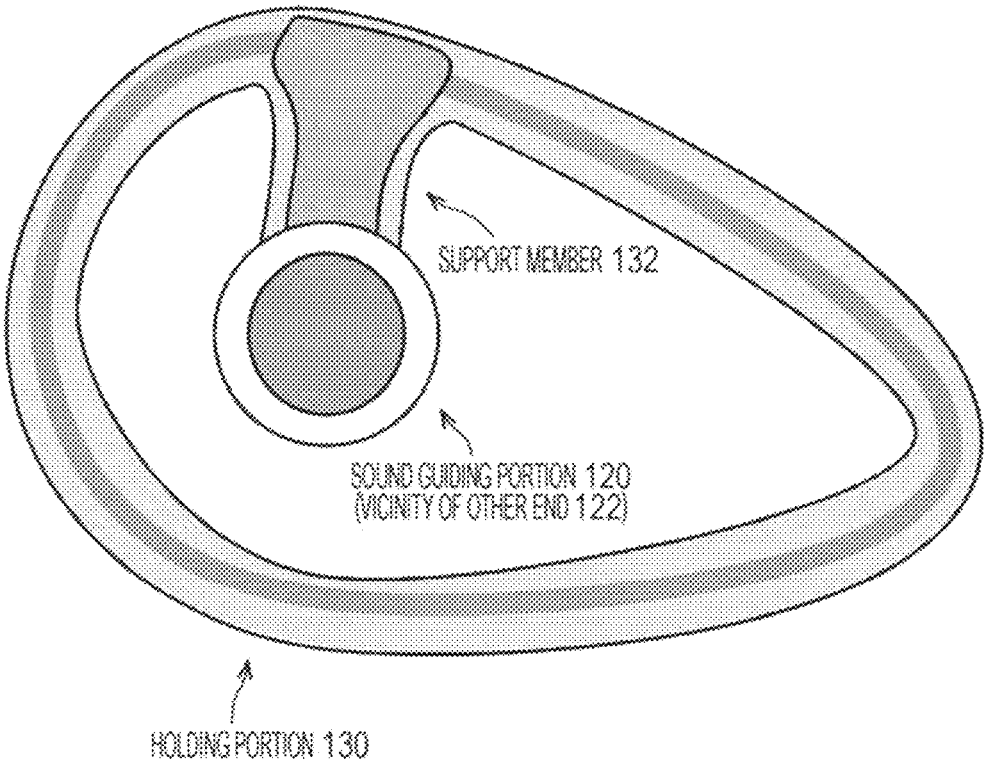
FIG. 30 is a diagram illustrating an internal configuration example of the holding portion 130 that maintains the shape and has moderate elasticity.

FIG. 30 illustrates an internal configuration example of the holding portion 130 having moderate elasticity, and which can be fit to the shape (the bottom face shape of the cavum conchae) in the intertragic notch space. The illustrated holding portion 130 is configured by coating a surface of an annular structural body 3001 made of a shape variable/shape memory wire or a narrow elastic piano wire with a resin such as silicone. Then, the holding portion 130 is connected with the vicinity of the other end 122 of the sound guiding portion 120 with the rod-like support member 132 (described above). The holding portion 130 illustrated in FIG. 30 can be used as the holding portion 130 (see FIGS. 26(*a*), 26(*b*) and 26(*c*) and FIG. 27) that is flexible and makes the holding performance for the intertragic notch favorable, or the holding portion 130 (see FIGS. 28 and 29) fit to the shape surface of the intertragic notch space of the year of an individual person.

Figure 75:
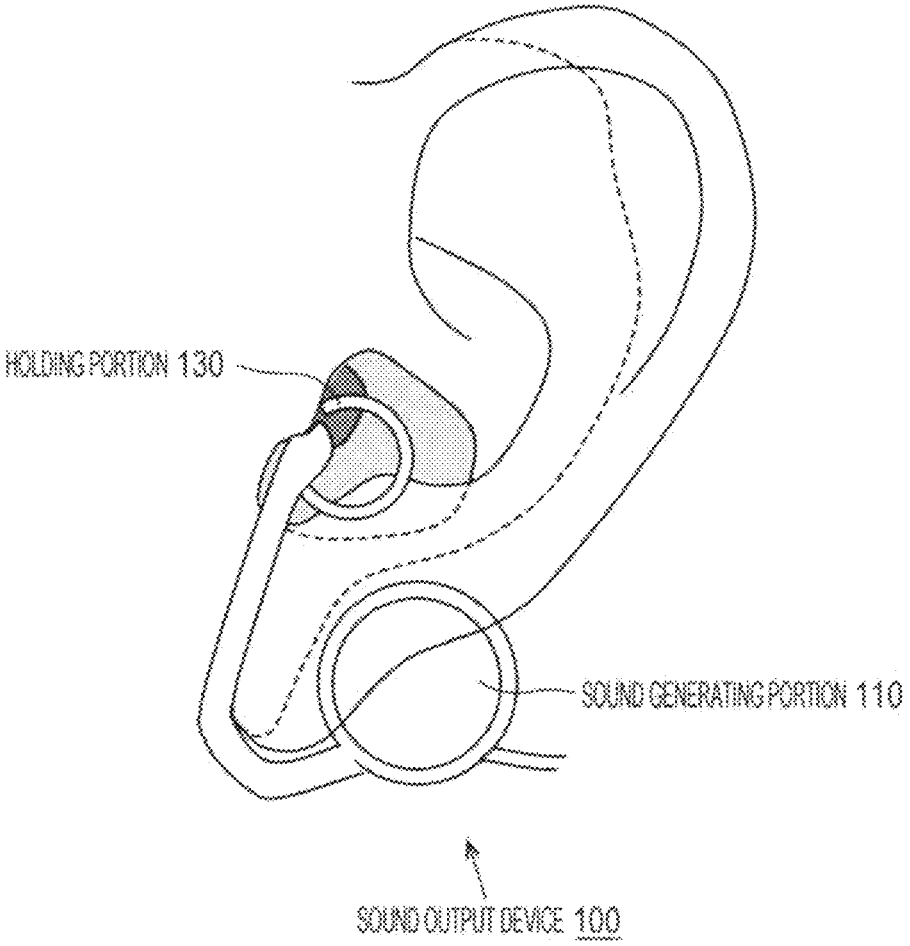
FIG. 75 is a diagram illustrating a contact state of the sound output device 100 illustrated in FIG. 9 with an ear (a bottom face of the cavum conchae and the ear back shape surface).

The configuration example of the holding portion 130 illustrated in FIGS. 26(*a*), 26(*b*) and 26(*c*) and FIG. 27 and the configuration example of the holding portion 130 illustrated in FIGS. 28 and 29 are common in that the holding portion 130 is in contact with the bottom face of the cavum conchae by plane (or a large contact area). If the contact area is large, the holding portion 130 is pressed against the bottom face of the cavum conchae by the pinch force of the pinch portion 123, and the pinch force is dispersed. Therefore, uncomfortable feeling in use over a long time can be substantially improved. Meanwhile, FIG. 9 illustrates the wearing state of the sound output device 100 made of a basic configuration on the left ear. FIG. 75 illustrates a contact state of the holding portion 130 and the sound generating portion 110 with the left ear (the bottom face and the ear back shape surface of the cavum conchae). In this case, the holding portion 130 is in contact with the bottom face of the cavum conchae by a point (or a narrow contact area), and the sound generating portion 110 is in contact with the back side of the pinna by a point (or a narrow contact area). Therefore, the pinch force concentrates on the narrow contact portions. Therefore, if the listener uses the sound output device 100 in the wearing state as illustrated in FIG. 75 over a long time, the listener will gradually feel a pain in the contact portions and the uncomfortable feeling will be increased.

Figure 76:
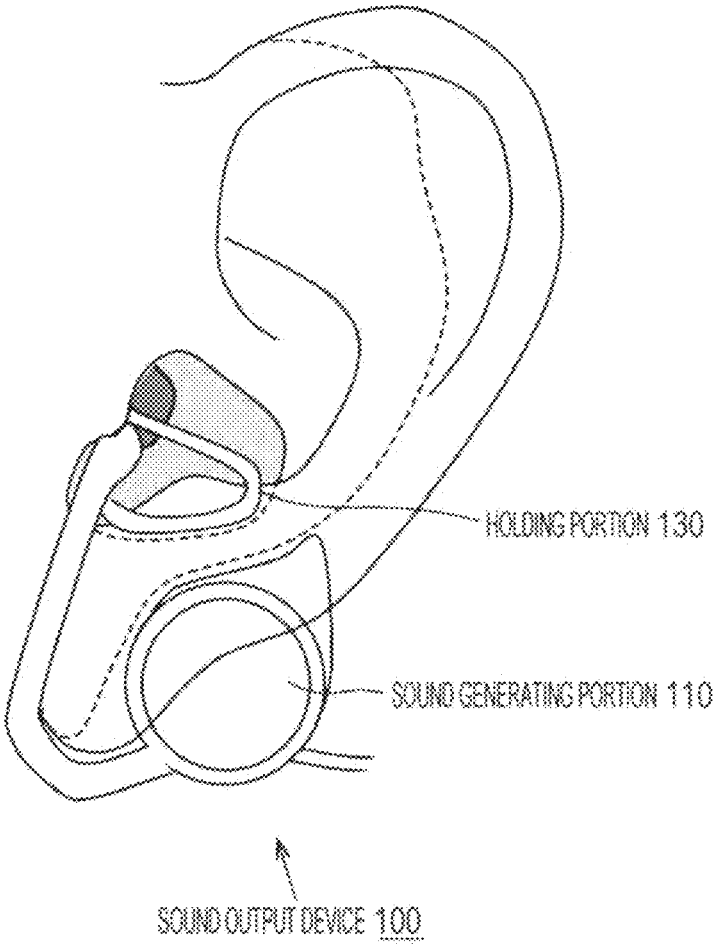
FIG. 76 is a diagram illustrating a state in which the sound output device 100, in which the holding portion 130 fit to a bottom face shape of the cavum conchae and the sound generating portion 110 fit to the ear back shape surface are combined, is worn on the left ear of the listener.
Figure 77:
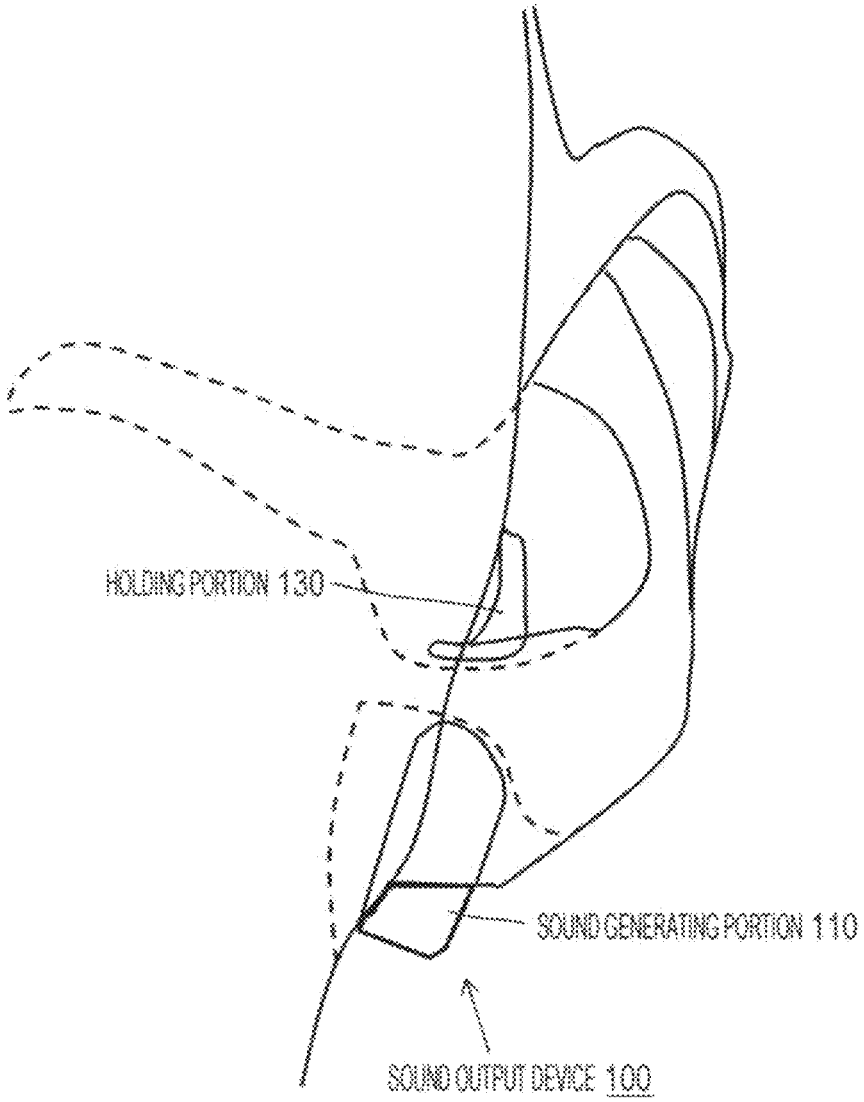
FIG. 77 is a diagram illustrating a state in which the holding portion 130 and the sound generating portion 110 are viewed from the front of the wearer in the wearing state illustrated in FIG. 76.

Further, FIG. 14 illustrates the example in which the shape of the sound generating portion 110 is formed to be fit to the ear back shape surface of the listener. In such a case, the contact area becomes large, and the sound output device 100 can be firmly worn on the ear of the listener with smaller pinch force. Further, the pinch force is dispersed, and the uncomfortable feeling can be improved in use over a long time. Further, the configuration example of the holding portion 130 illustrated in FIGS. 26(*a*), 26(*b*) and 26(*c*) and FIG. 27 and the configuration example of the holding portion 130 illustrated in FIGS. 28 and 29 may be used in combination of the sound generating portion 110 fit to the ear back shape surface illustrated in FIG. 14. FIG. 76 illustrates a state in which the sound output device 100 in which the holding portion 130 fit to the bottom face shape of the cavum conchae and the sound generating portion 110 fit to the ear back shape surface are combined is worn on the left ear of the listener. Further, FIG. 77 illustrates a state in which the holding portion 130 and the sound generating portion 110 are viewed in the wearing state illustrated in FIG. 76 from the front of the wearer (a direction perpendicular to FIG. 76). The holding portion 130 does not have a simple ring shape, and the lower end portion is curved to follow the bottom face shape of the cavum conchae. Further, in the sound generating portion 110, not only the portion coming in contact with the ear back has a bottom face shape fit to the ear back shape surface, but also a cross section of the portion is formed into a curved shape like an arc shape (R shape), instead of a flat shape. Therefore, both the holding portion 130 and the sound generating portion 110 are in contact with the corresponding portions by plane (large contact area), and thus the sound output device 100 can be firmly worn on the ear of the listener with smaller pinch force. Further, the pinch force is dispersed, and thus the uncomfortable feeling can be substantially improved in use over a long time.

Figure 31:
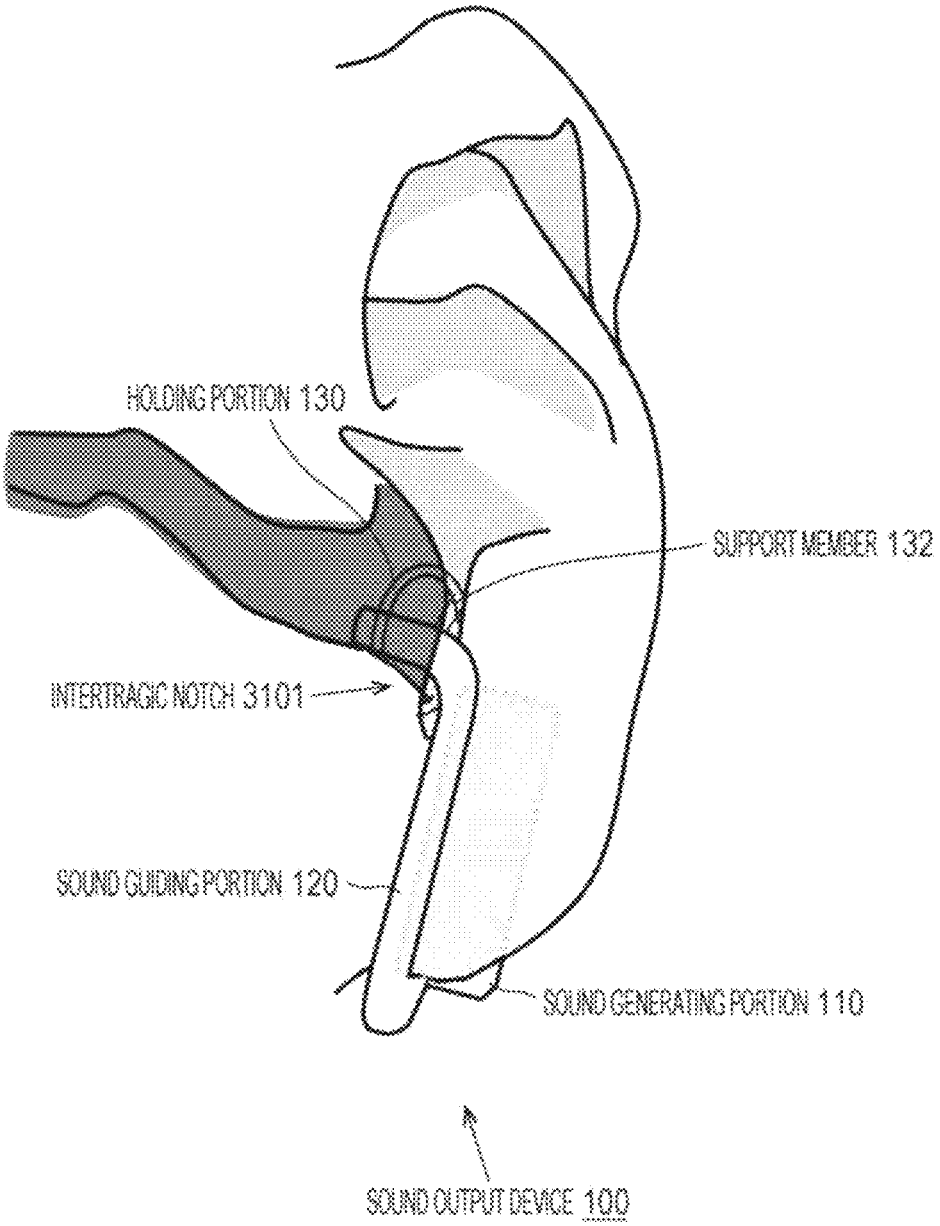
FIG. 31 is a diagram illustrating a state in which the holding portion 130 that also has a function to guard the eardrum is worn on the ear of the listener.
Figure 32:
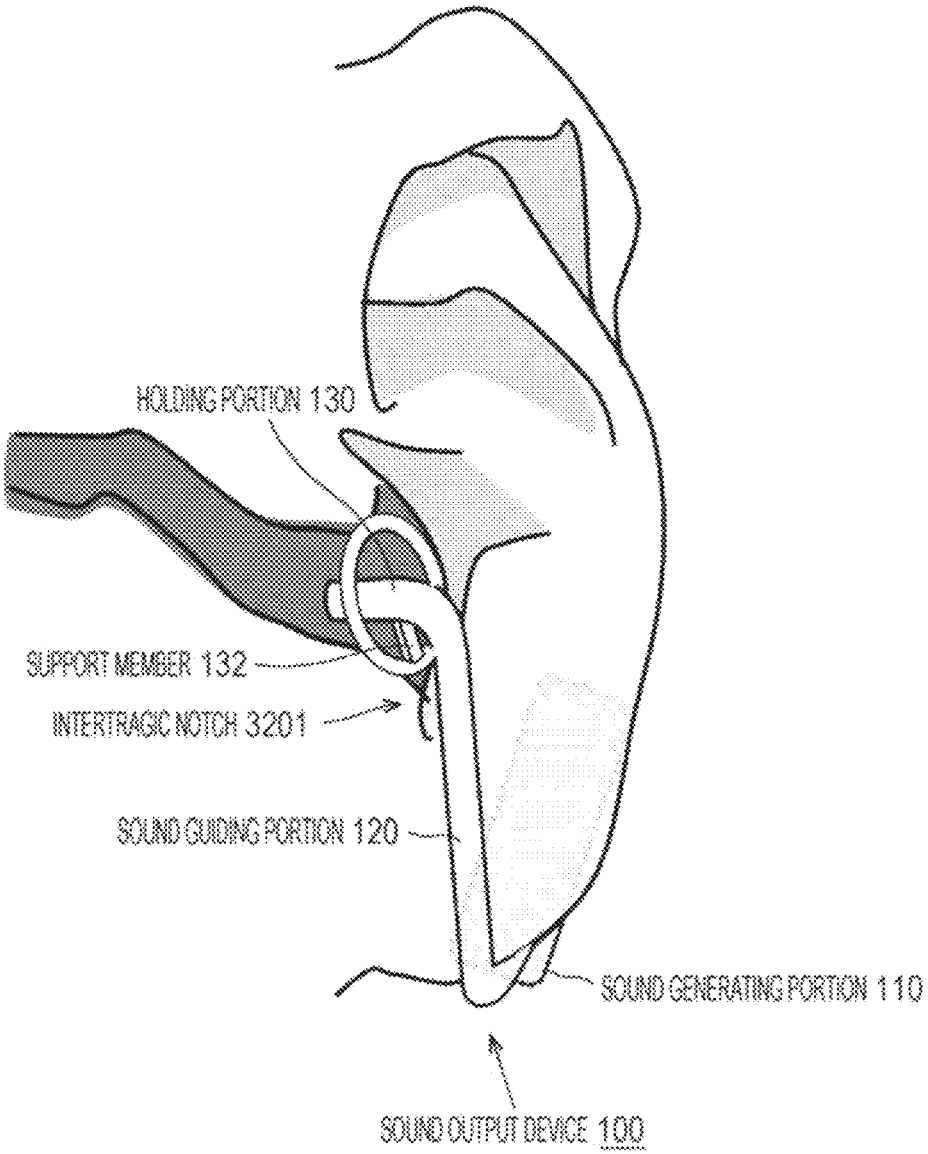
FIG. 32 is a diagram illustrating a state in which the holding portion 130 that also has the function to guard the eardrum is worn on the ear of the listener.

Further, the holding portion 130 favorably serves a function to guard the eardrum by keeping the other end 122 of the sound guiding portion 120 not to enter the ear canal more than necessary. For example, the holding portion 130 fixes the vicinity of the other end 122 of the sound guiding portion 120 through the support member 132, and the other end 122 of the sound guiding portion 120 does not enter the ear canal more than necessary if the holding portion 130 is larger than the ear cavity. Therefore, the holding portion 130 can guard the eardrum. FIGS. 31 and 32 illustrate a state in which the holding portion 130 that also serves the function to guard the eardrum is worn on the ear of the listener. Note that FIG. 31 illustrates a state in which the ring-like holding portion 130 is engaged with an intertragic notch 3101 of the left ear of the listener. Further, FIG. 32 illustrates a state in which the ring-like holding portion 130 comes off an intertragic notch 3201 and is not in an engaged state, but cannot physically enter the depth of the ear canal because the outer diameter of the ring is larger than the inner diameter of an entrance 3202 of the canal. Alternatively, the holding portion 130 may have a shape by which the holding portion 130 cannot physically enter the depth of the ear canal, instead of a large size.

In short, the holding portion 130 may have an arbitrary shape as long as the holding portion 130 cannot physically enter the depth of the ear canal and has the function to guard the eardrum, and has a hollow structure in which the ambient sound is taken. Note that the holding portion 130 serves the function to position the other end 122 of the sound guiding portion 120, and the function to hold the other end 122 of the sound guiding portion 120 at the vicinity of the entrance of the ear canal.

Figure 33A:
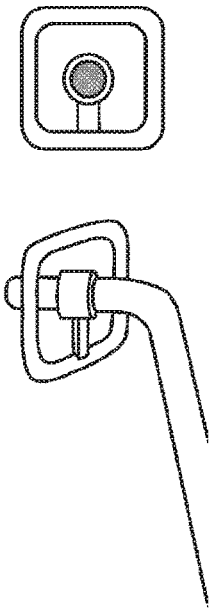
FIGS. 33(A) to 33(H) are diagrams illustrating configuration examples of the holding portion 130 having a shape other than the ring shape, which can serve the function to guard the eardrum.
Figure 33B:
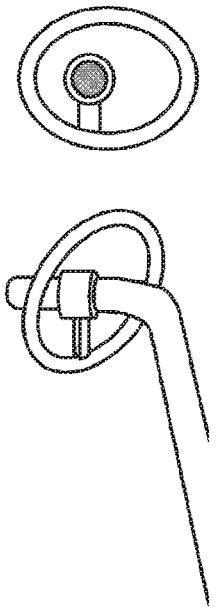
Figure 33C:
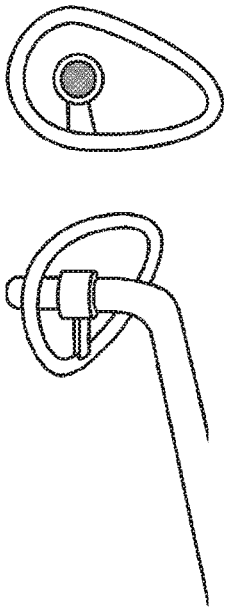
Figure 33D:
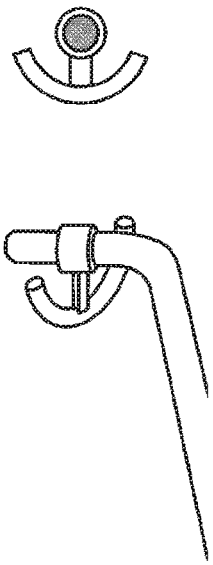
Figure 33E:
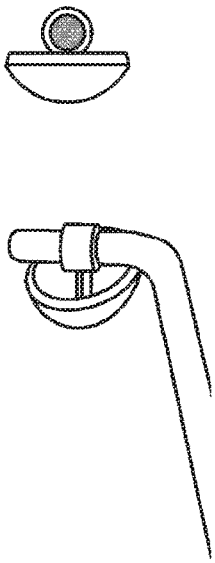
Figure 33F:
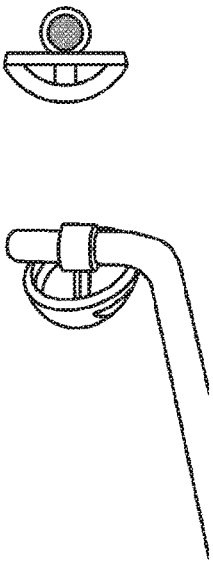
Figure 33G:
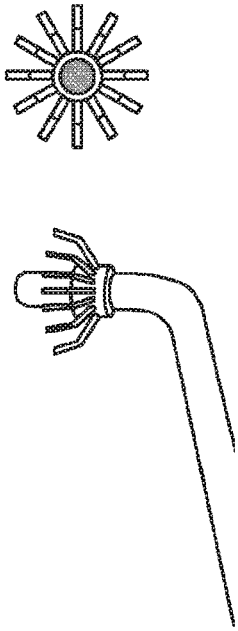
Figure 33H:
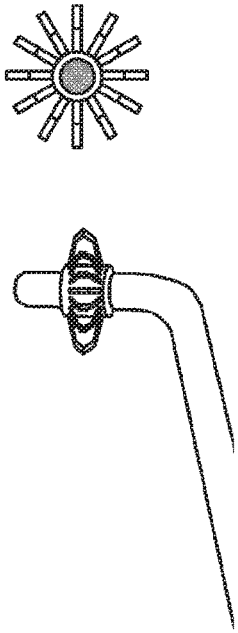

FIGS. 33(A) to 33(H) illustrate configuration examples of the holding portion 130 having a shape other than the ring shape, and which can serve the function to guard the eardrum. FIG. 33(A) illustrates a configuration example of the holding portion 130 having a square shape, FIG. 33 (B) illustrates a configuration example of the holding portion 130 having an oval shape, and FIG. 33(C) illustrates a configuration example of the holding portion 130 having an egg shape. The holding portions 130 illustrated in FIGS. 33(A) to 33(C) can be classified into one category where the holding portion 130 has an annular structure. Further, other than the annular structure, the reference number FIG. 33(D) illustrates a configuration example of the holding portion 130 having an anchor shape, FIG. 33(E) illustrates a configuration example of the holding portion 130 having a hemisphere shape, and FIG. 33(F) illustrates a configuration example of the holding portion 130 having a hemisphere shape with a hole, respectively. Although illustration is omitted, the holding portion 130 having a spherical shape instead of the hemisphere shape may be employed. Further, a multiple holding portion 130 formed in a radial manner, as illustrated in FIGS. 33(G) and 33(H) may be employed, instead of the structures in which the holding portion 130 supports the vicinity of the other end 122 of the sound guiding portion 120 with one or more support member 132, as illustrated in FIGS. 33(A) to 33(F).

[F. Wearing Mechanism on Ear]

In the examples illustrated in FIG. 9 and the like, the sound output device 100 is attached by pinching the pinna of the listener with the bent sound guiding portion 120, using the open-close structure of the pinch portion 123 arranged in the intermediate portion of the sound guiding portion 120.

Since the ears of persons have different shapes from one person to another, it is expected that stability of wearing varies depending on individual persons. In the present embodiment, as illustrated in FIGS. 7 to 9, the holding portion 130 that supports the vicinity of the other end 122 of the sound guiding portion 120 is engaged with the intertragic notch, and the housing of the sound generating portion 110 connected with one end 121 of the sound guiding portion 120 is pressed against the back-side surface of the pinna by the pinch force generated in the pinch portion 123. Therefore, the stability of wearing can be realized regardless of the personal difference in the ear shape.

For example, the sound guiding portion 120 is integrally manufactured with a material having spring characteristics, and the pinch force of the pinch portion 123 bent in a dogleg shaped manner can be generated.

Alternatively, the D portion of the sound guiding portion 120 is configured from a separate part that enables open/close operation using spring characteristics, and the D portion is connected with the C portion and the E portion as the pinch portion 123, thereby to configure the sound guiding portion 120 bent in a dogleg shaped manner to generate the pinch force.

Figure 34:
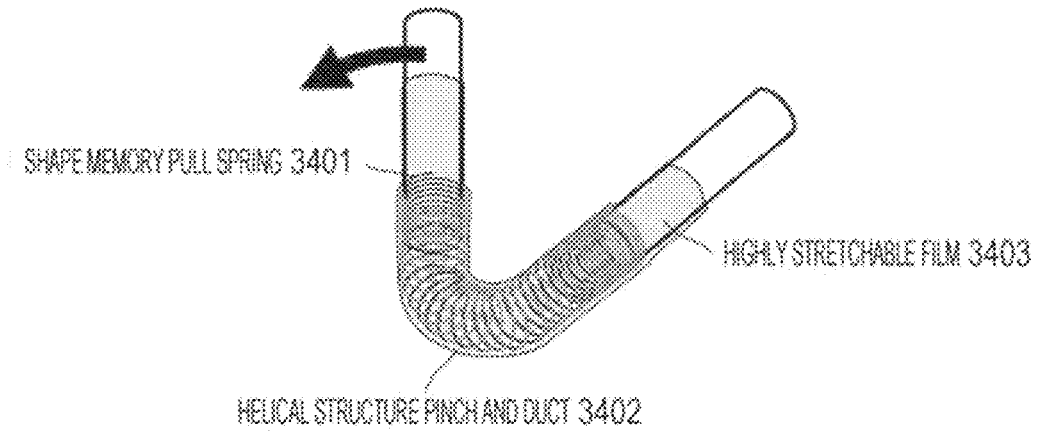
FIG. 34 is a diagram illustrating a configuration example of the pinch portion 123 configured as a separate part, and having spring characteristics to enable open/close operations.
Figure 35:
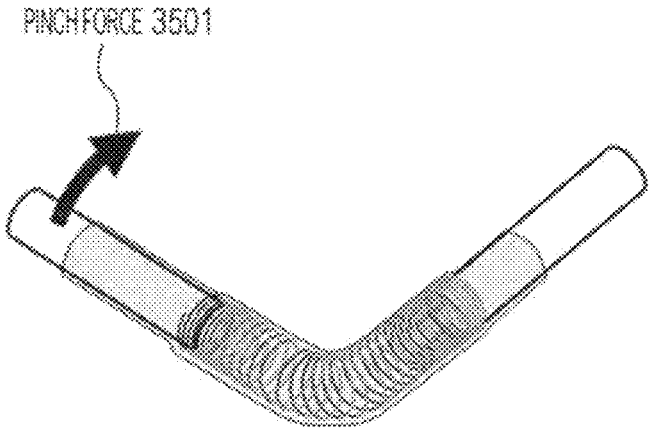
FIG. 35 is a diagram illustrating a configuration example of the pinch portion 123 configured as a separate part, and having spring characteristics to enable open/close operations.

FIGS. 34 and 35 illustrate a configuration example of the pinch portion 123 configured as a separate part, and which can perform open/close operation using spring characteristics. Note that FIG. 34 illustrates a close state of the pinch portion 123, and FIG. 35 illustrates an open state of the pinch portion 123. The illustrated pinch portion 123 is configured from a shape memory pull spring 3401 that stores a dogleg shape in the close position, a helical structure pinch and duct 3402 that is bent and stretched together with the shape memory pull spring 3401, and a highly stretchable film 3403 that covers an outside of a bent portion thereof. Then, when the pinch portion 123 is in the open state, the pinch portion 123 generates the pinch fore to return to the close position, as illustrated by the reference number 3501 of FIG. 35. Further, the highly stretchable film 3403 expands and contracts inside and outside the bent portion with deformation of the pinch portion 123, and keeps the inside of the sound guiding portion 120 to the closed space.

Figure 36:
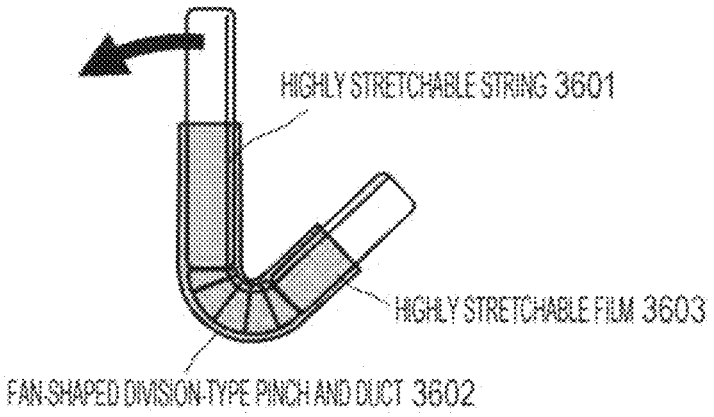
FIG. 36 is a diagram illustrating another configuration example of the pinch portion 123 configured as a separate part, and having spring characteristics to enable open/close operations.
Figure 37:
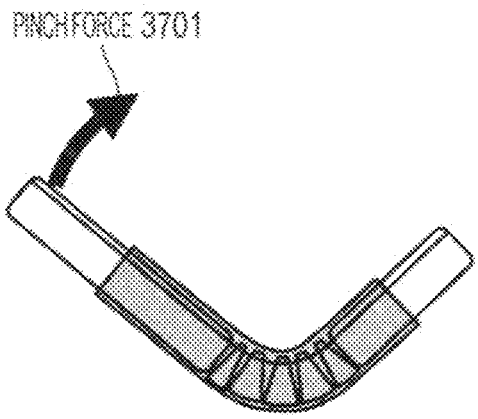
FIG. 37 is a diagram illustrating another configuration example of the pinch portion 123 configured as a separate part, and having spring characteristics to enable open/close operations.

Further, FIGS. 36 and 37 illustrate another configuration example of the pinch portion 123 configured as a separate part, and which can perform open/close operation using spring characteristics. Note that FIG. 36 illustrates a close state of the pinch portion 123, and FIG. 37 illustrates an open state of the pinch portion 123. The illustrated pinch portion 123 is configured from a highly stretchable string 3601 that expands and contracts in a length direction, a fan-shaped division-type pinch and duct 3602 that is bent and stretched with the expansion and contraction of the highly stretchable string 3601, and a highly stretchable film 3603 that covers an outside of a bent portion thereof. Then, when the pinch portion 123 is in the open state, the pinch portion 123 generates the pinch force to return to the close position, as illustrated by the reference number 3701 of FIG. 37.

Figure 38:
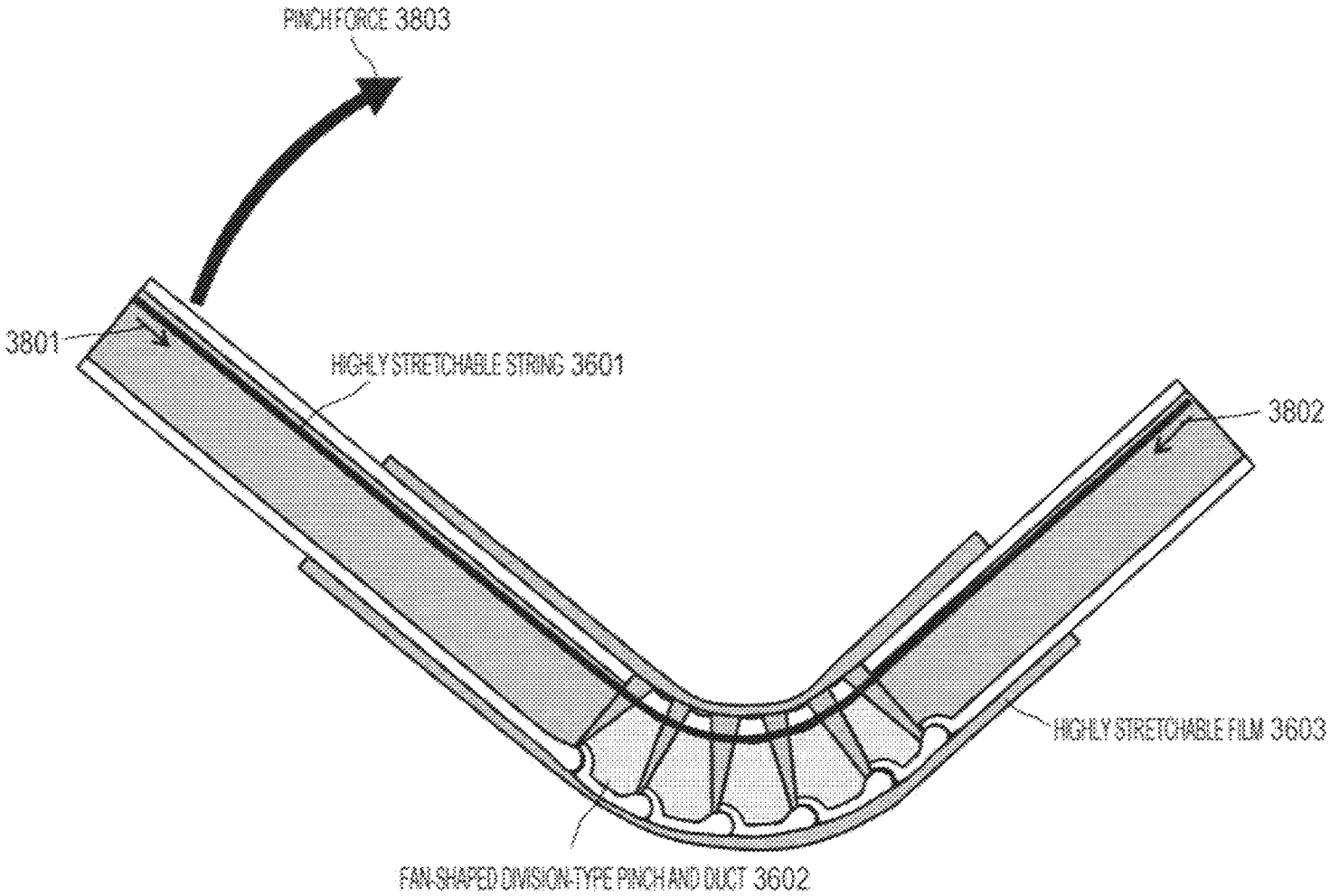
FIG. 38 is a diagram illustrating a detailed internal structure of the pinch portion 123 illustrated in FIGS. 36 and 37.

FIG. 38 illustrates a detailed internal structure of the pinch portion 123 illustrated in FIGS. 36 and 37. The highly stretchable string 3601 is inserted in the bent pinch portion 123 at an inner side. Then, pinch force 3803 to return the pinch portion 123 to the close position is generated by tensile force 3801 and 3802 acting on the highly stretchable string 3601. Further, the fan-shaped division-type pinch and duct 3602 is configured such that a plurality of ducts having a fan shape in cross section is arranged to have centers at an inner side of the bent pinch portion 123 and have periphery sides at an outer side of the bent pinch portion 123. Then, the fan-shaped division-type pinch and duct 3602 is opened and closed with bending and stretching operation of the pinch portion 123 with the expansion and contraction of the highly stretchable string 3601.

So far, the example to generate the pinch force for pinching the ear lobe, by bending in the pinch portion 123 corresponding to the D portion having a bent shape, of the sound guiding portion 120, has been described. A method of pinching the ear lobe, using the pinch force generated by twist around an axis in the E portion can be considered instead of the pinch force generated in the D portion (or in addition to the pinch force generated in the D portion).

Figure 39:
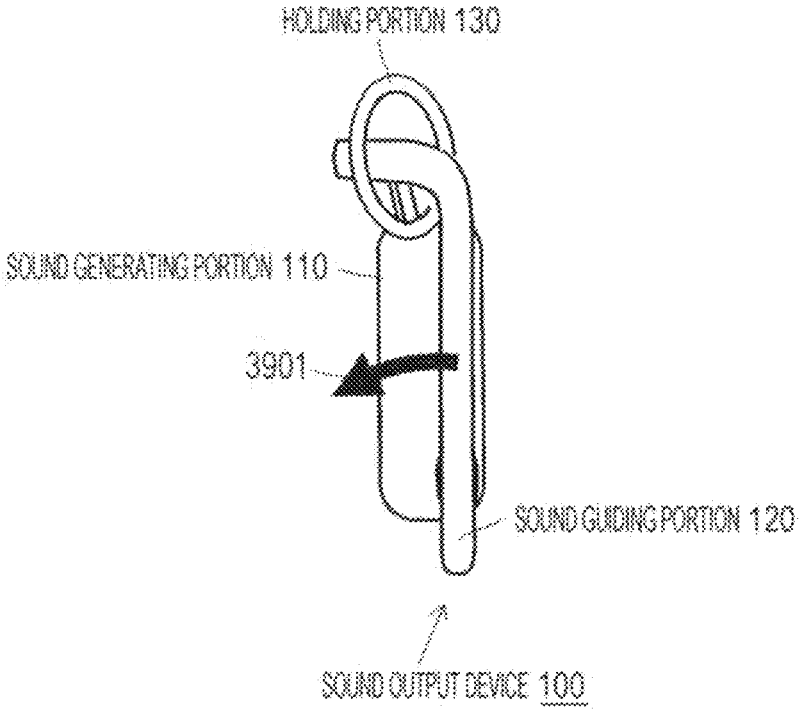
FIG. 39 is a diagram illustrating pinch force generated due to twist of an A portion of the sound guiding portion 120.
Figure 40:
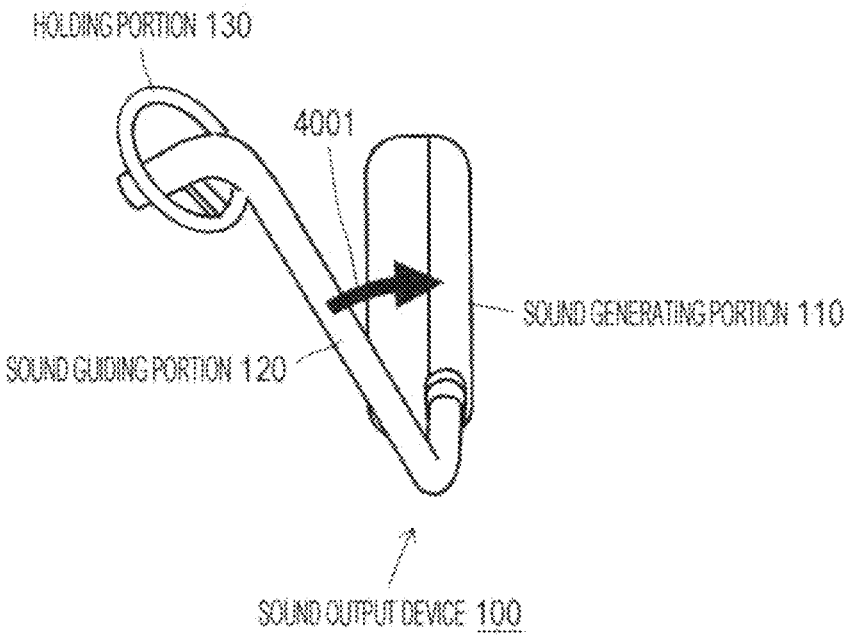
FIG. 40 is a diagram illustrating pinch force generated due to twist of the A portion of the sound guiding portion 120.
Figure 41:
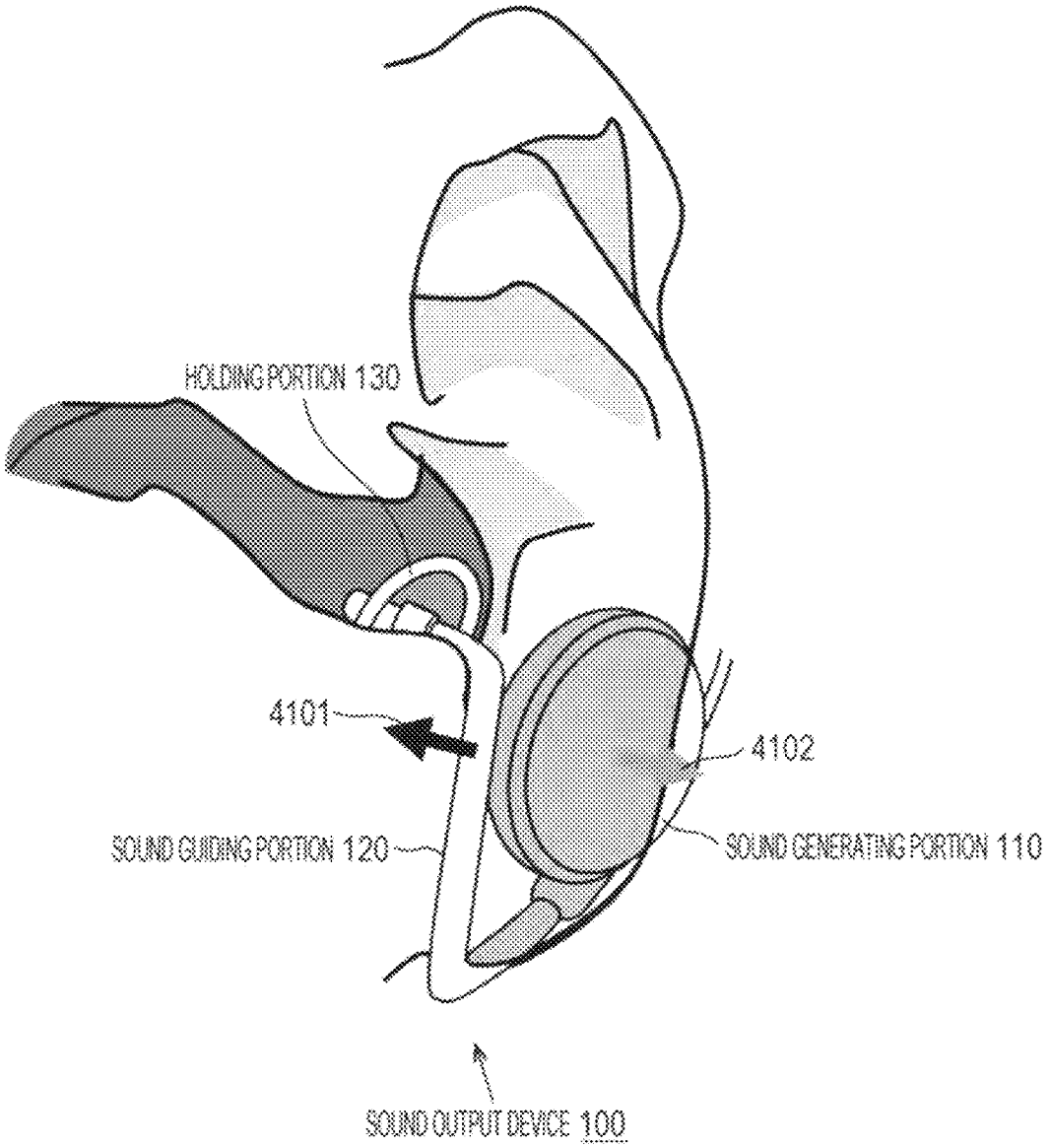
FIG. 41 is a diagram illustrating a state in which pinch force 4101 and 4102 are generated due to twist of the A portion of the sound guiding portion 120 in the sound output device 100 worn on the left ear of the listener.

FIG. 39 illustrates pinch force 3901 to return to an open position, which is generated in the C portion through the D portion by twist of the E portion, in the sound guiding portion 120 in the close state. Further, FIG. 40 illustrates pinch force (torque) 4001 to return to the close position, which is generated in the C portion through the D portion by twist of the E portion, in the sound guiding portion 120 in the open state. Further, FIG. 41 illustrates a state in which pinch force 4101 and 4102 is generated by twist of the E portion of the sound guiding portion 120, in the sound output device 100 worn on the left ear of the listener.

Figure 42:
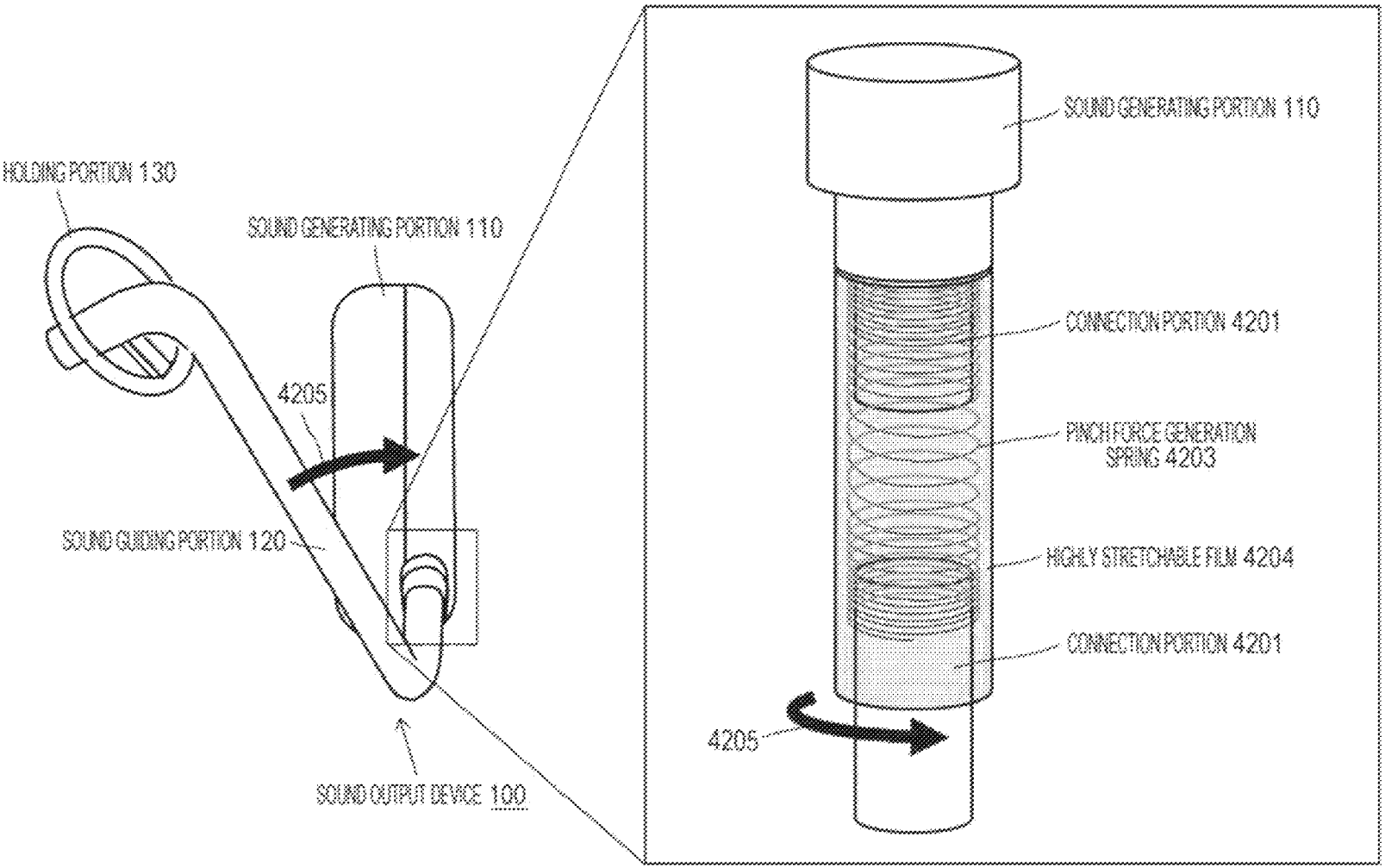
FIG. 42 is a diagram illustrating a structure for generating the pinch force in the A portion of the sound guiding portion 120.

FIG. 42 illustrates an enlarged and detailed structure for generating the pinch force in the E portion of the sound guiding portion 120. Both ends of the illustrated E portion are a connection portion 4201 with the sound generating portion 110 and a connection portion 4202 with the D portion, respectively, and these connection portions are connected with a pinch force generation spring 4203. Further, an outside of the pinch force generation spring 4203 is covered with a highly stretchable film 4204. When the sound guiding portion 120 is in the open state as illustrated in FIG. 40, pinch force (torque) 4205 to return to the close position is generated in the pinch force generation spring 4203 of the E portion. Further, the highly stretchable film 4204 expands and contracts with twist of the E portion to keep the inside of the sound guiding portion 120 to the closed space with the twist of the E portion.

Further, means to cause the sound output device 100 to be worn on the ear is not limited to the pinch structure of the sound guiding portion 120. For example, a mechanism to attach the sound generating portion 110 to the ear lobe, in place of, or in addition to the action to pinch the ear lobe by the pinch portion 123 of the sound guiding portion 120.

Figure 43:
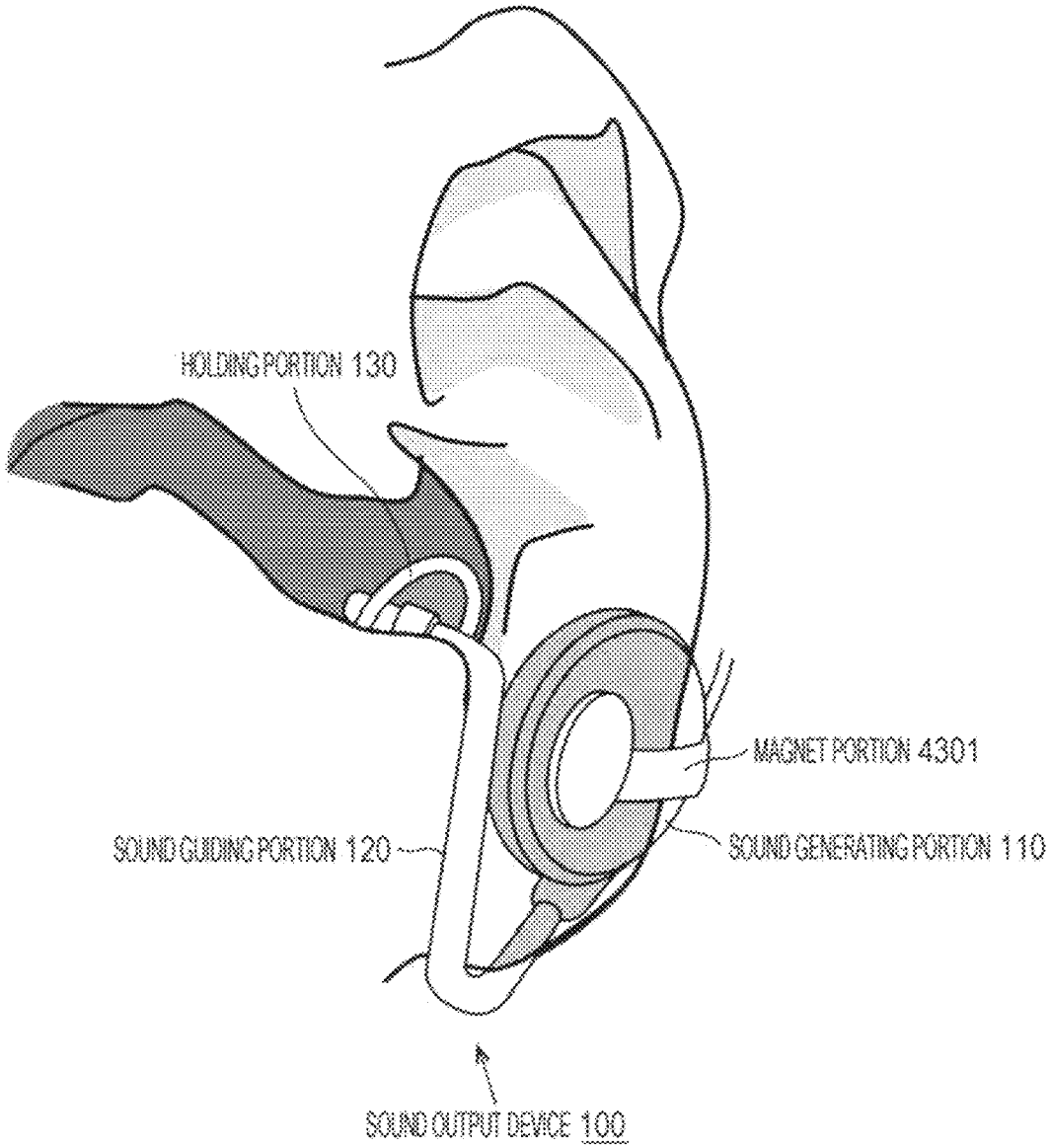
FIG. 43 is a diagram illustrating a configuration example of a mechanism to attach the sound generating portion 110 to the ear lobe.
Figure 44:
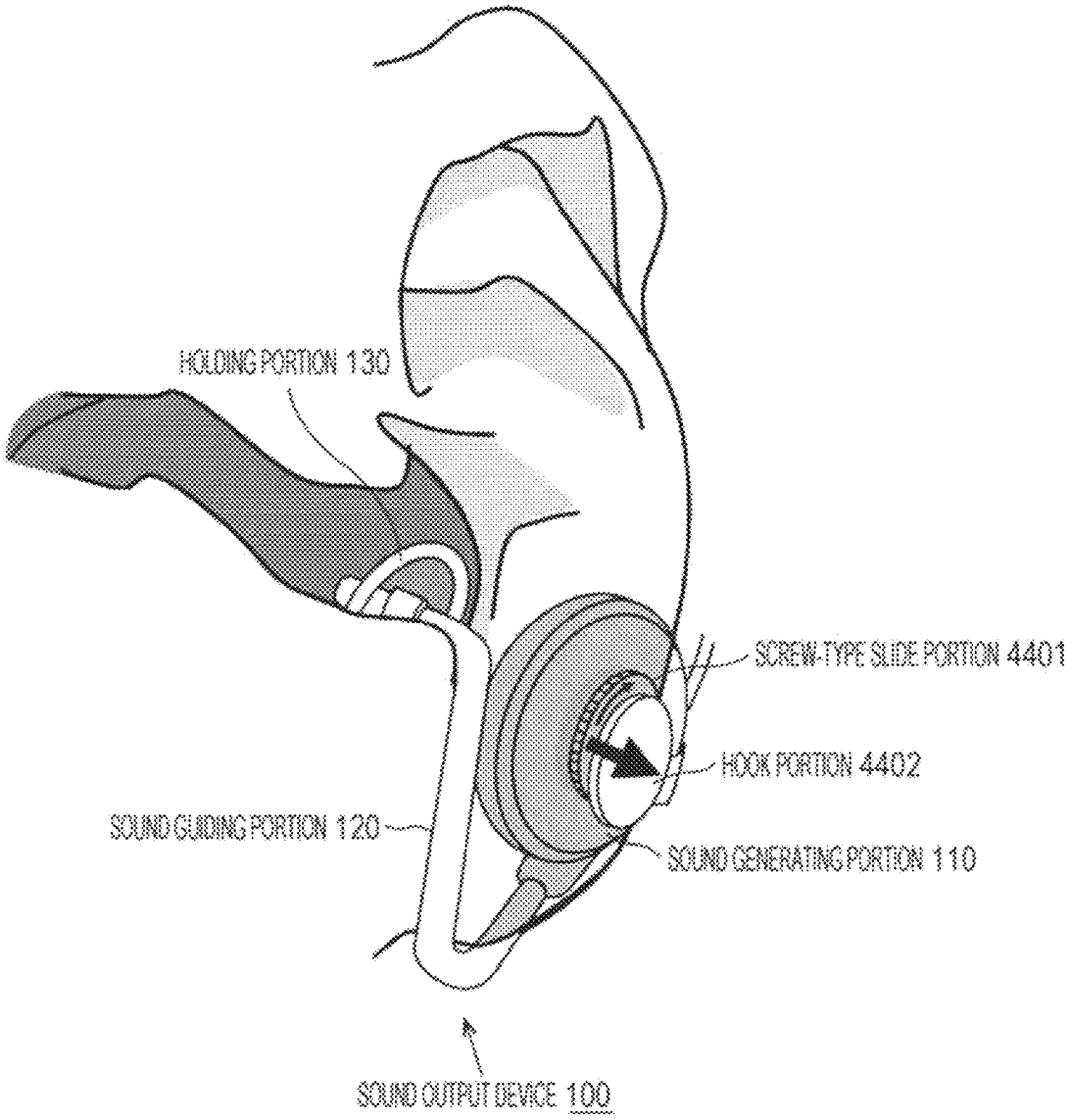
FIG. 44 is a diagram illustrating another configuration example of the mechanism to attach the sound generating portion 110 to the ear lobe.

FIGS. 43 and 44 respectively illustrate configuration examples of a pinch mechanism that pinches and fixes the ear lobe, using the housing of the sound generating portion 110.

In the example illustrated in FIG. 43, a magnet portion 4301 openable/closable to pinch the ear lobe is attached to the housing of the sound generating portion 110. Then, as illustrated in FIG. 43, when the sound generating portion 110 and the magnet portion 4301 are arranged to face each other through the ear lobe, the sound generating portion 110 is attracted by magnetic force of the magnet portion 4301, thereby to pinch the ear lobe, and as a result, the sound generating portion 110 is fixed to the back side of the ear lobe.

Further, in the example illustrated in FIG. 44, in the housing of the sound generating portion 110, a screw-type slide portion 4401 screwed in a place being in contact with the back of the ear lobe, and a hook portion 4402 arranged to face the screw-type slide portion 4401 are arranged. A gap between the screw-type slide portion 4401 and the hook portion 4402 can be adjusted by turning the screw-type slide 4401. Then, as illustrated in FIG. 44, the screw-type slide portion 4401 and the hook portion 4402 are arranged to face each other through the ear lobe, and when the gap between the screw-type slide portion 4401 and the hook portion 4402 is reduced by turning the screw-type slide 4401, the ear lobe can be pinched. As a result, the sound generating portion 110 is fixed to the back side of the ear lobe. Further, attachment/detachment can be performed by adjusting the gap between the screw-type slide portion 4401 and the hook portion 4402 by rotating the screw-type slide portion 4401.

[G. Deforming Portion]

As described with reference to FIGS. 1 and 2, the sound guiding portion 120 includes the deforming portion 124 between the other end 122 arranged in the vicinity of the entrance of the ear canal and the bent pinch portion 123. The deforming portion 124 is deformed when the external force acts, and keeps the other end 122 of the sound guiding portion 120 not to enter the depth of the ear canal more than necessary.

Figure 45:
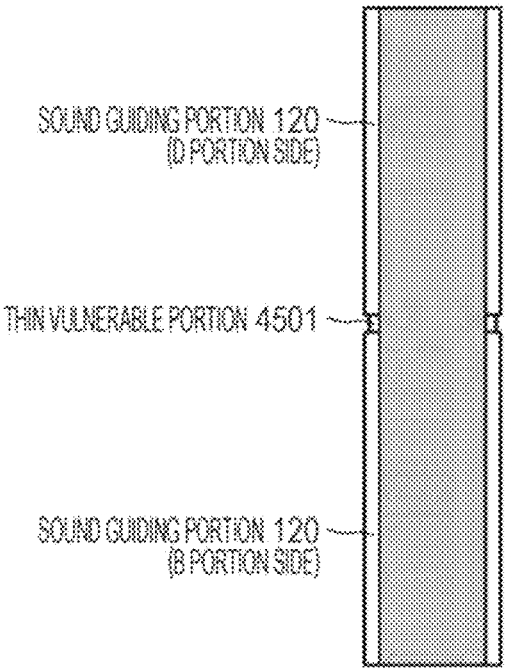
FIG. 45 is a diagram illustrating a configuration example of a deforming portion 124.
Figure 46:
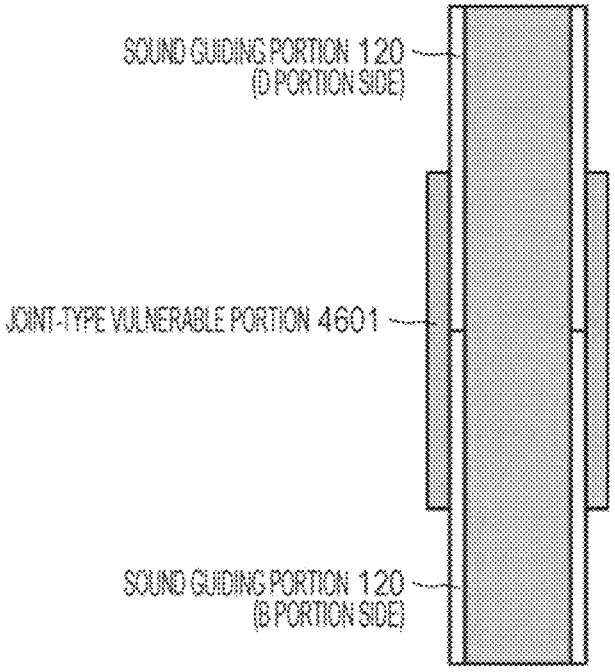
FIG. 46 is a diagram illustrating a configuration example of the deforming portion 124.
Figure 47:
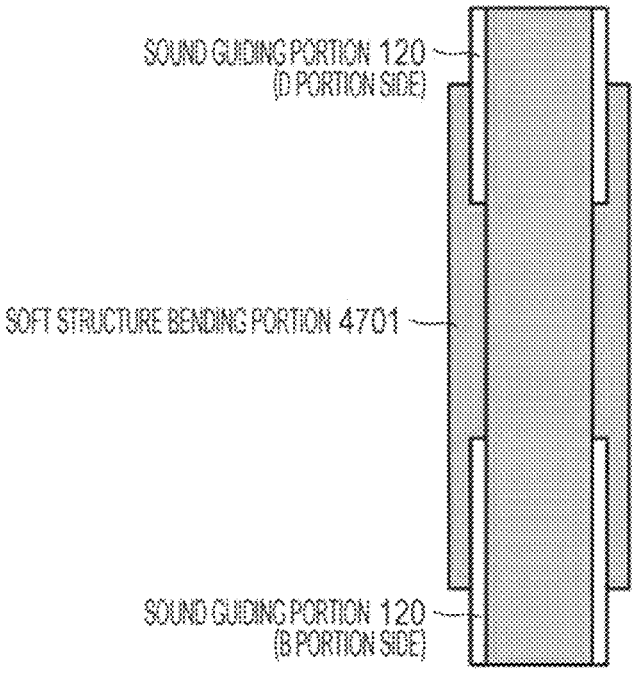
FIG. 47 is a diagram illustrating a configuration example of the deforming portion 124.

FIGS. 45 to 47 illustrate configuration examples of a cross section of a cut portion of the deforming portion 124 of the sound guiding portion 120, respectively. In any of the examples, the C portion of the sound guiding portion 120 is divided into two portions of a B portion side and a D portion side in a length direction, and these divided portions are connected in the deforming portion 124.

In any of the examples illustrated in FIGS. 45 to 47, the sound guiding portion 120 is pressed against the ear of the listener, and when excessive external force such as bending force acts on the C portion, the sound guiding portion 120 is bent and deformed. As a result of the sound guiding portion 120 being bent at the C portion, the other end 122 of the sound guiding portion 120, which is connected through the D portion bent at nearly a right angle, does not enter the depth of the ear canal.

In the example illustrated in FIG. 45, the divided C portions of the sound guiding portion 120 are connected at a thin vulnerable portion 4501 to configure the deforming portion 124. When predetermined external force or more force (bending force) is applied to the C portion, the sound guiding portion 120 is snapped at the thin vulnerable portion 4501. As a result, the external force is not transmitted to the other end 122 of the sound guiding portion 120, and thus does not enter the depth of the ear canal. Note that, when the thin vulnerable portion 4501 is snapped, it is difficult to connect the divided C portions again, and the sound guiding portion 120 needs to be replaced.

Further, in the example illustrated in FIG. 46, the divided C portions of the sound guiding portion 120 are connected at a joint-type vulnerable portion 4601 to configure the deforming portion 124. Similarly to the thin vulnerable portion 4501, the joint-type vulnerable portion 4601 is also formed of a vulnerable material. Therefore, when the predetermined external force or more force (bending force) is applied to the C portion, the sound guiding portion 120 is snapped at the joint-type vulnerable portion 4601. As a result, the external force is not transmitted to the other end 122 of the sound guiding portion 120, and thus does not enter the depth of the ear canal. Note that the joint-type vulnerable portion 4601 is different from the thin vulnerable portion 4501, and after snapped, the divided C portions can be reconnected, and the sound guiding portion 120 can be reused.

Further, in the example illustrated in FIG. 47, the divided C portions of the sound guiding portion 120 are connected at a soft structure bending portion 4701 to configure the deforming portion 124. The soft structure bending portion 4701 is different from the thin vulnerable portion 4501 and the joint-type vulnerable portion 4601. The soft structure bending portion 4701 has flexibility and is not snapped when bent, and generates restoring force to return to the original straight shape when bent. Therefore, the predetermined external force or more force (bending force) is applied to the C portion, the sound guiding portion 120 is bent at the soft structure bending portion 4701 once. As a result, the external force is not transmitted to the other end 122 of the sound guiding portion 120, and thus does not enter the depth of the ear canal. Further, when released from the external force, the C portion of the sound guiding portion 120 is automatically returned to the original shape by the restoring force of the soft structure bending portion 4701, and thus the sound guiding portion 120 can be reused.

[H. Earwax Intrusion Prevention]

The other end 122 of the sound guiding portion 120 is arranged in the vicinity of the entrance to face the depth side of the ear canal as a sound output hole. In the ear canal, dust in the air, remains of the skin, and the like are mixed with a secretion from a ceruminous ship, and earwax is accumulated. If the other end 122 of the sound guiding portion 120 comes in contact with the earwax and blocks the sound output hole, the sound quality is deteriorated. In addition, the earwax is filthy, and damage to the skin such as an inner wall of the ear canal is concerned.

Therefore, an earwax intrusion prevention portion maybe arranged to the other end 122 of the sound guiding portion 120. The earwax intrusion prevention portion may be integrally formed with the other end 122 of the sound guiding portion 120, or may be detachable from the other end 122. A removable-type earwax intrusion prevention portion can be detached and cleaned, and may be replaced when it becomes dirty.

Figure 48:
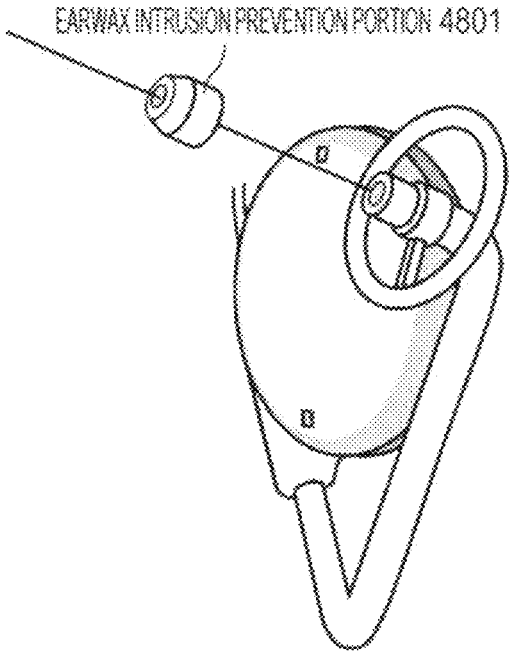
FIG. 48 is a diagram illustrating a state in which a removable-type earwax intrusion prevention portion 4801 is attached to the other end 122 of the sound guiding portion 120.
Figure 49:
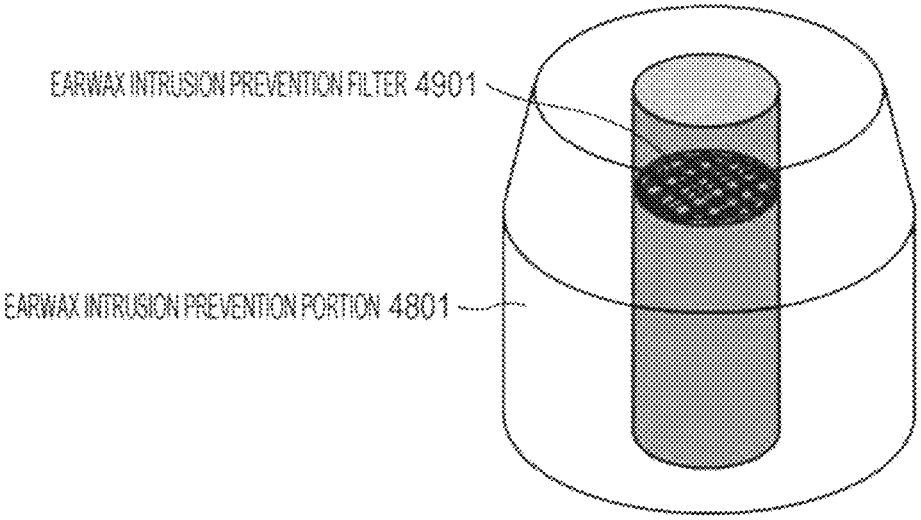
FIG. 49 is a diagram illustrating a configuration example of the earwax intrusion prevention 4801.

FIG. 48 illustrates a state in which a removable-type earwax intrusion prevention portion 4801 is attached to the other end 122 of the sound guiding portion 120. Further, FIG. 49 illustrates a configuration example of the earwax intrusion prevention 4801. The illustrated earwax intrusion prevention portion 4801 is a hollow structural body, and aerial vibration of the sound propagated in the tube of the sound guiding portion 120 passes through the hollow structural body as it is. Further, an earwax intrusion prevention filter 4901 that allows the aerial vibration to pass but does not allow the earwax to pass is installed inside the earwax intrusion prevention portion 4801.

[I. Sound Volume Adjustment Function]

The sound output device 100 according to the present embodiment has a configuration to propagate the aerial vibration of the sound generated in the sound generating portion 110 to the vicinity of the entrance of the ear canal with the sound guiding portion 120 having a hollow structure. Therefore, by controlling an inner diameter of a part of the sound guiding portion 120 as a passage of the aerial vibration, a sound volume adjustment function of the sound output from the other end 122 of the sound guiding portion 120 to the ear canal (or the sound heard by the eardrum) can be realized.

Figure 50:
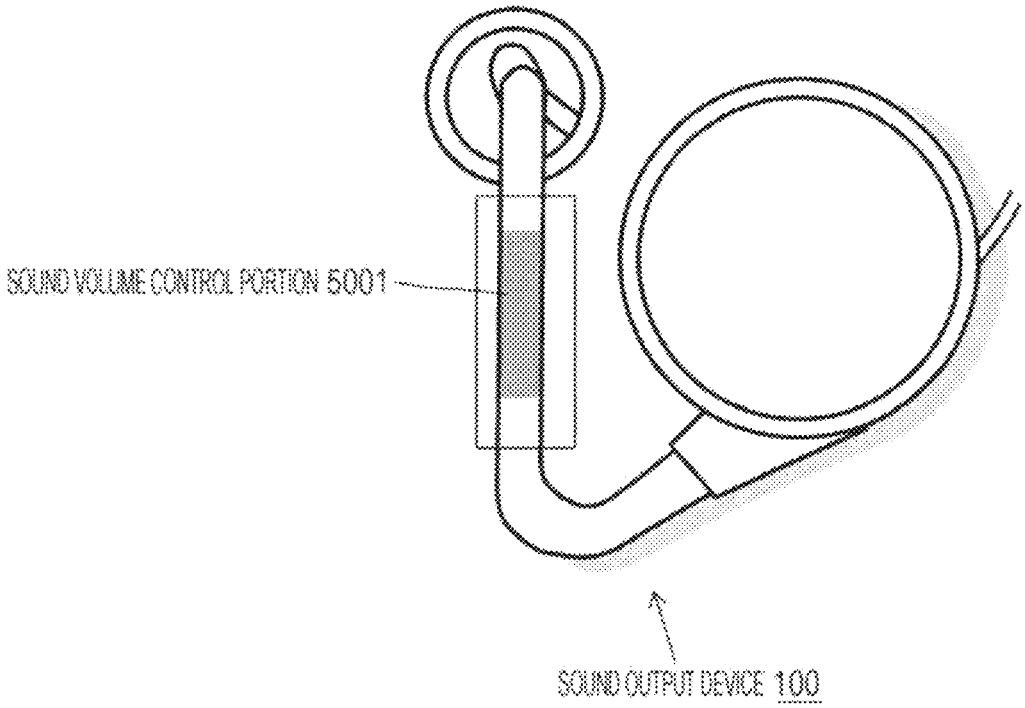
FIG. 50 is a diagram illustrating an appearance configuration of the sound output device 100 having a sound volume control portion 5000 provided in a C portion of the sound guiding portion 120.

For example, as illustrated in FIG. 50, a sound volume control portion 5000 is provided in the C portion of the sound guiding portion 120, the C portion being easily pinched with fingers by the listener who is wearing the sound output device 100, and the inner diameter of the sound guiding portion 120 in the vicinity of the sound volume control portion 5000 is changed according to a fingertip operation to the sound volume control portion 5000, whereby the sound volume adjustment is performed.

Figure 51:
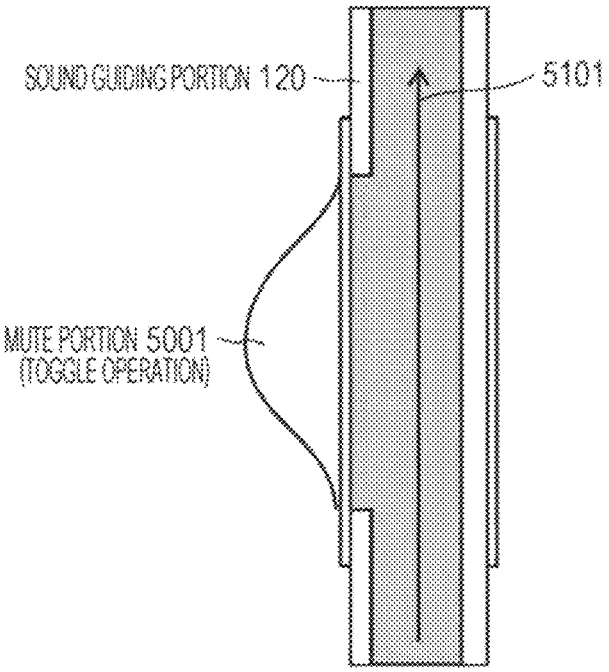
FIG. 51 is a diagram illustrating a sectional configuration example (mute-off state) of the sound volume control portion 5000 that realizes a mute function.
Figure 52:
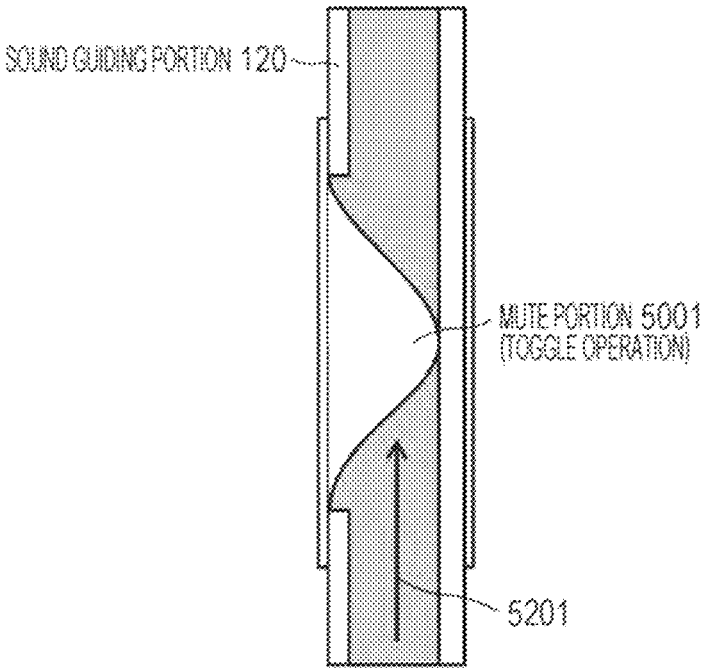
FIG. 52 is a diagram illustrating a sectional configuration example (mute-on state) of the sound volume control portion 5000 that realizes the mute function.
Figure 53:
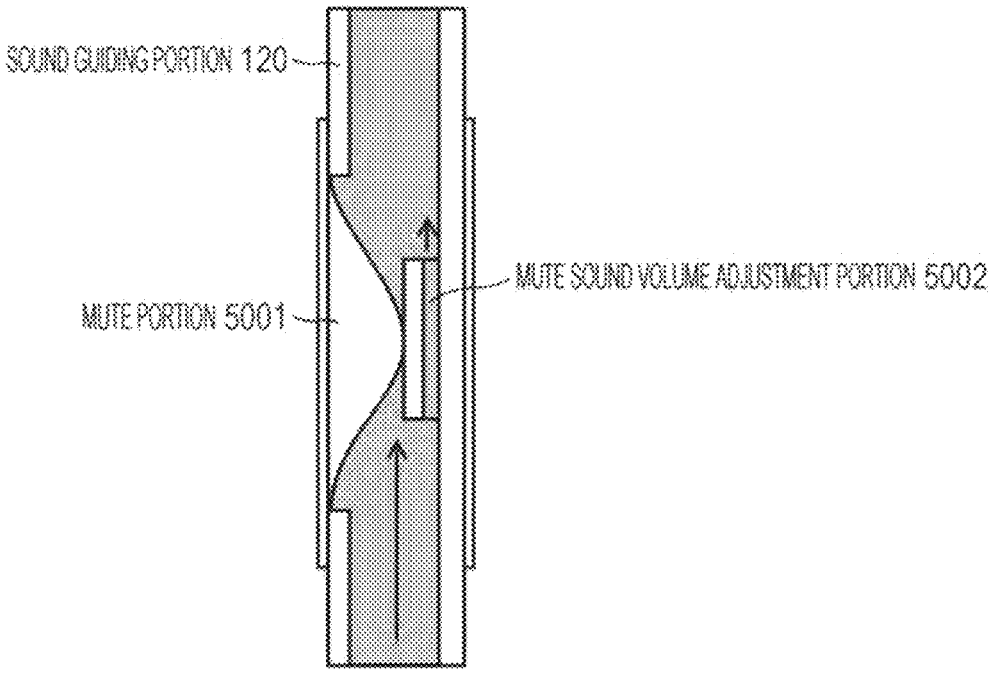
FIG. 53 is a diagram illustrating a sectional configuration example of the sound volume control portion 5000 (with a mute sound volume adjustment function) that realizes the mute function.

FIGS. 51 to 53 illustrate a sectional configuration example of the sound volume control portion 5000 that realizes a mute function and a series of mute operations. The sound volume control portion 5000 includes a mute portion 5001 emerging in the tube of the sound guiding portion 120. The mute portion 5001 performs a toggle operation in response to a pressing operation to a surface of the sound volume control portion 5000 with fingertips, and alternately switches appearing and disappearing in the tube of the sound guiding portion 120. To be specific, when the fingertip operation is made in a mute-off state, the mute portion 5001 appears in the tube of the sound guiding portion 120 and the mute-off state is switched to a mute-on state. Even if the fingers are released, the mute-on state is maintained. Further, when the fingertip operation is made again in the mute-on state, the mute portion 5001 disappears from the tube of the sound guiding portion 120 and the mute-on is cancelled, and the mute-off state is returned.

FIG. 51 illustrates the sound volume control portion 5000 in the mute-off state. In the mute-off state, the mute portion 5001 protrudes outside the sound guiding portion 120. Therefore, the inside of the sound guiding portion 120 is completely open, and thus the aerial vibration of the sound taken in from the sound generating portion 110 can proceeds toward the other end 122 of the sound guiding portion 120 without being disturbed, as illustrated by the reference number 5101.

Meanwhile, FIG. 52 illustrates the sound volume control portion 5000 in the mute-on state. In the mute-on state, the mute portion 5001 is depressed inside the sound guiding portion 120, and blocks the inside of the sound guiding portion 120 as a propagation path of the aerial vibration. Therefore, as illustrated by the reference number 5201, the aerial vibration of the sound taken in from the sound generating portion 110 is blocked by the mute portion 5001 depressed inside, and rarely reaches the other end 122 of the sound guiding portion 120. Even if the fingertips the fingertips are released from the mute portion 5001 in the mute-on state, the illustrated mute-off state is maintained. Further, when the mute portion 5001 is performed with the fingertips again in the mute-on state, the mute-on is cancelled and the mute-off state illustrated in FIG. 51 is returned.

Further, FIG. 53 illustrates a modification of the sound volume control portions 5000 illustrated in FIGS. 51 and 52. The sound volume control portion 5000 illustrated in FIG. 53 has a mute sound volume adjustment portion 5002 arranged in a wall surface facing the mute portion 5001 in the tube of the sound guiding portion 120. In the illustrated example, the mute portion 5001 depressed inside is in contact with the mute sound volume adjustment portion 5002 and blocks the propagation path of the aerial vibration, thereby to realize mute. Here, the mute sound volume adjustment portion 5002 is movable in the length direction along the inner wall surface of the sound guiding portion 120. Then, the degree of adhesion with the mute portion 5001 depressed inside, that is, the degree of prevention of the propagation path of the aerial vibration is changed according to the position of the mute sound volume adjustment portion 5002. Therefore, the sound volume to be mute can be adjusted.

Figure 54:
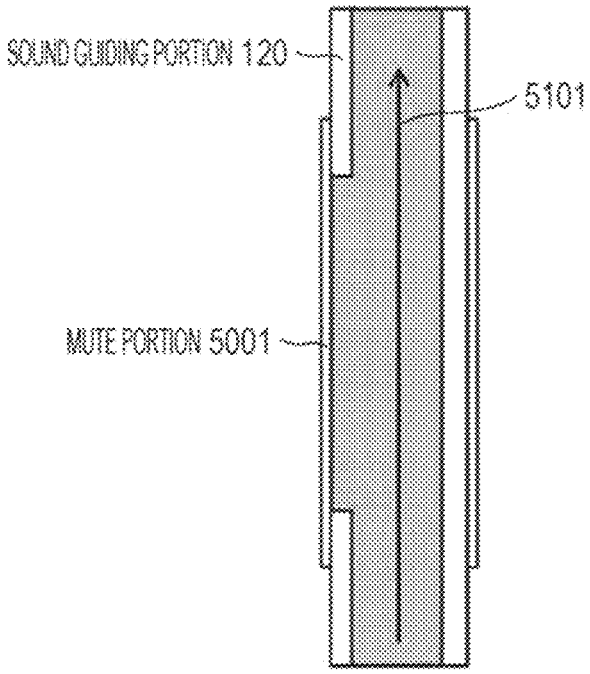
FIG. 54 is a diagram illustrating another sectional configuration example (mute-off state) of the sound volume control portion 5000 that realizes a mute function.
Figure 55:
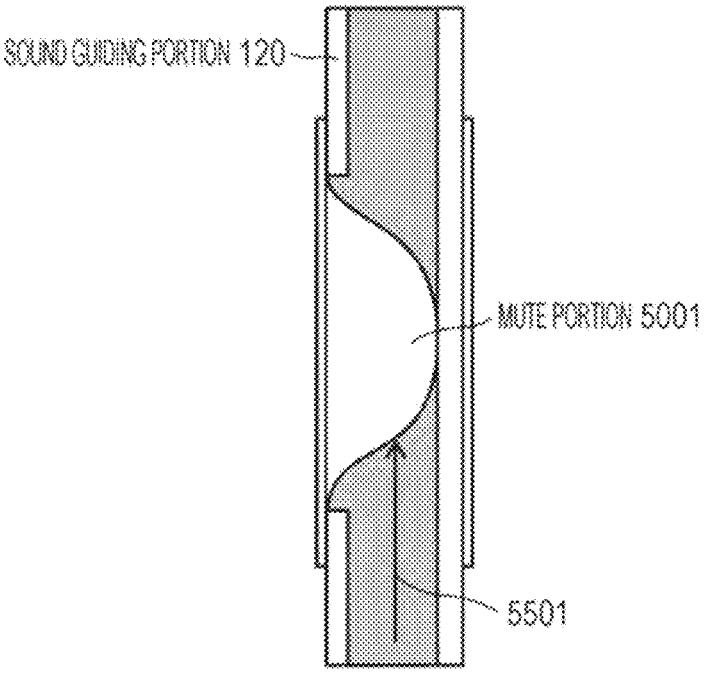
FIG. 55 is a diagram illustrating another sectional configuration example (mute-on state) of the sound volume control portion 5000 that realizes a mute function.
Figure 56:
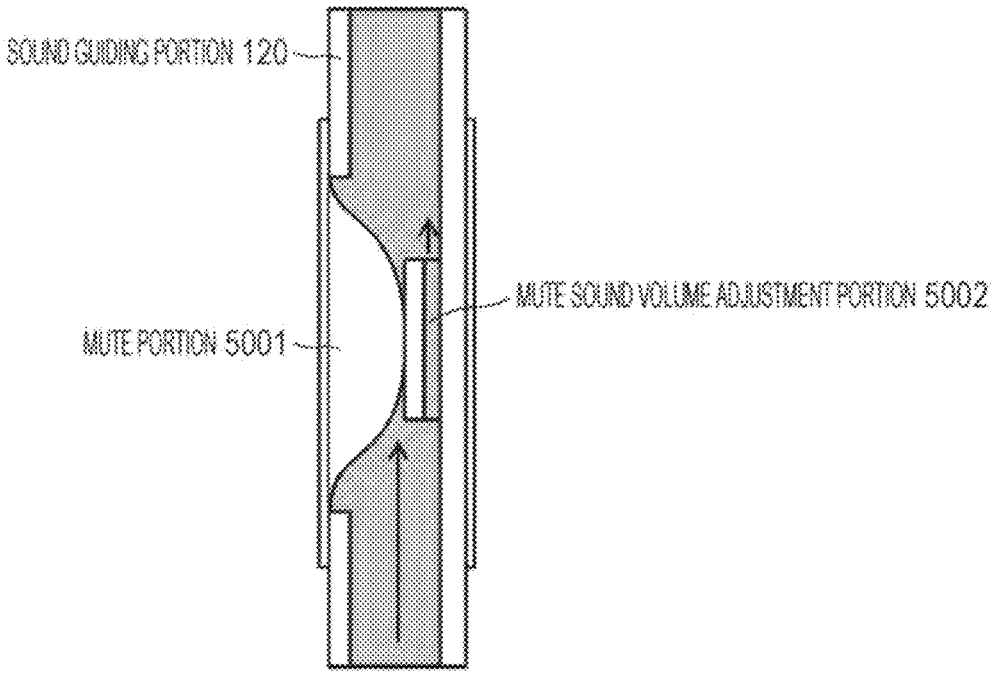
FIG. 56 is a diagram illustrating another sectional configuration example of the sound volume control portion 5000 (with the mute sound volume adjustment function) that realizes the mute function.

FIGS. 54 to 56 illustrate other sectional configuration examples of the sound volume control portion 5000 that realizes the mute function and a series of mute operations. The sound volume control portion 5000 includes the mute portion 5001 emerging in the tube of the sound guiding portion 120. However, the mute portion 5001 does not perform the toggle operation, unlike the examples illustrated in FIGS. 51 to 53. That is, the mute portion 5001 appears in the tube of the sound guiding portion 120 and becomes in the mute-on state only in the period of being pressed with fingertips or the like. However, if the fingertips are released, the mute portion 5001 immediately disappears from the tube of the sound guiding portion 120, and the mute-off state is returned.

FIG. 54 illustrates the sound volume control portion 5000 in the mute-off state. In the mute-off state, the mute portion 5001 has a flat shape, and disappears from the tube of the sound guiding portion 120. Therefore, the inside of the sound guiding portion 120 is completely open, and thus the aerial vibration of the sound taken in from the sound generating portion 110 can proceed toward the other end 122 of the sound guiding portion 120 without being disturbed, as illustrated by the reference number 5401.

Meanwhile, FIG. 55 illustrates the sound volume control portion 5000 in the mute-on state. In the mute-on state, the mute portion 5001 is elastically deformed when pressed with the fingertips or the like, protrudes to the inside of the sound guiding portion 120, and blocks the inside of the sound guiding portion 120 as the propagation path of the aerial vibration. Therefore, as illustrated by the reference number 5501, the aerial vibration of the sound taken in from the sound generating portion 110 is blocked by the mute portion 5001 depressed inside, and rarely reaches the other end 122 of the sound guiding portion 120. When the fingertips the fingertips are released from the mute portion 5001 and the mute portion 5001 is released from pressing in the mute-on state, the elastic deformation of the mute portion 5001 is cancelled, and the mute-off state illustrated in FIG. 54 is returned.

Further, FIG. 56 illustrates a modification of the sound volume control portions 5000 illustrated in FIGS. 54 to 55. The sound volume control portion 5000 illustrated in FIG. 56 has a mute sound volume adjustment portion 5002 arranged in a wall surface facing the mute portion 5001 in the tube of the sound guiding portion 120. In the illustrated example, the mute portion 5001 depressed inside is in contact with the mute sound volume adjustment portion 5002 and blocks the propagation path of the aerial vibration, thereby to realize mute. Here, the mute sound volume adjustment portion 5002 is movable in the length direction along the inner wall surface of the sound guiding portion 120. Then, the degree of adhesion with the mute portion 5001 depressed inside, that is, the degree of prevention of the propagation path of the aerial vibration is changed according to the position of the mute sound volume adjustment portion 5002. Therefore, the sound volume to be mute can be adjusted.

Figure 57:
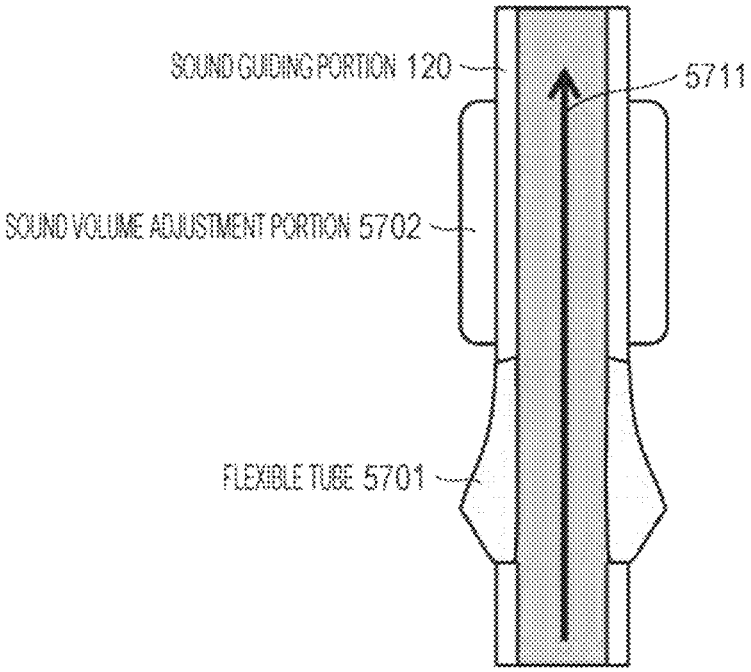
FIG. 57 is a diagram illustrating a sectional configuration example of the sound volume control portion 5000 that realizes continuous sound volume adjustment by continuously changing an inner diameter of the sound guiding portion 120.
Figure 58:
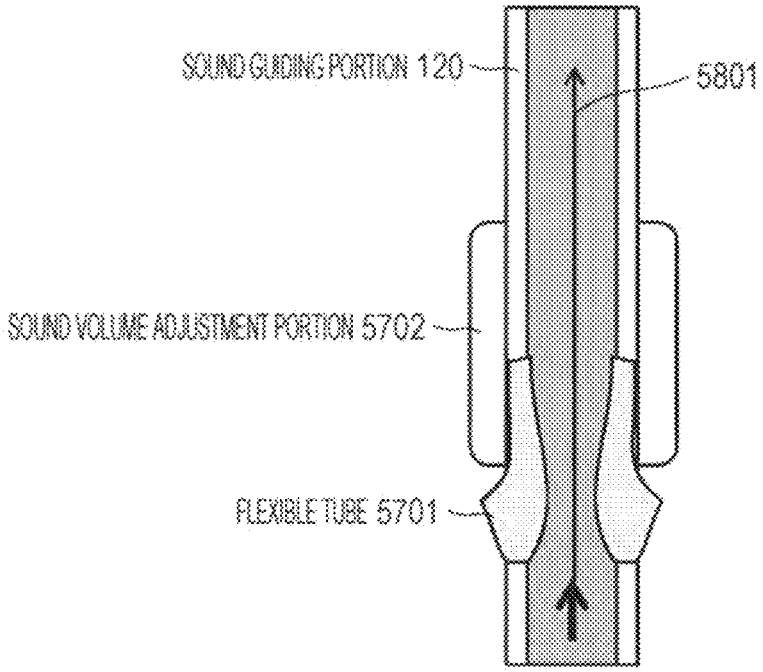
FIG. 58 is a diagram illustrating a sectional configuration example of the sound volume control portion 5000 that realizes continuous sound volume adjustment by continuously changing the inner diameter of the sound guiding portion 120.
Figure 59:
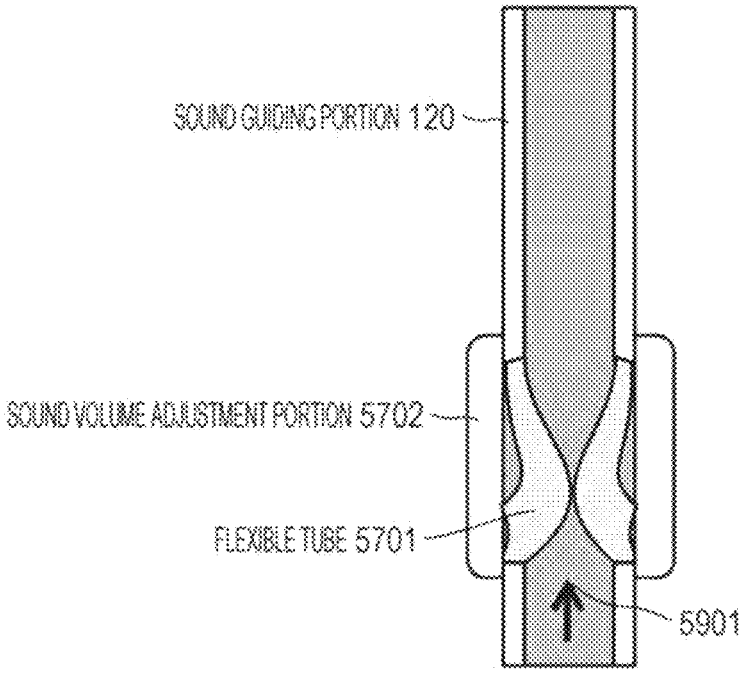
FIG. 59 is a diagram illustrating a sectional configuration example of the sound volume control portion 5000 that realizes continuous sound volume adjustment by continuously changing the inner diameter of the sound guiding portion 120.

FIGS. 57 to 59 illustrate sectional configuration examples of the sound volume control portion 5000 that realizes continuous sound volume adjustment (not mute) by continuously changing the inner diameter of the sound guiding portion 120, and a series of sound volume adjustment operations. The sound volume control portion 5000 is configured from a flexible tube 5701 inserted into the C portion of the sound guiding portion 120, and a ring-like sound volume adjustment portion 5702 into which the flexible tube 5701 is inserted. An outer periphery of the flexible tube 5701 has a tapered structure in which a tip end faces the sound volume adjustment portion 5702, and an outer diameter becomes larger as being away from the sound volume adjustment portion 5702. Meanwhile, an inner diameter of the sound volume adjustment portion 5702 is larger than a tip end portion but is smaller than a rear end portion, of the flexible tube 5701 having the tapered structure. The inner diameter of the sound volume adjustment portion 5702 may be constant in the length direction, or the sound volume adjustment portion 5702 may have a tarped shape with a gentler incline than the outer periphery of the flexible tube 5701.

The sound volume adjustment portion 5702 can be moved in a longitudinal direction of the flexible tube 5701. The flexible tube 5701 is narrowed down as the flexible tube 5701 is accommodated in the ring-like sound volume adjustment portion 5702. As a result, the flexible tube 5701 is compressed and becomes narrow in a radial direction. That is, in the example illustrated in FIGS. 57 to 59, the flexible tube 5701 is narrowed down and the inner diameter is continuously changed by changing the position of the ring-like sound volume adjustment portion 5702 in the longitudinal direction.

In the state illustrated in FIG. 57, the flexible tube 5701 is completely separated from the sound volume adjustment portion 5702. Therefore, the flexible tube 5701 has the initial inner diameter, and does not block the aerial vibration of the sound taken in from the sound generating portion 110, and the aerial vibration can propagate toward the other end 122 of the sound guiding portion 120, as illustrated in the reference number 5711.

In the state illustrated in FIG. 58, about half of the flexible tube 5701 is accommodated in the sound volume adjustment portion 5702. As a result, the flexible tube 5701 is compressed in the radial direction and is narrower than the initial inner diameter. Therefore, as illustrated by the reference number 5801, the aerial vibration of the sound taken in from the sound generating portion 110 is attenuated according to the degree of compression of the flexible tube 5701. Therefore, the sound volume of the sound radiated from the other end 122 and reaching the eardrum of the listener is decreased. It should be well understood that the sound volume is continuously decreased according to the operation to insert the flexible tube 5701 into the sound volume adjustment portion 5702.

In the state illustrated in FIG. 59, the flexible tube 5701 is completely accommodated in the sound volume adjustment portion 5702, and thus the propagation path of the aerial vibration is completely blocked. Therefore, as illustrated by the reference number 5901, the aerial vibration of the sound taken in from the sound generating portion 110 is blocked at the place where the flexible tube 5701 is squashed, and rarely reaches the other end 122 of the sound guiding portion 120. Therefore, the sound volume is 0.

Figure 60:
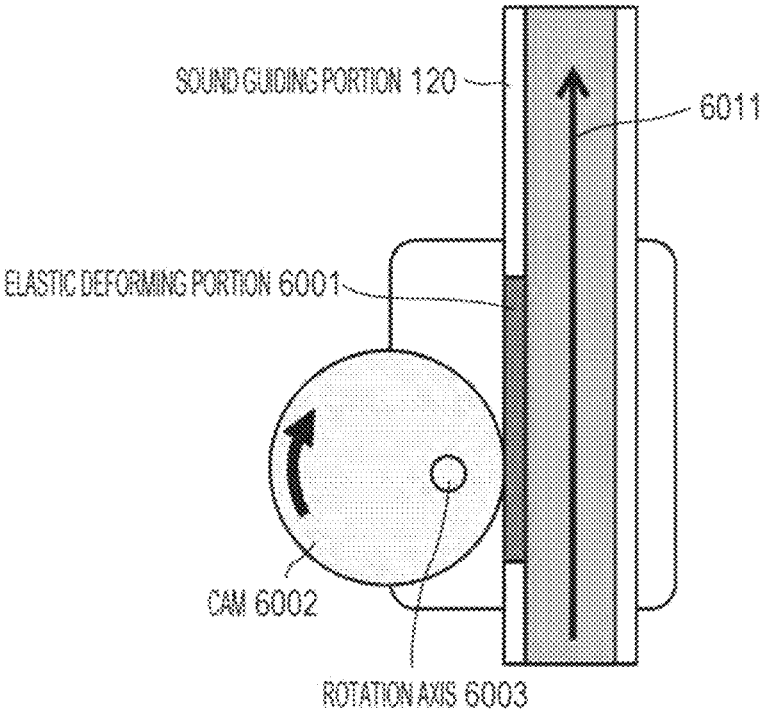
FIG. 60 is a diagram illustrating another sectional configuration example of the sound volume control portion 5000 that realizes continuous sound volume adjustment by continuously changing the inner diameter of the sound guiding portion 120.
Figure 61:
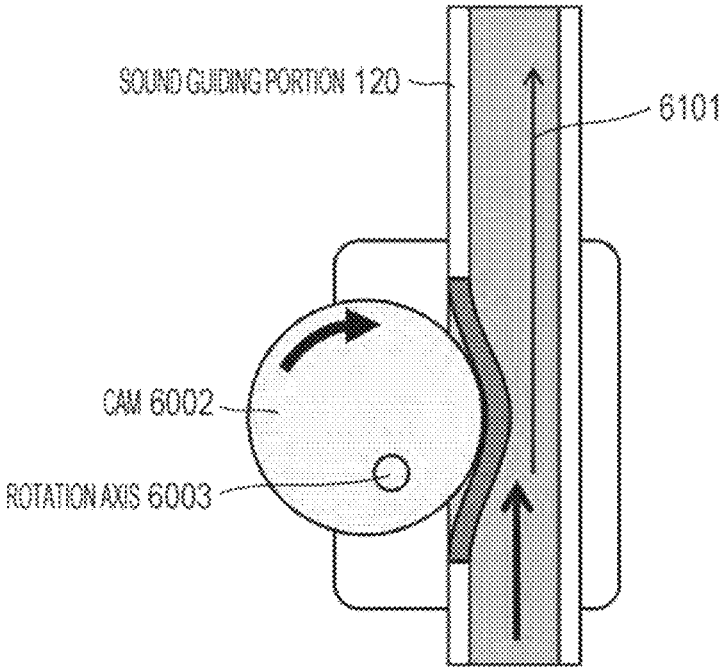
FIG. 61 is a diagram illustrating another sectional configuration example of the sound volume control portion 5000 that realizes continuous sound volume adjustment by continuously changing the inner diameter of the sound guiding portion 120.
Figure 62:
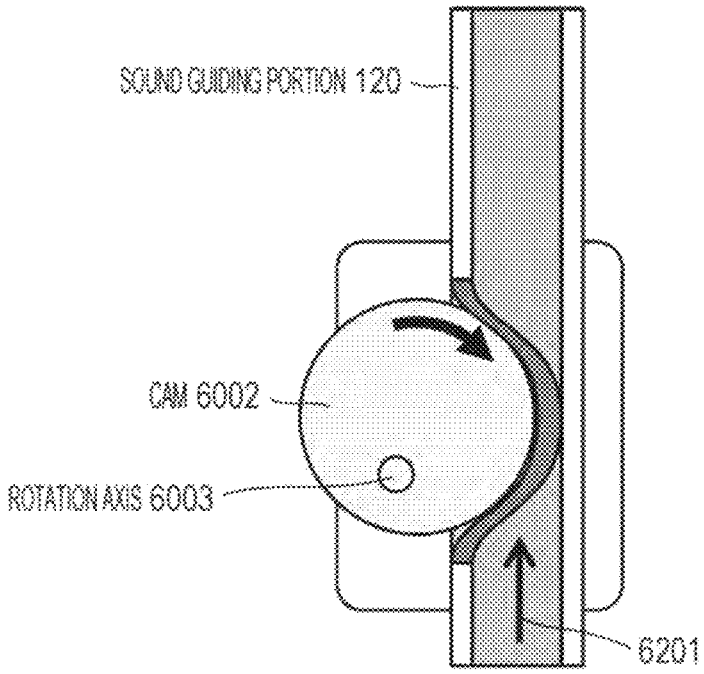
FIG. 62 is a diagram illustrating another sectional configuration example of the sound volume control portion 5000 that realizes continuous sound volume adjustment by continuously changing the inner diameter of the sound guiding portion 120.

FIGS. 60 to 62 illustrate another sectional configuration example of the sound volume control portion 5000 that realizes continuous sound volume adjustment by continuously changing the inner diameter of the sound guiding portion 120, and a series of sound volume adjustment operations. The sound volume control portion 5000 is configured from an elastic deforming portion 6001 that configures a part of a side surface of the sound guiding portion 120 in the C portion, and a cam 6002 rotatable around a rotation axis 6003 and arranged to come in contact with the elastic deforming portion 6001. The cam 6002 may be a disk plate but the rotation axis 6003 is eccentric, and thus the distance to the circumference is not constant. The degree of protrusion of the elastic deforming portion 6001 to the tube of the sound guiding portion 120 is changed according to a rotation angle.

In the state illustrated in FIG. 60, the cam 6002 is in contact with the elastic deforming portion 6001 in a rotation position where the distance from the rotation axis 6003 is shortest. Therefore, the elastic deforming portion 6001 has the initial shape, and does not block the aerial vibration of the sound taken in from the sound generating portion 110, and the aerial vibration can proceed toward the other end 122 of the sound guiding portion 120, as illustrated by the reference number 6011.

In the state illustrated in FIG. 61, the cam 6002 is in contact with the elastic deforming portion 6001 in a rotation position where the distance from the rotation axis 6003 is longer than that of the state illustrated in FIG. 60. Therefore, the elastic deforming portion 6001 is elastically deformed, and slightly protrudes to an inside of the sound guiding portion 120 and slightly blocks the inside of the sound guiding portion 120 as the propagation path of the aerial vibration. In such a case, as illustrated by the reference number 6101, the aerial vibration of the sound taken in from the sound generating portion 110 is attenuated according to the degree of blocking of the propagation path by the protruding elastic deforming portion 6001. As a result, the sound volume of the sound radiated from the other end 122 and reaching the eardrum of the listener is decreased. It should be well understood that the sound volume is continuously decreased according to the degree of blocking of the propagation path by the elastic deforming portion 6001, in other words, the rotation of the cam 6002.

In the state illustrated in FIG. 62, the cam 6002 is in contact with the elastic deforming portion 6001 in a rotation position where the distance from the rotation axis 6003 is longest. Therefore, the elastic deforming portion 6001 is elastically deformed and protrudes to the inside of the sound guiding portion 120 in a large manner, and completely blocks the inside of the sound guiding portion 120 as the propagation path of the aerial vibration. Therefore, as illustrated in the reference number 6201, the aerial vibration of the sound taken in from the sound generating portion 110 rarely reaches the other end 122 of the sound guiding portion 120, and the sound volume is 0.

[J. Audio Signal Processing]

As described with reference to FIG. 11, a dynamic-type speaker can be applied to the sound generating portion 110. That is, the inside of the sound generating portion 110 is divided into the diaphragm front space (front cavity) 1102 and the diaphragm back space (back cavity) 1103 by the diaphragm 1101. Then, when the magnetic field is changed according to the audio signal input to the voice coil 1105 through the cord 602, the diaphragm 198 is operated back and forth by magnetic force of the magnet 1104, and change of the pressure between the diaphragm front space 1102 and the diaphragm back space 1103, and this change of the pressure becomes the sound.

Examples of the sound production element for sound generation include balanced armature-type and condenser-type speakers, other than the dynamic-type speaker. However, the applicant of the present application thinks that the dynamic-type speaker is favorable for the sound generating portion 110 to sufficiently drive the sound guiding portion 120 in a pipe structure having a bent shape folded back from the back side to the front side of the pinna.

Figure 63:
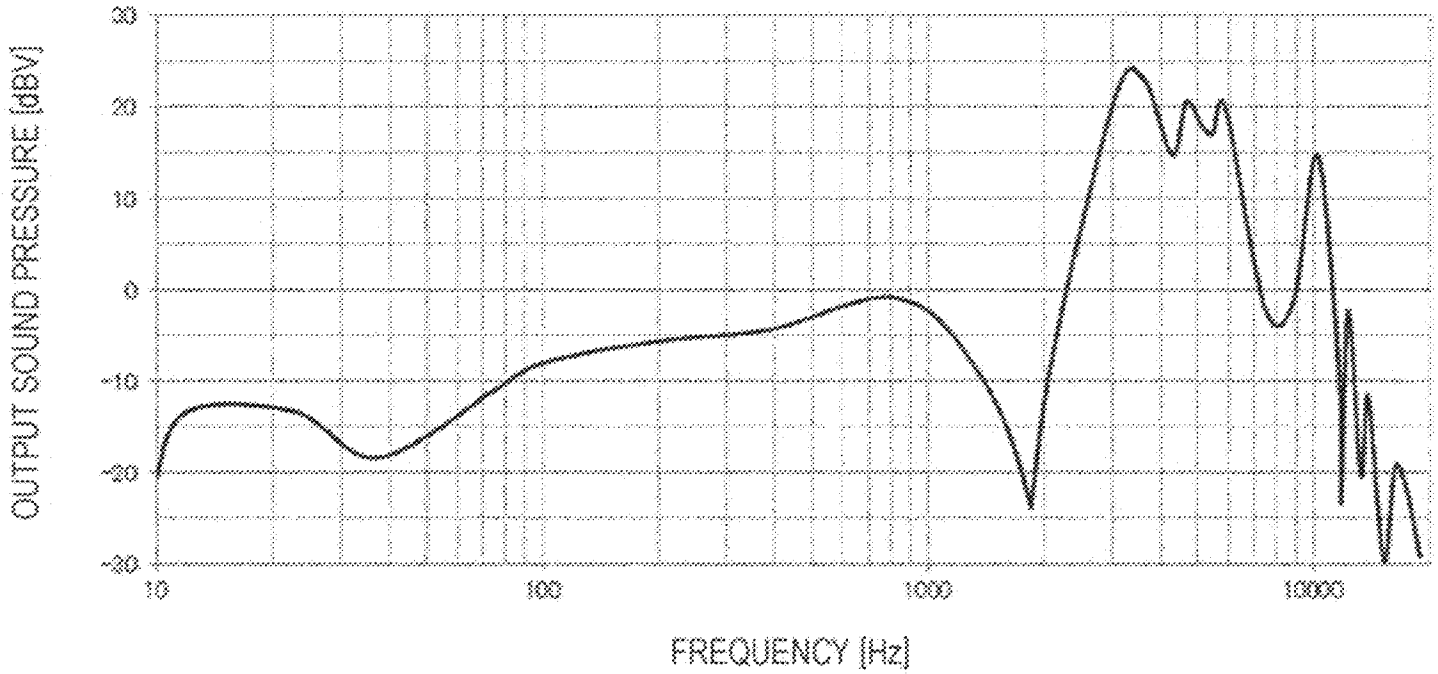
FIG. 63 is a diagram exemplarily illustrating sound characteristics of the sound output device 100 in a case where the sound generating portion 110 is configured from a dynamic-type speaker.

FIG. 63 exemplarily illustrates a sound characteristic (frequency level characteristic) at the other end 1220 of the sound guiding portion 120 in a case where the sound generating portion 110 is configured from the dynamic-type speaker. The horizontal axis of FIG. 63 represents a frequency level [Hz] and the vertical axis represents output sound pressure [dBV]. From FIG. 63, it can be confirmed that there is a good response in the low frequency range of 100 Hz or less, which is important to listen to music, and there is also a response in the audible range near 20 kHz.

There is a problem that the sound propagated in the sound guiding portion 120 that is, a pipe is weak in the low frequency range. Therefore, resonance of one-side open by the sound guiding portion 110 and attenuation in the low frequency range may by corrected by signal processing.

Figure 64:
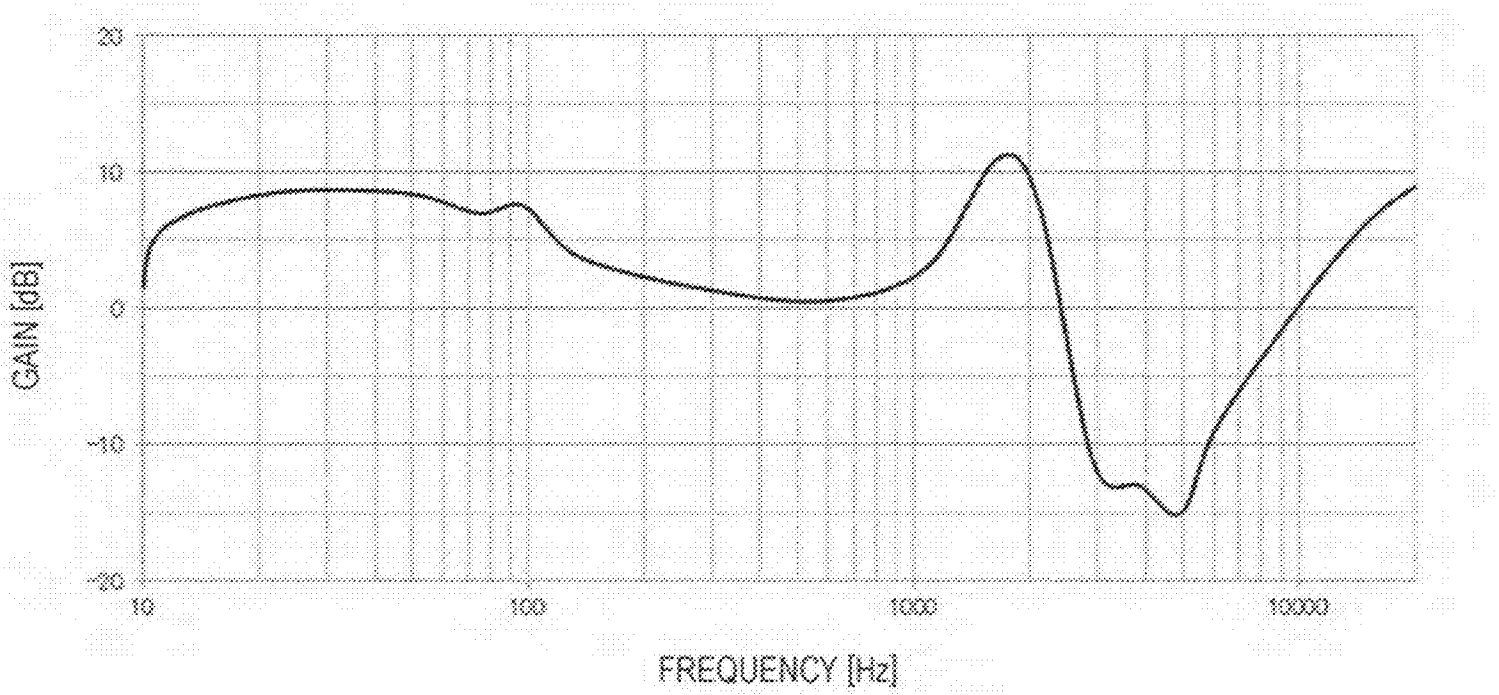
FIG. 64 is a diagram exemplarily illustrating frequency characteristics of signal processing applied to an input signal to the sound output device 100.
Figure 65:
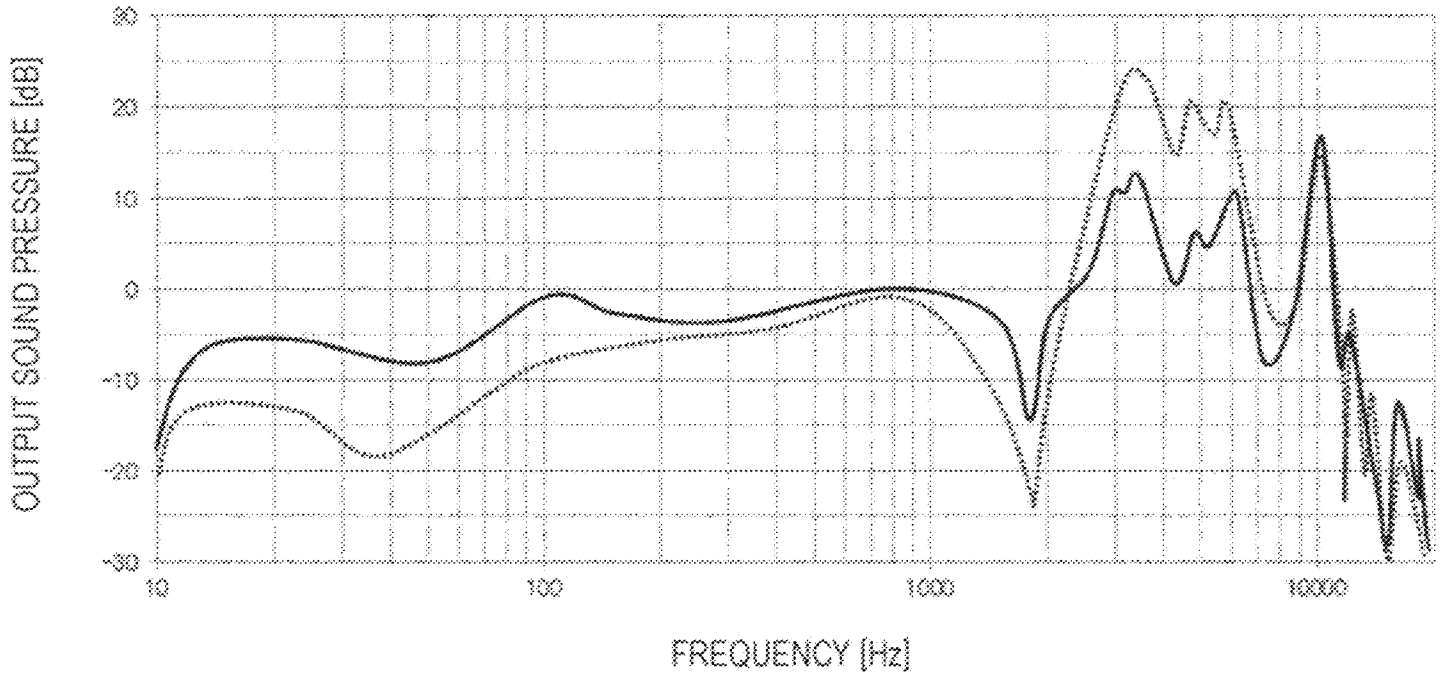
FIG. 65 is a diagram exemplarily illustrating sound characteristics (frequency level characteristics) of the sound output device 100, which are improved by the signal processing illustrated in FIG. 64.

For example, in a case where signal processing (an equalizer) of the frequency characteristic as illustrated in FIG. 64 is applied to the audio signal input to the sound generating portion 110, the sound characteristic (frequency level characteristic) of the sound output device 100 can be improved as illustrated in FIG. 65. Note that, in FIG. 65, the frequency level characteristic improved by the signal processing is illustrated by the solid line, and the frequency level characteristic before improvement (illustrated in FIG. 63) is illustrated by the dotted line, as a comparison. Compared with the characteristic before the improvement, it is known that, while the low frequency range is improved by the signal processing, a wide frequency range is suppressed and the output sound pressure becomes flattened throughout the wide frequency range. Such signal processing can be performed inside the sound output device 100. However, the audio signal after the signal processing is performed outside may be input to the sound output device 100.

Figure 66:
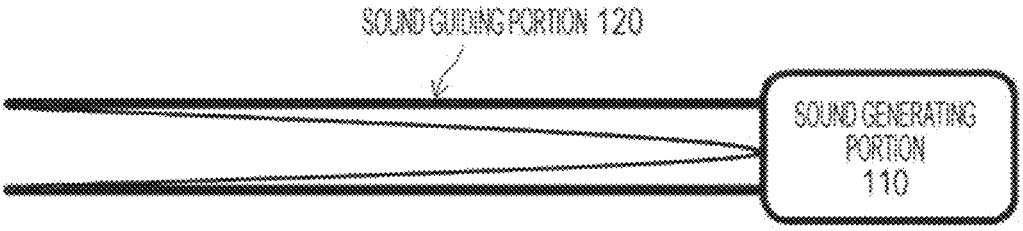
FIG. 66 is a diagram exemplarily illustrating resonance action (¼ wavelength resonance) of one-side open by the sound guiding portion 110.
Figure 67:
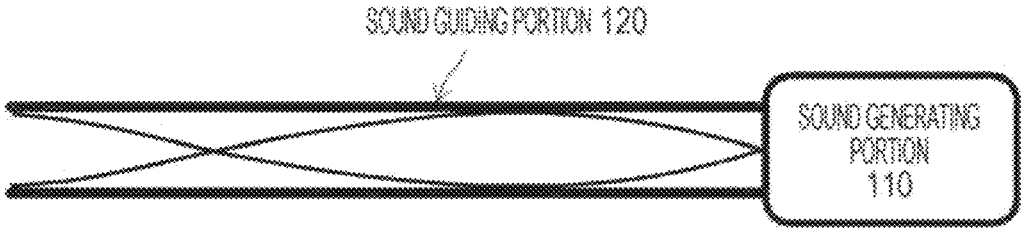
FIG. 67 is a diagram exemplarily illustrating resonance action (1+¼ wavelength resonance) of one-side open by the sound guiding portion 110.
Figure 68:
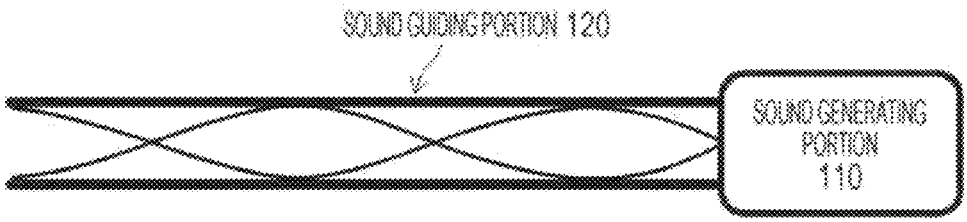
FIG. 68 is a diagram exemplarily illustrating resonance action (2+¼ wavelength resonance) of one-side open by the sound guiding portion 110.

Further, FIGS. 66 to 68 exemplarily illustrate resonance action of the one-side open by the sound guiding portion 110. FIG. 66 illustrates a state in which the sound of a frequency component, in which the entire length of the sound guiding portion 120 with one-side open corresponds to a ¼ wavelength, resonates and a standing wave appears. Further, FIG. 67 illustrates a state in which the sound of a frequency component, in which the entire length of the sound guiding portion 120 corresponds to a 1+¼ wavelength, resonates and a standing wave appears. Further, FIG. 68 illustrates a state in which the sound of a frequency component, in which the entire length of the sound guiding portion 120 corresponds to a 2+¼ wavelength, resonates and a standing wave appears. Then, FIG. 69 exemplarily illustrates the sound characteristic (frequency level characteristic) in the other end 1220 of the sound guiding portion 120 affected by the resonance action of the one-side open. In this case, the sound characteristic includes a peak characteristic of the sound pressure frequency due to the resonance. That is, peaks of the sound pressure frequency due to the resonance appear near the frequencies in which the length of the sound guiding portion 120 corresponds to the ¼ wavelength, the 1+¼ wavelength, and the 2+¼ wavelength, respectively.

Figure 69:
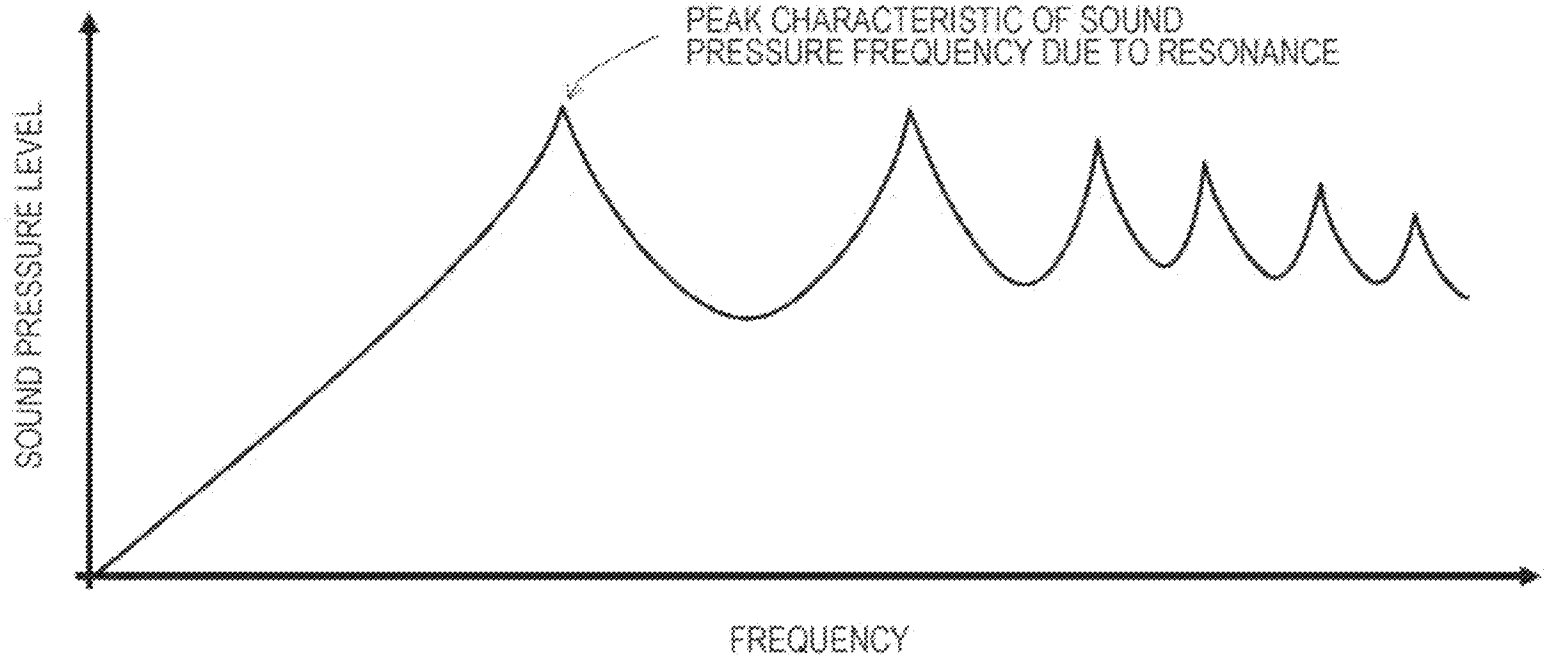
FIG. 69 is a diagram exemplarily illustrating sound characteristics (frequency level characteristics) of the sound guiding portion 120 affected by the resonance action of one-side open.

As illustrated in FIG. 69, appearing of the peak of the sound pressure level appears only in the specific frequency component is led to deterioration of sound quality. It is favorable to uniform the peaks of the sound pressure level throughout a wide range of frequency regions, and therefore the peaks need to be flattened.

Figure 70:
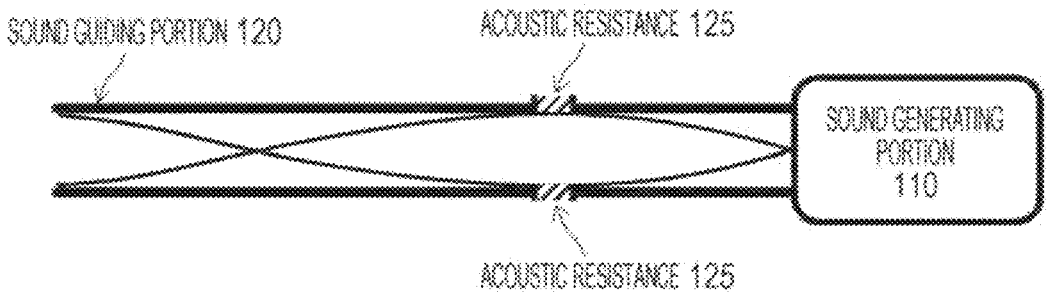
FIG. 70 is a diagram illustrating a configuration example of the sound guiding portion 120 that suppresses peak characteristics of a sound pressure frequency by the resonance.
Figure 71:
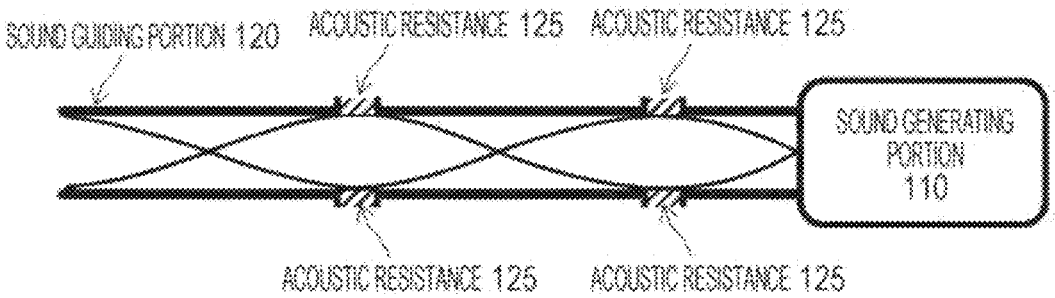
FIG. 71 is a diagram illustrating a configuration example of the sound guiding portion 120 that suppresses peak characteristics of a sound pressure frequency by the resonance.

FIGS. 70 and 71 illustrate configuration examples of the sound guiding portion 120 that suppresses the peak characteristic of the sound pressure frequency due to resonance, respectively. In the sound guiding portion 120 illustrated in FIGS. 70 and 71, acoustic elements (acoustic resistances) that suppress the resonance action are respectively arranged in positions corresponding to antinodes where the amplitude of the standing wave generated by the resonance action of one-side open by the sound guiding portion 110 is maximized. To be specific, in the sound guiding portion 120 illustrated in FIG. 70, acoustic elements 125 are arranged on wall surfaces corresponding to antinodes of the standing wave of the sound made of a frequency component in which the entire length of the sound guiding portion 120 corresponds to the 1+¼ wavelength. Further, in the sound guiding portion 120 illustrated in FIG. 71, the acoustic elements 125 are arranged on wall surfaces corresponding to antinodes of the standing wave of the sound made of a frequency component in which the entire length of the sound guiding portion 120 corresponds to the 2+¼ wavelength. As general expression, it can be expressed that the acoustic elements 125 are arranged on wall surfaces corresponding to antinodes of the standing wave of the sound made of a frequency component corresponding to an N+¼ wavelength (note that N is an integer of 1 or more).

Figure 72:
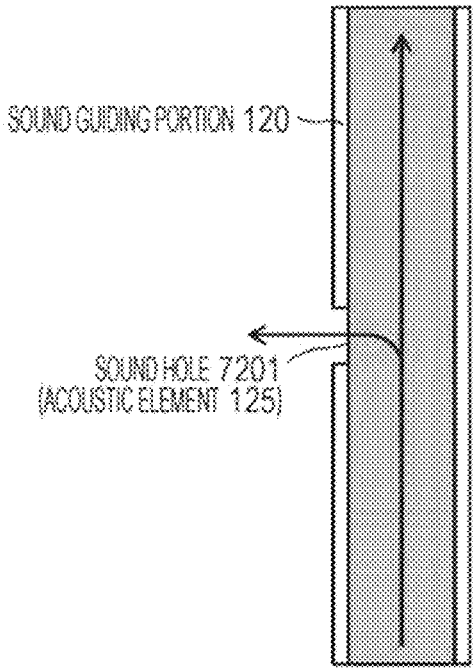
FIG. 72 is a diagram illustrating a configuration example of an acoustic element made of a sound hole 7201.

FIG. 72 illustrates an example of the enlarged acoustic element 125. The illustrated acoustic element 125 is configured from fine sound hole drilled in the wall surface of the sound guiding portion 120. As illustrated in FIG. 72, a sound hole 7201 attenuates the standing wave proceeding in the sound guiding pipe 120 by discharging the standing wave to an outside of the sound guiding portion 120, thereby to adjust the frequency level characteristic of the resonance component. The acoustic element 125 can realize different effects depending on the diameter, the length, and the like of the sound hole 7201.

Figure 73:
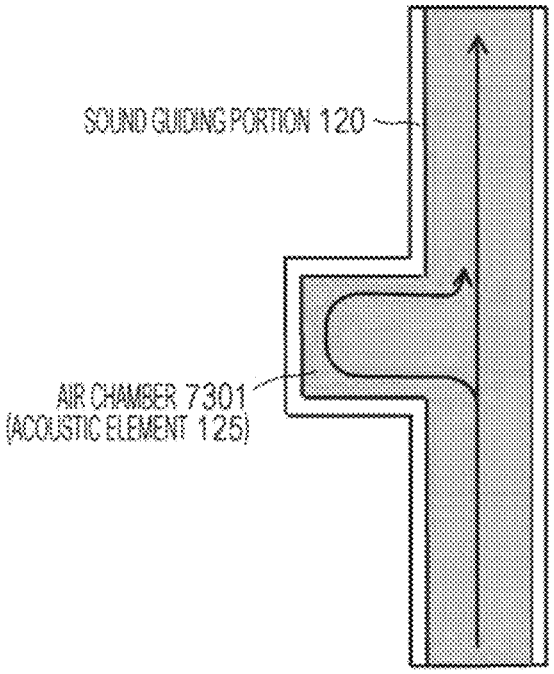
FIG. 73 is a diagram illustrating a configuration example of the acoustic element made of an air chamber 7301.

Further, FIG. 73 illustrates another example of the enlarged acoustic element 125. The illustrated acoustic element 125 is configured from an air chamber 7301 provided in a depressed manner in the wall surface of the sound guiding portion 120. As illustrated in FIG. 73, the air chamber 7301 attenuates the standing wave proceeding in the sound guiding pipe 120 by allowing the standing wave to go around into the air chamber 7301, thereby to adjust the frequency level characteristic of the resonance component. The acoustic element 125 can realize different effects depending on the volume, the shape, and the like of the air chamber 7301.

Note that if the acoustic element 125 is configured from only the sound hole or the air chamber, a standing wave component may be leaked through the sound hole, or goes around into the air chamber and maybe excessively attenuated. Therefore, for the acoustic element 125, it is more favorable to fill acoustic resistance in the sound hole or adjust attenuation of the standing wave component. The acoustic resistance is a member having larger resistance than the air when the sound waves pass through, and the resistance is increased as the filling density of the acoustic resistance is made larger. The acoustic resistance is configured from, for example, non-woven fabric or expanded foam such as urethane.

Figure 74:
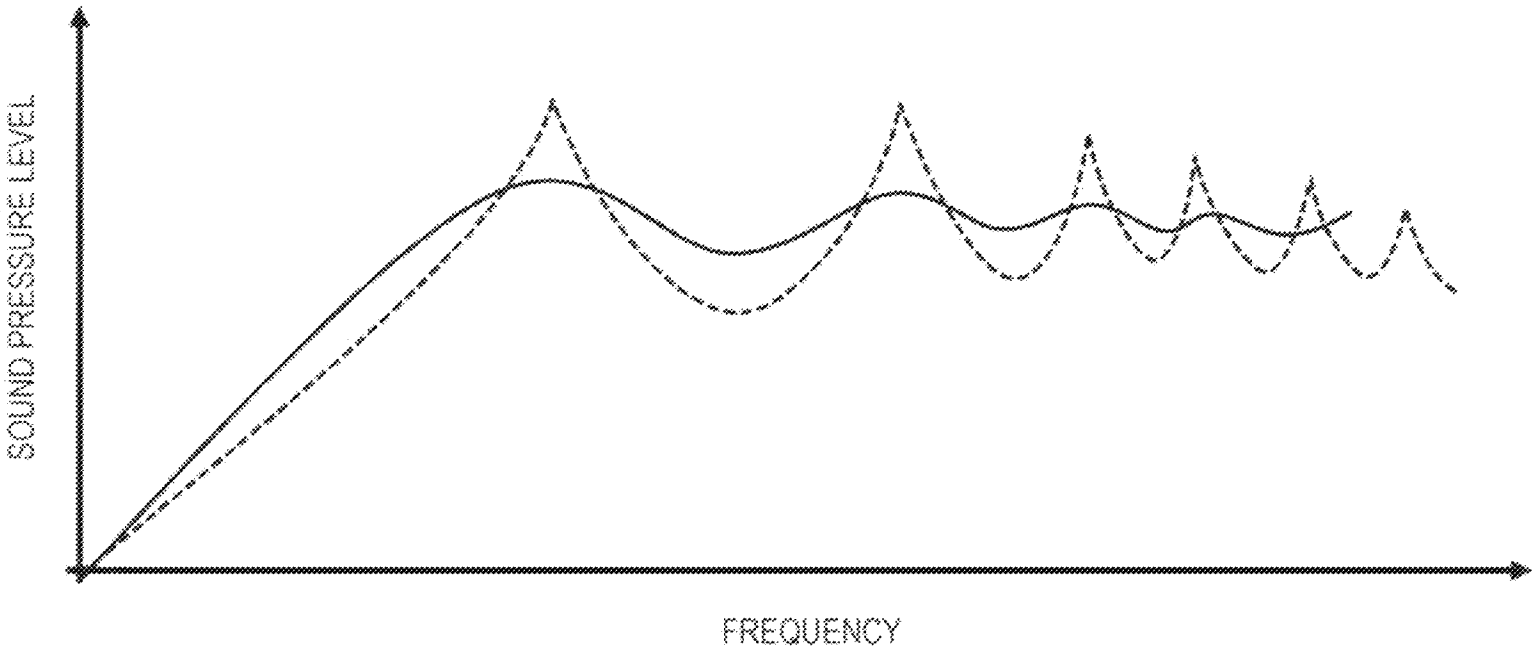
FIG. 74 is a diagram exemplarily illustrating sound characteristics (frequency level characteristics) of when using the sound guiding portion 120 that suppresses the peak characteristics of the sound pressure frequency by the resonance.

FIG. 74 exemplarily illustrates the sound characteristic (frequency level characteristic), using the sound guiding portion 120 that suppresses the peak characteristic of the sound pressure frequency due to resonance. In FIG. 74, the sound characteristic (frequency level characteristic) with a suppressed peak characteristic of the sound pressure frequency due to resonance is illustrated by the solid line, and the sound characteristic before suppression is illustrated by the dotted line, as a comparison. It is known that the output sound pressure becomes flattened in the wide frequency range by suppressing the peak characteristic of the sound pressure frequency due to resonance.

[K. Summary]

Finally, characteristics of the sound output device 100 according to the present embodiment are summarized.

(1) The listener can naturally listen to the ambient sound during wearing the sound output device 100. Therefore, the listener can use the functions of human depending on aural characteristics in a normal way, such as space perception, danger sensing, and perception of conversation and subtle nuance of conversation.

(2) The sound output device 100 does not block the ear cavity when being worn, and thus have an appearance of being welcomed to talk to from other people. Further, the listener who wears the sound output device 100 can hear the ambient sound on a constant basis, and thus takes, as nature of human, passive behavior such as "turn to the direction of the sound", "slide a glance at the direction of the sound", and the like from sound information such as footsteps of someone approaching. Such behavior gives people around an impression of being "welcomed to talk to", and does not impede interpersonal communication.

(3) The sound output device 100 is not affected by self-generated noises. The other end 122 of the sound guiding portion 120 as the sound output hole is separated from the inner wall of the ear canal when being worn on the ear cavity. Therefore, the listener is not affected by the own voice, heart beat, chewing sound, sound when swallowing saliva, blood flow sound, breath sound, vibration sound traveling in the body when walking, and rustling sound of clothes such as a cord. Further, frictional sound between the earpiece and the inner wall of the ear canal is not generated. Further, since the ear cavity is open, there is no concern about dampness in the ear canal.

(4) The sound output device 100 has good wearability on the ear, and can absorb positioning variation caused by personal difference in the size and shape of the ear. The holding portion 130 is engaged with the intertragic notch and supports the other end 122 of the sound guiding portion 120 such that the sound output hole of the other end 122 faces the depth side of the ear canal. Therefore, the sound output device 100 does not require length adjustment, which is required in a case of a behind-the-ear sound output device with a sound guiding body folded back at the helix. Further, the holding portion 130 is engaged with the intertragic notch, and thus the favorable wearing state is maintained. Further, the pinch portion 123 as the folded portion of the sound guiding portion 120 pinches and fixes the ear lobe, and thus the favorable wearing state can be maintained. Further, the structure that the sound guiding portion 120 is folded back at the ear lobe from the back of the pinna and is extended to the vicinity of the entrance of the ear canal does not interfere with other devices even if the listener uses a pair of glasses, a glass-type wearable device, a behind-the-ear device at the same time.

(5) The sound guiding portion 120 propagates the sound generated in the sound generating portion 110 from behind the ear to the vicinity of the entrance of the ear canal in the shortest distance. Therefore, compared with the behind-the-ear sound output device, the sound loss can be minimized by the shortened length of the sound guiding portion, and the sound generating portion 110 can be made low output and favorable sound quality can be obtained. As an additional remark, dimensional tolerance of the sound generating portion 110 is high, and design according to a necessary acoustic band and sound pressure can be performed.

INDUSTRIAL APPLICABILITY

The technology disclosed in the present specification has been described in detail with reference to the specific embodiments. However, it is obvious that a person skilled in the art can make a revision and a substitution of the embodiments without departing from the gist of the technology disclosed in the present specification.

The sound output device to which the technology disclosed in the present specification is applied is worn on the ear of the listener and used, similarly to so-called an earphone, and is characterized in that the sound output device can output sound information while realizing the listening characteristics of ambient sound in the wearing state, which is equivalent to the non-wearing state, at the same time, and the sound output device appears not to block the ear cavity of the listener, to the people around. The sound output device to which the technology disclosed in the present specification is applied can be applied to the field of various sports played outside and inside, including walking, jogging, cycling, mount climbing, and snowboarding (during play, in remote coaching, and the like), the field of communication and presentation that requires listening to the ambient sound and presentation of audio information at the same time (for example, information supplement at the time of viewing a play, presentation of audio information at the museum, bird-watching (listening to birdsong)), driving, navigation, guards, newscasters, and the like, making use of the characteristics.

In the present specification, the technology disclosed in the present specification has been described in the form of examples. Therefore, the described content of the present specification should not be construed in a limited manner. Claims should be considered to judge the gist of the technology disclosed in the present specification.

Note that the technology disclosed in the present specification can have configurations below.

(1) A sound output device including:
- a sound generating portion arranged on a back of an ear of a listener; and
- a sound guiding portion having a hollow structure, having one end connected to the sound generating portion, and the other end arranged in a vicinity of an entrance of an ear canal of the listener, and configured to take in a sound generated in the sound generating portion from the one end and to propagate the sound to the other end.

(1-1) The sound output device according to (1), wherein the sound guiding portion has a folding structure to fold back from a front to the back of the ear in the vicinity of an end edge of an ear lobe of the listener.

(1-2) The sound output device according to (1), wherein the other end of the sound guiding portion has a smaller outer diameter than an inner diameter of the ear canal of the listener.

(2) The sound output device according to (1), further including:
- a holding portion configured to hold the other end of the sound guiding portion at the vicinity of the entrance of the ear canal of the listener.

(3) The sound output device according to (2), wherein the holding portion is engaged with an intertragic notch of the listener.

(3-1) The sound output device according to (3), wherein the holding portion supports the other end of the sound guiding portion such that the other end faces a depth of the ear canal.

(3-2) The sound output device according to (3), wherein the holding portion includes an opening portion that allows the entrance of the ear canal to open to an external environment.

(3-3) The sound output device according to (3), wherein the holding portion comes in contact with a bottom face of cavum conchae.

(3-3-1) The sound output device according to (3-3), wherein the holding portion includes a contact portion coming in contact with the bottom face of the cavum conchae by plane (or large contact area).

(3-3-2) The sound output device according to (3-3), wherein the holding portion includes a contact portion curved to become a shape of the bottom face of the cavum conchae.

(4) The sound output device according to (1), further including:
- a pinch portion configured to pinch an ear lobe of the listener to allow the sound output device to be worn on the ear.

(5) The sound output device according to (1), wherein the sound guiding portion includes a pinch portion having an open/close structure arranged at a portion where the sound guiding portion is folded back from a back side to a front side of a pinna of the listener, and the pinch portion pinches an ear lobe, using pinch force to return to a close position.

(6) The sound output device according to (1), further including:
- a pinch portion configured to pinch an ear lobe of the listener together with the sound generating portion to allow the sound generating portion to be worn on the ear.

(6-1) The sound output device according to (6), wherein the sound generating portion includes a contact portion made of a shape fit to an ear back shape surface of the listener.

(6-2) The sound output device according to (6) or (6-1), wherein the sound generating portion includes a contact portion made of a curved shape in a portion coming in contact with the ear back shape surface of the listener.

(7) The sound output device according (1), further including:
- a guard portion configured to prevent the other end of the sound guiding portion from being deeply inserted into the ear canal of the listener.

(8) The sound output device according to (2), wherein the holding portion is engaged with the vicinity of the entrance of the ear canal (intertragic notch) of the listener, and fixes the sound guiding portion to the vicinity of the other end to prevent the sound guiding portion from being deeply inserted into the ear canal.

(9) The sound output device according to (1), further including:
- a deforming portion configured to be deformed according to action of external force to prevent the other end of the sound guiding portion from being deeply inserted into the ear canal of the listener.

(10) The sound output device according to (5), wherein the sound guiding portion includes a deforming portion that is deformed according to action of external force, between the other end and the pinch portion.

(11) The sound output device according to (10), wherein the deforming portion is snapped when predetermined external force or more force is applied to prevent the other end of the sound guiding portion from being deeply inserted into the ear canal of the listener.

(12) The sound output device according to (10), wherein the deforming portion is snapped when predetermined external force or more force is applied to prevent the other end of the sound guiding portion from being deeply inserted into the ear canal of the listener, and is reconnectable.

(13) The sound output device according to (10), wherein the deforming portion is bent when the external force is applied to prevent the other end of the sound guiding portion from being deeply inserted into the ear canal of the listener, and is restored to an original shape when released from the external force.

(14) The sound output device according to (1), further including:

an earwax intrusion prevention portion to the other end of the sound guiding portion.

(14-1) The sound output device according to (14), wherein the earwax intrusion prevention portion is detachable from the other end.

(15) The sound output device according to (1), further including:

a sound volume control portion configured to adjust a sound volume of the sound output from the other end to the ear canal according to change of an inner diameter of the sound guiding portion.

(16) The sound output device according to (15), wherein the sound volume control portion performs switching of a mute-on state and a mute-off state by a toggle operation of a mute portion emerging in the sound guiding portion in response to pressing of a surface.

(17) The sound output device according to (15), wherein the sound volume control portion has a mute portion appear in the sound guiding portion in response to pressing of a surface and becomes a mute-on state, and has the mute portion disappear from the sound guiding portion when the surface is released from the pressing and becomes a mute-off state.

(18) The sound output device according to (15), wherein the sound volume control portion includes a flexible tube having a tapered structure inserted in the sound guiding portion, and a ring-like sound volume adjustment portion into which the flexible tube is inserted, and continuously sets the sound volume by continuously changing an inner diameter of the flexible tube according to a position of insertion in the sound volume adjustment portion.

(19) The sound output device according to (15), wherein the sound volume control portion includes an elastic deforming portion that configures a side surface of a part of the sound guiding portion, and a cam rotatably arranged to come in contact with the elastic deforming portion, and causes the elastic deforming portion to protrude into the sound guiding portion according to change of a rotation angle of the cam to continuously set the sound volume.

(20) The sound output device according to (1), wherein the sound generating portion includes a dynamic-type sound production element.

(21) The sound output device according to (1) or (20), further including:

a signal processing unit configured to perform gain adjustment according to a frequency level, for an audio signal input to the sound generating portion.

(22) The sound output device according to (21), wherein the signal processing unit performs signal processing for correcting attenuation of a low frequency range of an audio output from the other end of the sound guiding portion.

(23) The sound output device according to (1), wherein the sound guiding portion includes an acoustic element in at least one place in the hollow structure.

(23-1) The sound output device according to (23), wherein the sound guiding portion has the acoustic element arranged in a portion corresponding to an antinode where amplitude of a standing wave of the sound generated by resonance action in the hollow structure of one-side open is maximized.

(23-2) The sound output device according to (23), wherein the acoustic element is made of a sound hole or an air chamber formed in a wall surface of the hollow structure.

(23-2-1) The sound output device according to (23-2), wherein the acoustic element further includes acoustic resistance.

REFERENCE SIGNS LIST

100 Sound output device
110 Sound generating portion
120 Sound guiding portion
121 One end (sound input hole)
122 The other end (sound output hole)
123 Pinch portion
124 Deforming portion
130 Holding portion
132 Support member
1101 Diaphragm
1104 Magnet
1105 Voice coil
3401 Shape memory pull spring
3402 Helical structure pinch and duct
3403 Highly stretchable film
3601 Highly stretchable string
3602 Fan-shaped division-type pinch and duct
3603 Highly stretchable film
4201 Connection portion
4202 Connection portion
4203 Pinch force generation spring
4204 Highly stretchable film
4301 Magnet portion
4401 Screw-type slide portion
4402 Hook portion
4501 Thin vulnerable portion
4601 Joint-type vulnerable portion
4701 Soft structure bending portion
4801 Earwax intrusion prevention portion
4901 Earwax intrusion prevention filter
5000 Sound volume control portion
5001 Mute portion
5002 Mute sound volume adjustment portion
5701 Flexible tube
5702 Sound volume adjustment portion
6001 Elastic deforming portion
6002 Cam
6003 Rotation axis

The invention claimed is:

1. A sound output device, comprising:

a sound generating portion arranged to be on a back side of an ear lobe of an ear, wherein the sound generating portion is configured to generate sound;

a sound guiding portion configured to:

receive the sound generated by the sound generating portion from a first end of the sound guiding portion; and propagate the sound to a second end of the sound guiding portion, wherein the sound guiding portion has a hollow tube structure arranged to be connected to the sound generating portion at the first end and to be located in a vicinity of an entrance of an ear canal of the ear at the second end, wherein the sound guiding portion includes a bent portion around a first portion of the ear lobe, and wherein the bent portion is folded back from the back side of the ear lobe to a front side of a pinna of the ear; and a holding portion configured to hold the second end of the sound guiding portion at the vicinity of the entrance of the ear canal of the ear, wherein the holding portion is positioned outside the ear canal, and wherein the holding portion comprises an opening portion configured to open the entrance of the ear canal to ambient sound such that the ambient sound enters the ear canal.

2. The sound output device according to claim 1, wherein the holding portion has a ring-like structure.

3. The sound output device according to claim 2, wherein the holding portion is engageable with an intertragic notch of the ear.

4. The sound output device according to claim 1, wherein the bent portion is arranged to be folded back around one end of the ear lobe.

5. A sound output device, comprising:

a sound generating portion arranged on a back of an ear; and a sound guiding portion configured to:

receive sound generated by the sound generating portion from a first end of the sound guiding portion; and propagate the sound to a second end of the sound guiding portion, wherein the sound guiding portion includes a hollow structure connected to the sound generating portion at the first end and arranged in a vicinity of an entrance of an ear canal of the ear at the second end; and a pinch portion having an open/close structure at a first portion of the sound guiding portion, where the sound guiding portion is folded back from a back side of an ear lobe of the ear to a front side of a pinna of the ear at the first portion, and the pinch portion is configured to pinch the ear lobe by a pinch force to return to a close position.

6. The sound output device according to claim 3, wherein the holding portion is further configured to fit to a bottom face shape of a cavum conchae in the intertragic notch of the ear, and the sound generating portion is further configured to fit to an ear back shape of the ear.

7. The sound output device according to claim 1, further comprising a guard portion configured to prevent the second end of the sound guiding portion from being deeply inserted into the ear canal.

8. The sound output device according to claim 2, wherein the holding portion is further configured to:

engage with an intertragic notch of the ear; and fix the sound guiding portion to the vicinity of the second end to prevent the sound guiding portion from being deeply inserted into the ear canal.

9. The sound output device according to claim 1, further comprising a deforming portion configured to:

deform based on an action of external force; and prevent the second end of the sound guiding portion from being deeply inserted into the ear canal based on the deformation of the deforming portion.

10. The sound output device according to claim 5, wherein the sound guiding portion further includes a deforming portion between the second end and the pinch portion, wherein the deforming portion is deformed based on an action of an external force.

11. The sound output device according to claim 10, wherein the deforming portion is snapped to prevent the second end from being deeply inserted into the ear canal, wherein the deforming portion is snapped based on application of the external force that is greater than or equal to a threshold external force.

12. The sound output device according to claim 10, wherein the deforming portion is snapped to prevent the second end of the sound guiding portion from being deeply inserted into the ear canal, wherein the deforming portion is snapped based on application of the external force greater than or equal to a threshold external force, and wherein individual portions of the deforming portion are reconnectable.

13. The sound output device according to claim 10, wherein the deforming portion is bent to prevent the second end of the sound guiding portion from being deeply inserted into the ear canal, wherein the deforming portion is bent based on the external force, and wherein the deforming portion is restored to an original shape based on release of the deforming portion from the external force.

14. The sound output device according to claim 1, further comprising an earwax intrusion prevention portion at the second end of the sound guiding portion.

15. The sound output device according to claim 1, wherein the sound guiding portion is further configured to output the sound from the second end to the ear canal, and the sound guiding portion further includes a sound volume control portion configured to:

change an inner diameter of the sound guiding portion based on a pressing operation of the sound volume control portion; and adjust, based on the change of the inner diameter, a sound volume of the sound output from the second end to the ear canal.

16. The sound output device according to claim 15, wherein the sound volume control portion comprises a mute portion that is configured to:

protrude from the sound guiding portion based on the pressing operation of a surface of the sound volume control portion; and switch between a mute-on state and a mute-off state based on a toggle operation of the mute portion, wherein the toggle operation corresponds to the protrusion of the mute portion from the sound guiding portion.

17. The sound output device according to claim 15, wherein the sound volume control portion includes a mute portion configured to:

appear in the sound guiding portion based on the pressing operation of a surface of the sound volume control portion to obtain a mute-on state; and disappear from the sound guiding portion based on a release of the surface from the pressing operation to obtain a mute-off state.

18. The sound output device according to claim 15, wherein the sound volume control portion includes:

a flexible tube having a tapered structure inserted in the sound guiding portion; and a ring-like sound volume adjustment portion into which the flexible tube is inserted, wherein the sound volume control portion is configured to continuously set the sound volume based on a continuous change of an inner diameter of the flexible tube, and wherein the inner diameter of the flexible tube is changed based on a position of the insertion of the flexible tube in the ring-like sound volume adjustment portion.

19. The sound output device according to claim 15, wherein the sound volume control portion includes:

an elastic deforming portion on a side surface of the sound guiding portion; and a rotatable cam configured to contact the elastic deforming portion, wherein the elastic deforming portion is configured to:

protrude into the sound guiding portion based on a change of a rotation angle of the rotatable cam, to continuously set the sound volume.

20. A sound guiding device, comprising:

a sound generating portion configured to generate sound;

a sound guiding portion having a hollow tube structure configured to propagate the sound from a first end of the sound guiding portion on a back side of an ear lobe of an ear to a second end of the sound guiding portion in a vicinity of an entrance of an ear canal of the ear, wherein the sound guiding portion includes a bent portion around a first portion of the ear lobe, and wherein the bent portion is folded back from the back side of the ear lobe to a front side of a pinna of the ear; and a holding portion configured to:

engage with an intertragic notch of the ear such that the holding portion is outside the ear canal; and hold the second end of the sound guiding portion at the vicinity of the entrance of the ear canal of the ear, wherein the holding portion comprises an opening portion configured to open the entrance of the ear canal to ambient sound such that the ambient sound enters the ear canal.

* * * * *